US005324626A

United States Patent [19]

Shono et al.

[11] Patent Number: 5,324,626

[45] Date of Patent: Jun. 28, 1994

[54] SILVER HALIDE COLOR PHOTOGRAPHIC MATERIAL

[75] Inventors: Akiko Shono; Nobuo Seto, both of Minami-ashigara, Japan

[73] Assignee: Fuji Photo Film Co., Ltd., Kanagawa, Japan

[21] Appl. No.: 909,719

[22] Filed: Jul. 7, 1992

[30] Foreign Application Priority Data

Jul. 9, 1991 [JP] Japan ..... 3-193695

[51] Int. Cl.[5] ..... G03C 1/46

[52] U.S. Cl. ..... 430/503; 430/551; 430/557; 430/372

[58] Field of Search ..... 430/549, 555, 503, 557, 430/551, 372

[56] References Cited

U.S. PATENT DOCUMENTS

| | | | |
|---|---|---|---|
| 4,149,886 | 4/1979 | Tanaka et al. | 430/557 |
| 4,248,961 | 2/1981 | Hagen et al. | 430/557 |
| 4,289,847 | 9/1981 | Ishikawa et al. | 430/557 |
| 4,857,444 | 8/1989 | Hirose et al. | 430/549 |
| 5,104,782 | 4/1992 | Seto et al. | 430/551 |
| 5,212,052 | 5/1993 | Sakanoue et al. | 430/557 |
| 5,213,958 | 5/1993 | Motoki et al. | 430/557 |

FOREIGN PATENT DOCUMENTS

| | | |
|---|---|---|
| 59-116747 | 7/1984 | Japan . |
| 60-222853 | 11/1985 | Japan . |
| 62-239149 | 10/1987 | Japan . |
| 62-240965 | 10/1987 | Japan . |
| 62-254149 | 11/1987 | Japan . |
| 2-300748 | 12/1990 | Japan . |

*Primary Examiner*—Charles L. Bowers, Jr.
*Assistant Examiner*—Geraldine Letscher
*Attorney, Agent, or Firm*—Birch, Stewart, Kolasch & Birch

[57] ABSTRACT

There is disclosed a silver halide color photographic material, which comprises a compound represented by formula (I) in a photosensitive layer or a non-photosensitive layer and a yellow dye-forming coupler represented by formula (II), (III), or (IV) in a blue-sensitive silver halide emulsion layer:

wherein $R_1$ represents an alkyl group, an alkenyl group, an aryl group, a heterocyclic group, a silyl group, an acyl group, a sulfonyl group, or an $R_o$ group; $R_2$, $R_3$, $R_4$, $R_5$, and $R_6$ each represent a hydrogen atom, a halogen atom, an alkyl group, an alkenyl group, an aryl group, a substituted amino group, an alkylthio group, an arylthio group, an $R_p$ group, an $R_q$ group, an $R_r$ group, an $R_s$ group, an $R_t$ group, or an $R_u$ group; $R_{1a}$, $R_{1b}$, and $R_{1c}$ have the same meaning as that of $R_1$; $R_2$ and $R_3$, $R_3$ and $R_4$, or $R_5$ and $R_6$ may bond together to form a 5- or 6-membered ring or a spiro ring; and v and w each represent 0 or 1, provided that at least one of v and w is 0, $R_o$ $R_p$ $-SO_2R_{1a}$ $R_q$ $R_r$ $R_s$ -continued
$R_t$ $-\overset{O}{\overset{\|}{C}}-O-R_{1a}$
$R_u$ $-OR_{1a}$
Formula (II)
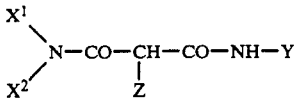
-continued
Formula (III)
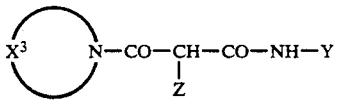
Formula (IV)
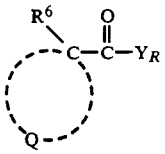
wherein the substituents of formulae (II), (III) and (IV) are as defined in the specification.
27 Claims, No Drawings

SILVER HALIDE COLOR PHOTOGRAPHIC MATERIAL

FIELD OF THE INVENTION

The present invention relates to a silver halide color photographic material, and more particularly to a silver halide color photographic material that is improved in emulsion stability, color reproduction, and preservability of the dye images.

BACKGROUND OF THE INVENTION

In silver halide color photographic materials, as photographic couplers that will react with the oxidized product of an aromatic primary amine developing agent to form color-formed dyes, generally a yellow coupler, a magenta coupler, and a cyan coupler are used in combination.

The color-formed dyes obtained from these couplers are required to have, for example, excellent spectral absorption properties and high fastness to light, heat, humidity, etc. The excellent spectral absorption properties desired in photographic materials should be such that color-formed dyes formed from respective couplers do not have undesired absorption in wavelength regions other than the desired major absorption. For example, in the case of yellow color-formed dyes, since the major absorption part of the formed dye is broad, the color reproduction of yellow hue and green hue is unsatisfactory.

In color print materials to be used for recording and storing images, conventionally, pivaloylacetanilide-type yellow couplers are used. However, since the major absorption of the yellow dyes obtained from these couplers is broad, the color reproduction is unsatisfactory and a technique for its improvement is desired. The fastness of the color-formed dyes obtained from the above-mentioned yellow couplers is poorer than that of the color-formed dyes obtained from magenta couplers and cyan couplers, the change in color balance of the respective color-formed dyes during long-term storage is conspicuous, and therefore the improvement is strongly desired.

Thus, to improve light-fastness of such yellow color-formed dyes, steric hindrance phenol compounds described, for example, in JP-A ("JP-A" means unexamined published Japanese patent application) Nos. 48535/1979 and 222853/1985, polyalkylpiperidine compounds described, for example, in JP-B ("JP-B" means examined Japanese patent publication) No. 20617/1982 and JP-A Nos. 116747/1984 and 11935/1984, and compounds described, for example, in JP-A Nos. 239149/1987, 240965/1987, 254149/1987, and 300748/1990, are known, and when yellow couplers are used in combination with these compounds, fastness to light is indeed improved. However, the improved effect is still not at the satisfactory level, and it is found that, for example, the stability of the emulsion is deteriorated.

The deterioration of the stability of the emulsion results in serious problems in photographic performance; that is, (1) after a lapse of time the coupler dissolved in the oil droplets deposits, thereby causing coating trouble or a drop in the color density, or (2) after a lapse of time the diameter of the oil droplets increases, thereby causing a decrease called haze and lowering of the apparent color density.

Thus, no technique that can satisfy all of the above performances has yet been developed.

SUMMARY OF THE INVENTION

Therefore the object of the present invention is to provide a silver halide color photographic material that is excellent in spectral absorption properties of the yellow color-formed dye that will be formed, and that is improved in light fastness without deteriorating such performances as the emulsion stability.

The above and other objects, features, and advantages of the invention will become fully apparent in the following description.

DETAILED DESCRIPTION OF THE INVENTION

The present inventors have studied in various ways and have found that the above object can be attained by providing a silver halide color photographic material having, a blue-sensitive silver halide emulsion layer, a green-sensitive silver halide emulsion layer, a red-sensitive silver halide emulsion layer, and non-photosensitive layers adjacent to these emulsion layers, on a base, which comprises, in at least one of said photosensitive layers or non-photosensitive layers, at least one compound represented by the following formula (I), and in said blue-sensitive silver halide layer, at least one coupler selected from the group consisting of yellow couplers represented by the following formula. (II) or (III) and an α-acylacetamide yellow coupler represented by formula (IV):

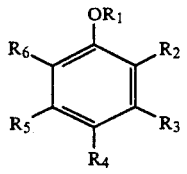

wherein $R_1$ represents an alkyl group, an alkenyl group, an aryl group, a heterocyclic group, a silyl group, an acyl group, a sulfonyl group, or an $R_o$ group shown below in which $R_{1a}$ and $R_{1b}$ may be the same or different; $R_2$, $R_3$, R, $R_5$, and $R_6$, which may be the same or different, each represent a hydrogen atom, a halogen atom, an alkyl group, an alkenyl group, an aryl group, a substituted amino group, an alkylthio group, an arylthio group, an $R_p$ group, an $R_q$ group, an $R_r$ group, an $R_s$ group, an $R_t$ group, or an $R_u$ group, shown below; $R_{1a}$, $R_{1b}$, and $R_{1c}$ have the same meaning as that of $R_1$; $R_2$ and $R_3$, $R_3$ and $R_4$, or $R_5$ and $R_6$ may bond together to form a 5- or 6-membered ring or a spiro ring; and v and w each represent 0 or 1, provided that at least one of v and w is 0,

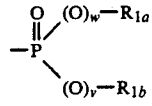

$R_o$

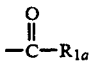

$R_p$ $-SO_2R_{1a}$ $R_q$

-continued

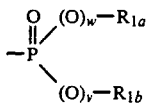

$R_r$

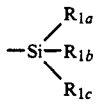

$R_s$

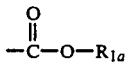

$R_t$ $-OR_{1a}$ $R_u$

Formula (II)

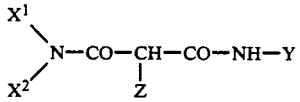

Formula (III)

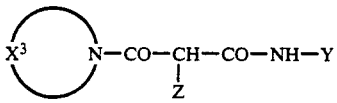

wherein $X^1$ and $X^2$ each represent an alkyl group, an aryl group, or a heterocyclic group, $X^3$ represents an organic residue which forms together with the >N- a nitrogen-containing heterocyclic group, Y represents an aryl group or a heterocyclic group, and Z represents a group which will be released upon a coupling reaction of the coupler represented by the formula (II) or (III) with the oxidized product of a developing agent, Formula (IV)

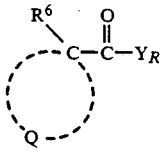

wherein $R^6$ represents a monovalent group, Q represents a group of non-metallic atoms required to form together with C (carbon atom) a substituted or unsubstituted 3- to 5-membered cyclic hydrocarbon group or a substituted or unsubstituted heterocyclic group having in the group at least one heteroatom selected from the group consisting of N, S, O, and P, and $Y_R$ represents a residue remaining after removing the acyl group

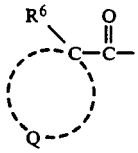

at the α-position of the acetamide moiety from the acetylacetamide yellow coupler represented by formula (IV), provided that $R^6$ is a group other than hydrogen atom and does not bond to the Q to form a ring.

The specific construction of the present invention will now be described in detail.

First the compounds represented by formula (I) will be described in detail. In formula (I), $R_1$ represents an alkyl group (having preferably 1 to 40 carbon atoms, more preferably 1 to 30 carbon atoms, e.g., methyl, n-butyl, n-octyl, n-hexadecyl, ethoxyethyl, 3-phenoxypropyl, and benzyl), an alkenyl group (having preferably 2 to 40 carbon atoms, more preferably 2 to 30 carbon atoms, e.g., vinyl and allyl), an aryl group (having preferably 6 to 40 carbon atoms, more preferably 6 to 30 carbon atoms, e.g., phenyl and naphthyl), a heterocyclic group (having preferably 1 to 40 carbon atoms, more preferably 1 to 30 carbon atoms, e.g., pyridyl and tetrahydropyranyl), a silyl group (having preferably 1 to 40 carbon atoms, more preferably 1 to 30 carbon atoms, e g., trimethylsilyl and t-butyldimethylsilyl), an acyl group (having preferably 2 to 40 carbon atoms, more preferably 2 to 30 carbon atoms, e.g., acetyl, benzoyl, and dodecanoyl), a sulfonyl group (having preferably 1 to 40 carbon atoms, more preferably 1 to 30 carbon atoms, e.g., methanesulfonyl, octanesulfonyl, and benzenesulfonyl), or an $R_0$ group; $R_2$, $R_3$, $R_4$, $R_5$, and $R_6$, which may be the same or different, each represent a hydrogen atom, an alkyl group (having preferably 1 to 40 carbon atoms, more preferably 1 to 30 carbon atoms, e.g., methyl, n-butyl, n-octyl, sec-dodecyl, t-butyl, t-amyl, t-hexyl, t-octyl, t-octadecyl, α,α-dimethylbenzyl, and 1,1-dimethyl-4-hexyloxycarbonylbutyl), an alkenyl group (having preferably 2 to 40 carbon atoms, more preferably 2 to 30 carbon atoms, e.g., vinyl and allyl), an aryl group (having preferably 6 to 40 carbon atoms, more preferably 6 to 30 carbon atoms, e.g., phenyl, naphthyl, p-methoxyphenyl, and 2,4-t-butylphenyl), a substituted amino group (having preferably 0 to 40 carbon atoms, more preferably 0 to 30 carbon atoms, e.g., acetylamino, propylamino, benzamino, N-methylamino, N,N-dimethylamino, N,N-dihexylamino, N-cyclohexylamino, N-(t-butyl)amino, and a nitrogen-containing heterocyclic group whose substituent is a closed ring (having preferably 1 to 40 carbon atoms, more preferably 1 to 30 carbon atoms, e.g., piperidino and 1-piperazinyl), alkylthio group (having preferably 1 to 40 carbon atoms, more preferably 1 to 30 carbon atoms, e.g., methylthio, n-butylthio, sec-butylthio, t-butylthio, and dodecylthio), an arylthio group (having preferably 6 to 40 carbon atoms, more preferably 6 to 30 carbon atoms, e.g., phenylthio and naphthylthio), a halogen atom (e.g., chlorine and bromine), an $R_p$ group (e.g., acetyl, capryl, p-methoxybenzoyl, octadecanoyl, dodecanoyl, and octanoyl), an $R_q$ (e.g., methanesulfonyl, octanesulfonyl, and benzenesulfonyl), an $R_r$ group, an $R_s$ group, an $R_t$ group (e.g., octyloxycarbonyl and 2,4-di-t-butylphenoxycarbonyl), or an $R_u$ group; $R_{1a}$, $R_{1b}$, and $R_{1c}$ have the same meaning as that of $R_1$; $R_1$ and $R_2$ may bond together to form a 5- or 6-membered ring or a spiro ring, and $R_2$ and $R_3$, or $R_3$ and $R_4$ may bond together to form a 5- or 6-membered ring or a spiro ring; and v and w each are 0 or 1, provided that at least one of v and w is 0. $R_{1a}$, $R_{1b}$, and $R_{1c}$ each preferably represent an alkyl group, an alkenyl group, an aryl group, a heterocyclic group, a silyl group, an acyl group or a sulfonyl group. Examples of the rings include a chroman ring, a coumaran ring, a spirochroman ring, and a spiroindane ring.

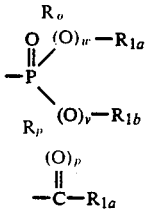

-continued

| | |
|---|---|
| $-SO_2R_{1a}$ | $R_q$ |
| $-P(=O)(O)_w-R_{1a}$, $(O)_v-R_{1b}$ | $R_r$ |
| $-Si(R_{1a})(R_{1b})R_{1c}$ | $R_s$ |
| $-C(=O)-O-R_{1a}$ | $R_t$ |
| $-OR_{1a}$ | $R_u$ |

Of the compounds represented by formula (I), compounds represented by the following formulae (I-a) to (I-h) are more preferable in view of the effect of the present invention.

Formula (I-a)

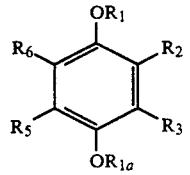

Formula (I-b)

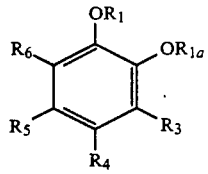

Formula (I-c)

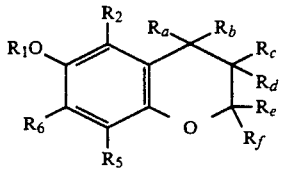

Formula (I-d)

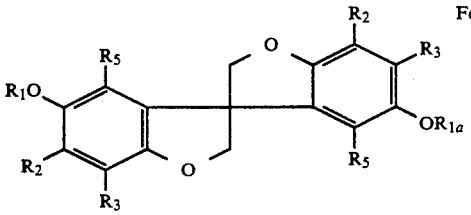

Formula (I-e)

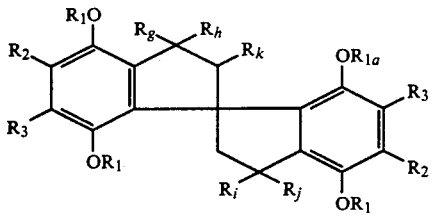

-continued

Formula (I-f)

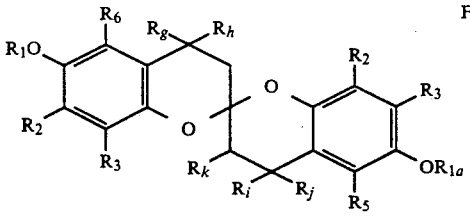

Formula (I-g)

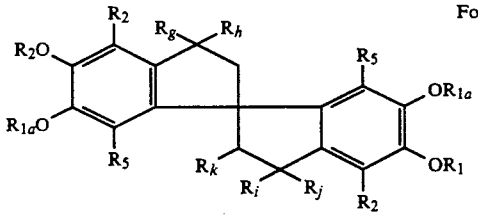

Formula (I-h)

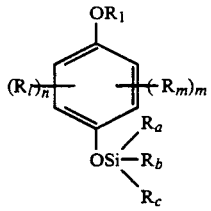

In formulae (I-a) to (I-h), $R_1$, $R_{1a}$, $R_2$, $R_3$, $R_4$, $R_5$, $R_6$ have the same meanings as those in formula (I), $R_a$ to $R_k$, which may be the same or different, each represent a hydrogen atom, an alkyl group (e.g., methyl, ethyl, isopropyl, and dodecyl), or an aryl group (e.g., phenyl and p-methoxyphenyl), $R_d$ and $R_e$, and $R_e$ and $R_f$ may bond together to form a 5- to 7-membered hydrocarbon ring, $R_l$ and $R_m$, which may be the same or different, each represent a hydrogen atom, an alkyl group (e.g., methyl, ethyl, and dodecyl), an aryl group (e.g., phenyl and 4-chlorophenyl), an acyl group (e.g., acetyl, benzoyl, and dodecanoy), an oxycarbonyl group (e.g., methoxycarbonyl and 4-dodecyloxyphenoxycarbonyl), or a sulfonyl group (e.g., methanesulfonyl, octanesulfonyl, and benzenesulfonyl), $R_l$ and $R_m$ do not represent hydrogen atoms at the same time respectively, $R_l$ and $R_m$ may bond together to form a 5- to 7-membered ring (e.g., a morpholino ring and a piperidine ring, m is 1 or 2, and n is 0 to 1, provided that m+n is 1 or 2).

Out of the compounds represented by formulae (I-a) to (I-h), those wherein $R_1$ and $R_{1a}$ each represent an alkyl group or an aryl group are preferable, with an alkyl group being the most preferable. Out of the compounds represented by formulae (I-a) to (I-h), those wherein $R_2$ to $R_6$ each represent a hydrogen atom, an alkyl group or an aryl group are preferable.

Out of the compounds represented by formulae (I-a) to (I-h), preferable compounds are the compounds represented by formulae (I-d), (I-e), (I-g), and (I-h) with the compounds represented by formula (I-g) being the most preferable in view of the effect of the present invention.

Specific examples of the compound represented by formula (I) are shown below, which is not intended to limit the present invention:

I-1
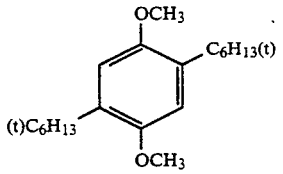
I-2
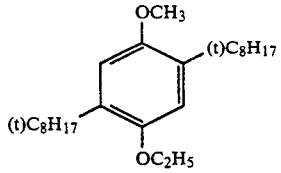
I-3
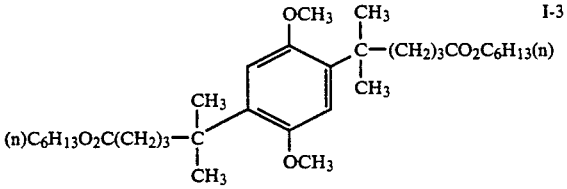
I-4
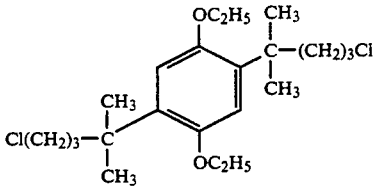
I-5
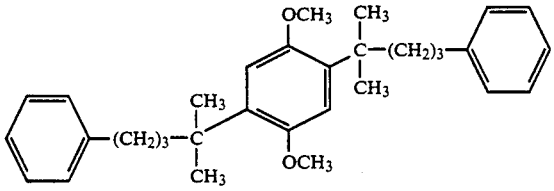
I-6
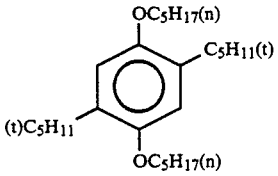
I-7
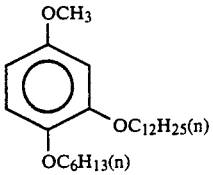
I-8
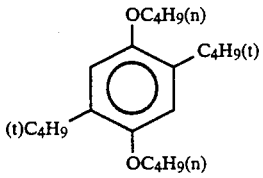
I-9
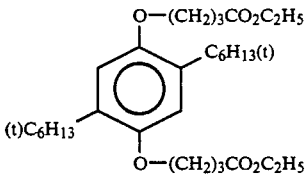
I-10
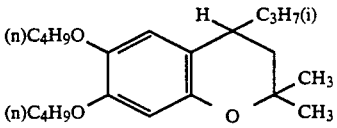
I-11
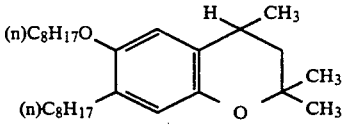
I-12
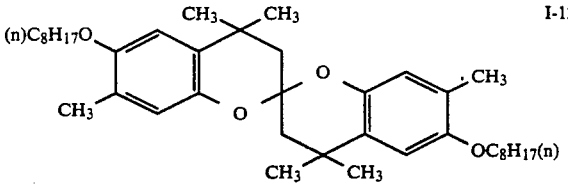
I-13
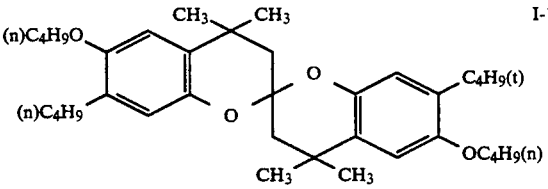
I-14
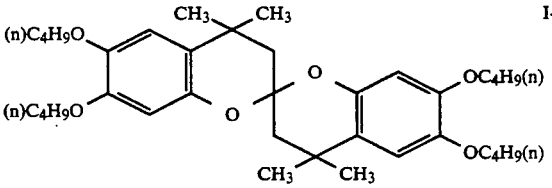
I-15
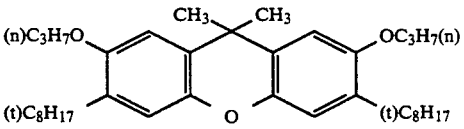
I-16
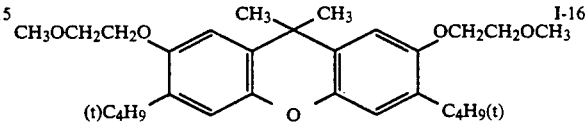

-continued
I-17
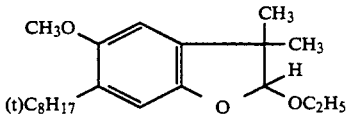
I-18
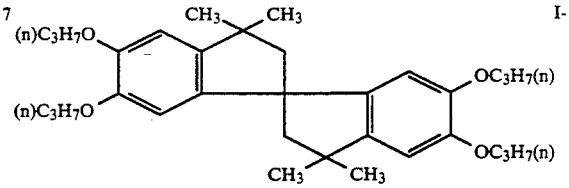
I-19
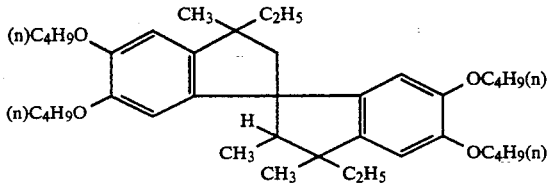
I-20
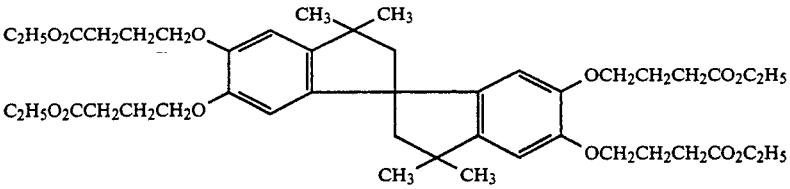
I-21
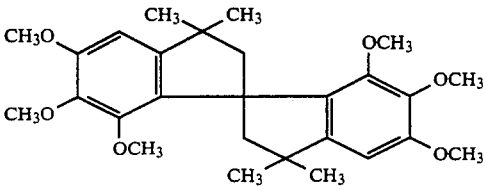
I-22
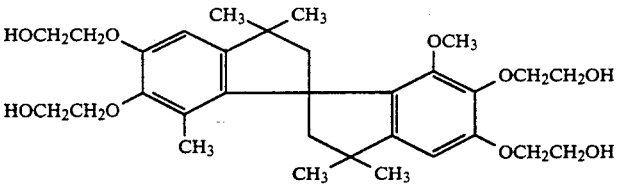
I-23
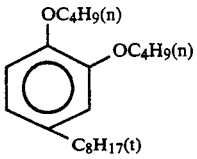
I-24
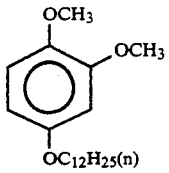
I-25
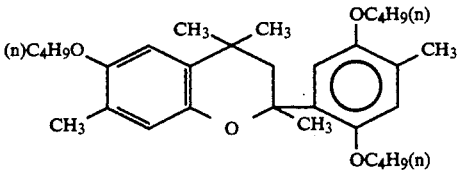
I-26
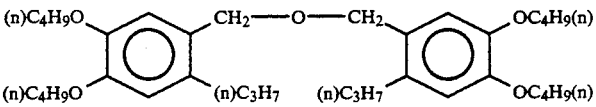

-continued
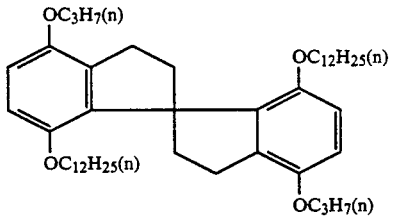
I-27
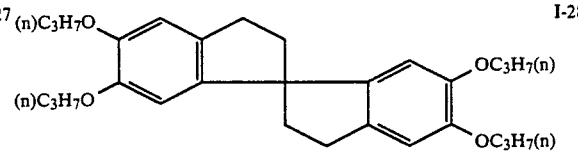
I-28
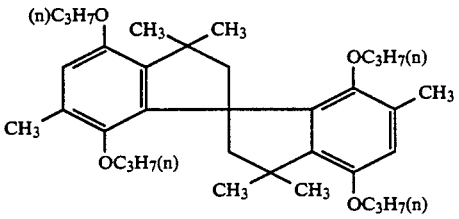
I-29
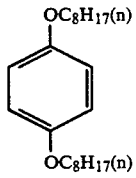
I-30
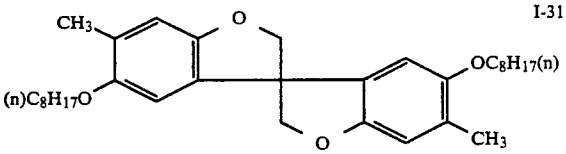
I-31
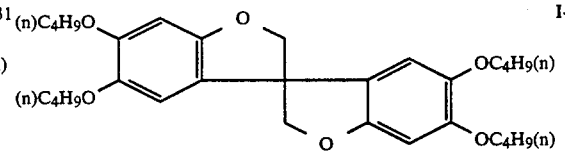
I-32
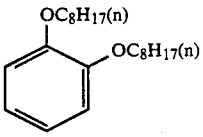
I-33
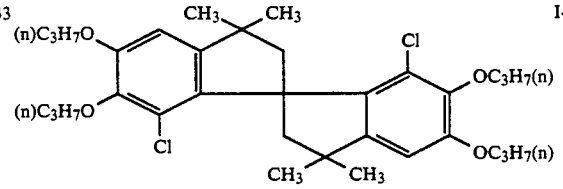
I-34
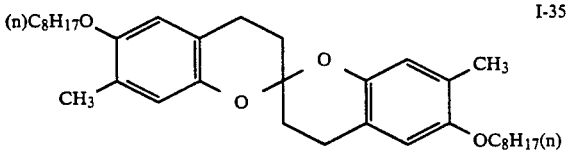
I-35
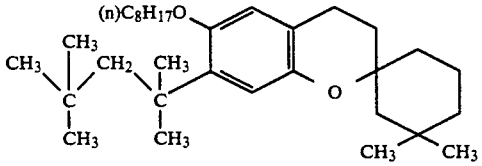
I-36
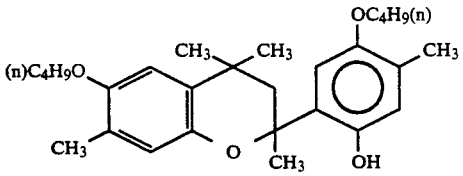
I-37
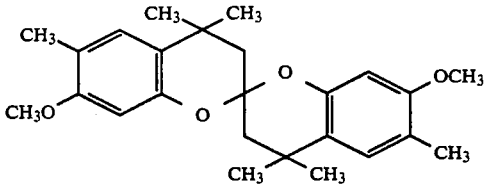
I-38
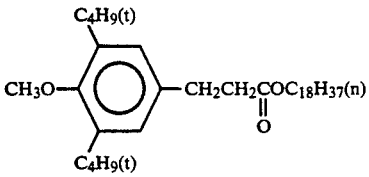
I-39
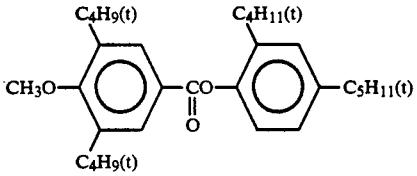
I-40
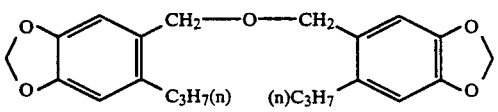
I-41
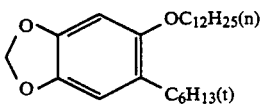
I-42

-continued
I-43
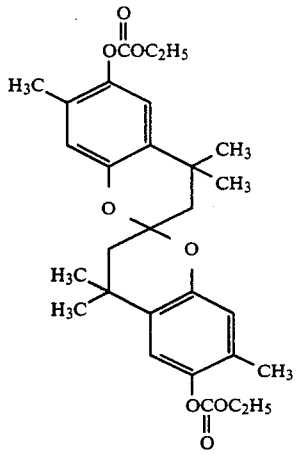
I-44
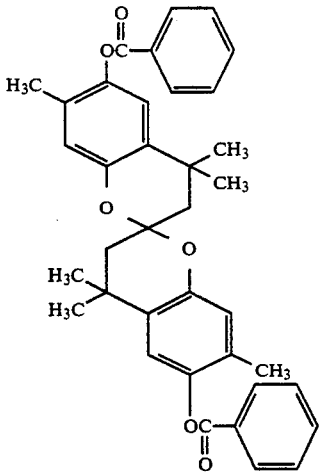
I-45
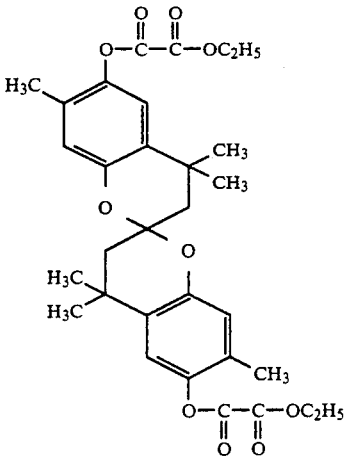
I-46
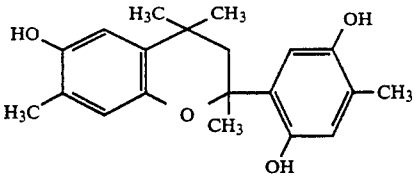
I-47
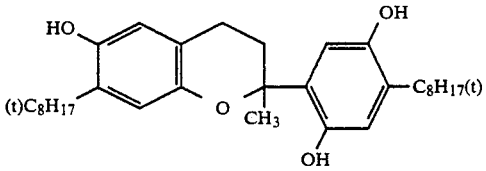
I-48
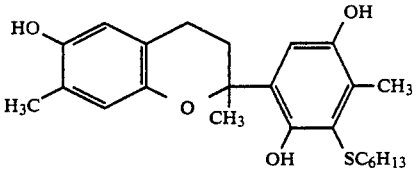
I-49
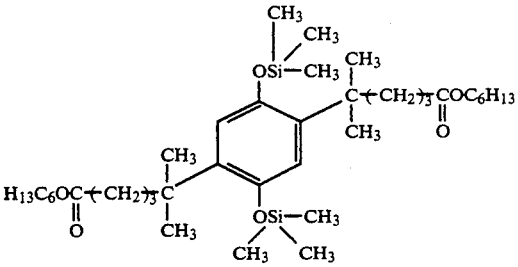
I-50
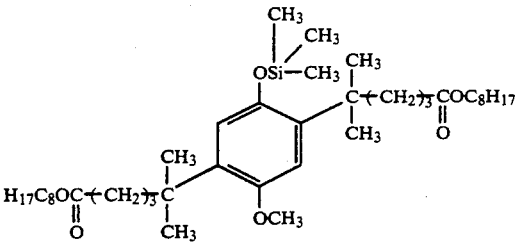
I-51
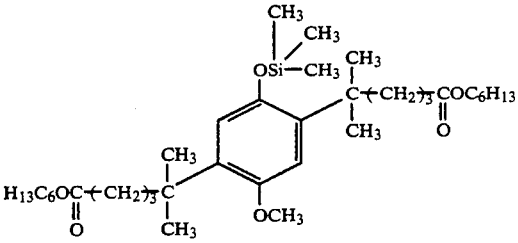
I-52
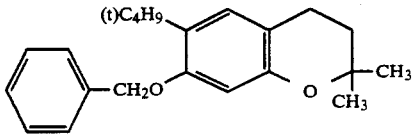

-continued

I-53

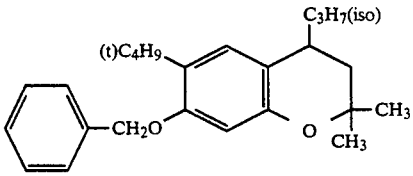

I-54

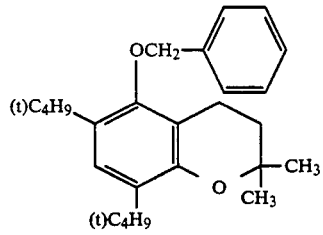

I-55

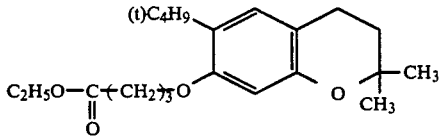

I-56

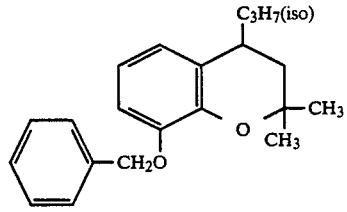

These compounds can be synthesized by or in accordance with methods described, for example, in JP-B Nos. 14034/1970, 24257/1981, 19763/1982, and 52421/1984, JP-A Nos. 152225/1987, 52057/1980, 89835/1980, 159644/1981, 211454/1985, 244045/1987, 244046/1987, 273531/1987, 220142/1988, 95439/1988, 95448/1988, and 95450/1988, and European Patent No. 0,239,972.

The compound represented by formula (I) is contained in an amount generally in the range of 0.01 to 2.0 mol, more preferably in the range of 0.2 to 1.0 mol, per mol of the yellow coupler of the present invention. Although the compound represented by formula (I) may be added to any layer, preferably the compound is added to the layer containing the yellow coupler or its adjacent layer with the former layer being more preferable.

Couplers represented by formula (II) and (III) will be described in detail.

When $X^1$ and $X^2$ represent an alkyl group, the alkyl group is a straight-chain, branched chain, or cyclic, saturated or unsaturated, substituted or unsubstituted alkyl group that has 1 to 30 carbon atoms, preferably 1 to 20 carbon atoms. As an example of the alkyl group, methyl, ethyl, propyl, butyl, cyclopropyl, allyl, t-octyl, i-butyl, dodecyl, or 2-hexyldecyl can be mentioned.

When $X^1$ and $X^2$ represent a heterocyclic group, the heterocyclic group is a 3- to 12-membered, preferably a 5- to 6-membered, saturated or unsaturated, substituted or unsubstituted, monocyclic or condensed ring heterocyclic group that has 1 to 20 carbon atoms, preferably 1 to 10 carbon atoms, and at least one heteroatom, such as a nitrogen atom, an oxygen atom, or a sulfur atom. As an example of the heterocyclic group, 3-pyrrolidinyl, 1,2,4-triazole-3-yl, 2-pyridyl, 4-prymidinyl, 3-pyrazolyl, 2-pyrrolyl, 2,4-dioxo-1,3-imidazolidine-5-yl, or pyranyl can be mentioned.

When $X^1$ and $X^2$ represent an aryl group, the aryl group is a substituted or unsubstituted aryl group that has 6 to 20 carbon atoms, preferably 6 to 10 carbon atoms. As a typical example of the aryl group, a phenyl group or a naphthyl group can be mentioned.

When $X^3$ represents a nitrogen-containing heterocyclic group together with the >N-, the heterocyclic group is a 3- to 12-membered, preferably 5- to 6-membered, substituted or unsubstituted, saturated or unsaturated, monocyclic or condensed ring heterocyclic group that has 1 to 20 carbon atoms, preferably 1 to 15 carbon atoms and may contain in addition to the nitrogen atom, for example, an oxygen atom or a sulfur atom as heteroatom. As an example of the heterocyclic group, pyrrolidino, piperidino, morpholino, 1-piperazinyl, 1-indolinyl, 1,2,3,4-tetrahydroquinoline-1-yl, 1-imidazolidinyl, 1-pyrazolyl, 1-pyrrolinyl, 1-pyrazolidinyl, 2,3-dihydro-1-indazolyl, 2-isoindolinyl, 1-indolyl, 1-pyrrolyl, 4-thiazine-S,S-dioxo-4-yl or benzoxadine-4-yl can be mentioned.

When $X^1$ and $X^2$ represent a substituted alkyl, aryl or heterocyclic group and $X^3$ represents a substituted nitrogen-containing heterocyclic group together with the >N-, examples of the substituent include: a halogen atom (e.g., fluorine and chlorine), an alkoxycarbonyl group (having preferably 2 to 30 carbon atoms, and more preferably 2 to 20 carbon atoms, e.g., methoxycarbonyl, dodecyloxycarbonyl, and hexadecyloxycarbonyl), an acylamino group (having preferably 2 to 30 carbon atoms, and more preferably 2 to 20 carbon atoms, e.g., acetamido, tetradecaneamido, 2-(2,4-di-t-amylphenoxy)butaneamido, and benzamido), a sulfonamido group ( having preferably 1 to 30 carbon atoms, and more preferably 1 to 20 carbon atoms, e.g., methanesulfonamido, dodecanesulfonamido, hexadecylsulfonamido, and benzenesulfonamido), a carbamoyl group (having preferably 1 to 30 carbon atoms, and more preferably 1 to 20 carbon atoms, e.g., N-butylcarbamoyl and N,N-diethylcarbamoyl), an N-sulfonylcarbamoyl group (having preferably 1 to 30 carbon atoms, and more preferably 1 to 20 carbon atoms, e.g., N-mesylcarbamoyl and N-dodecylsulfonylcarbamoyl), a sulfamoyl group (having preferably 1 to 30 carbon atoms, and more preferably 1 to 20 carbon atoms, e.g., N-butylsulfamoyl, N-dodecylsulfamoyl, N-hexadecylsulfamoyl, N-3-(2,4-di-t-amylphenoxy)butylsulfamoyl, and N,N-diethylsulfamoyl), an alkoxy group (having preferably 1 to 30 carbon atoms, and more preferably 1 to 20 carbon atoms, e.g., methoxy, hexadecyloxy, and isopropoxy), an aryloxy group (preferably having 6 to 20 carbon atoms, and more preferably 6 to 10 carbon atoms, e.g., phenoxy, 4-methoxyphenoxy, 3-t-butylhydroxyphenoxy, and naphthoxy), an aryloxycarbonyl group (preferably having 7 to 21 carbon atoms, and more preferably 7 to 11, e.g., phenoxycarbonyl), an N-acylsulfamoyl group (having preferably 2 to 30 carbon atoms, and more preferably 2 to 20 carbon atoms, e.g., N-propanoylsulfamoyl and N-tetradecanoylsulfamoyl), a sulfonyl group (having preferably 1 to 30 carbon atoms, and more preferably 1 to 20 carbon atoms, e.g., methanesulfonyl, octanesulfonyl, 4-hydroxyphenylsulfonyl, and dodecanesulfonyl), an alkoxycarbonylamino group (having preferably 1 to 30 carbon atoms, and more preferably 1 to 20 carbon atoms, e.g., ethoxycarbonylamino), a cyano group, a nitro group, a carboxyl group, a hydroxyl group, a sulfo group, an alkylthio group (having preferably 1 to 30 carbon atoms, and more preferably 1 to 20 carbon atoms, e.g., methylthio, dodecylthio, and dodecylcarbamoylmethylthio), a ureido group (having preferably 1 to 30 carbon atoms, more preferably 1 to 20 carbon atoms, e.g., N-phenylureido and N-hexadecylureido), an aryl group (having preferably 6 to 20 carbon atoms, and more preferably 6 to 10 carbon atoms, e.g., phenyl, naphthyl, and 4-methoxyphenyl), a heterocyclic group (that is a 3- to 12-membered, preferably 5- to 6-membered, monocyclic or condensed ring having preferably 1 to 20 carbon atoms, and more preferably 1 to 10 carbon atoms and containing at least one heteroatom, such as a nitrogen atom, an oxygen atom, and a sulfur atom, e.g., 2-pyridyl, 3-pyrazolyl, 1-pyrrolyl, 2,4-dioxo-1,3-imidazolidine-1-yl, 2-benzoxazolyl, morpholino, and indolyl), an alkyl group (which may be straight-chain, branched chain, or cyclic and saturated or unsaturated and preferably has 1 to 30 carbon atoms, and more preferably 1 to 20 carbon atoms, e.g., methyl, ethyl, isopropyl, cyclopropyl, t-pentyl, t-octyl, cyclopentyl, t-butyl, s-butyl, dodecyl, and 2-hexyldecyl), an acyl group (preferably having 1 to 30 carbon atoms, and more preferably 2 to 20 carbon atoms, e.g., acetyl and benzoyl), an acyloxy group (having preferably 2 to 30 carbon atoms, and more preferably 2 to 20 carbon atoms, e.g., propanoyloxy and tetradecanoyloxy), an arylthio group (having preferably 6 to 20 carbon atoms, and more preferably 6 to 10 carbon atoms, e.g., phenylthio and naphthylthio), a sulfamoylamino group (having preferably 0 to 30 carbon atoms, and more preferably 0 to 20 carbon atoms, e.g., N-butylsulfamoylamino, N-dodecylsulfamoylamino, and N-phenylsulfamoylamino), or an N-sulfonylsulfamoyl group (having preferably 1 to 30 carbon atoms, and more preferably 1 to 20 carbon atoms, e.g., N-mesylsulfamoyl, N-ethanesulfonylsulfamoyl, N-dodecanesulfonylsulfamoyl, and N-hexadecanesulfonylsulfamoyl). These substituents may be further substituted. Examples of the substituent include those mentioned above.

Among the above substituents, preferable one includes, for example, an alkoxy group, a halogen atom, an alkoxycarbonyl group, an acyloxy group, an acylamino group, a sulfonyl group, a carbamoyl group, a sulfamoyl group, a sulfonamido group, a nitro group, an alkyl group, or an aryl group.

When Y in formulas (II) and (III) represents an aryl group, the aryl group is a substituted or unsubstituted aryl group having preferably 6 to 20 carbon atoms, and more preferably 6 to 10 carbon atoms. Typical examples thereof are a phenyl group and a naphthyl group.

When Y in formulas (II) and (III) represents a heterocyclic group, the heterocyclic group has the same meaning as that of the heterocyclic group represented by $X^1$ and $X^2$.

When Y represents a substituted aryl group or a substituted heterocyclic group, examples of the substituent include those mentioned as examples of the substituent possessed by $X^1$. Preferable examples of the substituted aryl group and heterocyclic group represented by Y are those wherein the substituted group has a halogen atom, an alkoxycarbonyl group, a sulfamoyl group, a carbamoyl group, a sulfonyl group, an N-sulfonylsulfamoyl group, an N-acylsulfamoyl group, an alkoxy group, an acylamino group, an N-sulfonylcarbamoyl group, a sulfonamido group, or an alkyl group.

A particularly preferable example of Y is a phenyl group having at least one substituent in the ortho position.

The group represented by Z in formulas (II) and (III) may be any one of conventionally known coupling releasing groups. Preferably Z includes, for example, a nitrogen-containing heterocyclic group bonded to the coupling site through the nitrogen atom, an aryloxy group, an arylthio group, a heterocyclic oxy group, a heterocyclic thio group, an acyloxy group, a carbamoyloxy group, an alkylthio group, or a halogen atom.

These coupling releasing groups may be any one of non-photographically useful groups, photographically useful groups, or precursors thereof (e.g., a development retarder, a development accelerator, a desilvering accelerator, a fogging agent, a dye, a hardener, a coupler, a developing agent oxidized product scavenger, a fluorescent dye, a developing agent, or an electron transfer agent).

When Z is a photographically useful group, one which is conventionally known is useful. For example, photographically useful groups described, for example, in U.S. Pat. No. 4,248,962, 4,409,323, 4,438,193, 4,421,845, 4,618,571, 4,652,516, 4,861,701, 4,782,012, 4,857,440, 4,847,185, 4,477,563, 4,438,193, 4,628,024, 4,618,571, or 4,741,994, and Europe Publication Patent No. 193389 A, 348139 A, or 272573 A or coupling releasing groups for releasing them (e.g., a timing group) are used.

When Z represents a nitrogen-containing heterocyclic group bonded to the coupling site through the nitrogen atom, preferably Z represents a 5- to 6-membered, substituted or unsubstituted, saturated or unsaturated, monocyclic or condensed ring heterocyclic group preferably having 1 to 15 carbon atoms, and more preferably 1 to 10 carbon atoms. As heteroatom, in addition to the nitrogen atom, an oxygen atom or a sulfur atom may be present. As a preferable example of the heterocyclic group, 1-pyrazolyl, 1-imidazolyl, pyrrolino, 1,2,4-triazole-2-yl, 1,2,3-triazole-1-yl, benzotriazolyl, benzimidazolyl, imidazolidine-2,4-dione-3-yl, oxazolidine-2,4-dione-3-yl, 1,2,4-triazolidine-3,5-dione-4-yl, imidazolidine-2,4,5-trion-3-yl, 2-imidazolinone-1-yl-, 3,5-dioxomorpholino, or 1-indazolyl can be mentioned. When these heterocyclic groups are substituted, the substituent includes those mentioned as examples of the substituent which may be possessed by the $X^1$ group. Preferable substituents are those wherein one substituent is an alkyl group, an alkoxy group, a halogen atom, an alkoxycarbonyl group, an aryloxycarbonyl group, an alkylthio group, an acylamino group, a sulfonamido group, an aryl group, a nitro group, a carbamoyl group, or a sulfonyl group.

When Z represents an aromatic oxy group, preferably the aromatic oxy group is a substituted or unsubstituted aromatic oxy group having 6 to 10 carbon atoms, and more preferably a substituted or unsubstituted phenoxy group. If the aromatic oxy group is substituted, examples of the substituent include those mentioned as examples of the substituent which may be possessed by $X^1$ mentioned above. Among them, preferable substituents are those wherein at least one substituent is an electron-attractive substituent, such as a sulfonyl group, an alkoxycarbonyl group, a sulfamoyl group, a halogen atom, a carboxyl group, a carbamoyl group, a nitro group, a cyano group, or an acyl group.

When Z represents an aromatic thio group, preferably the aromatic thio group is a substituted or unsubstituted aromatic thio group having 6 to 10 carbon atoms, and more preferably a substituted or unsubstituted phenylthio group. When the aromatic thio group is substituted, examples of the substituent include those mentioned as examples of the substituent which may be possessed by $X^1$ mentioned above. Among them, preferable substituents are those wherein at least one substituent is an alkyl group, an alkoxy group, a sulfonyl group, an alkoxycarbonyl group, a sulfamoyl group, a halogen atom, a carbamoyl group, or a nitro group.

When Z represents a heterocyclic oxy group, preferably the heterocyclic moiety has 1 to 20 carbon atoms, and more preferably 1 to 10 carbon atoms and at least one heteroatom, for example, one nitrogen atom, one oxygen atom, or one sulfur atom and is 3- to 12-membered, more preferably 5- to 6-membered, substituted or unsubstituted, saturated or unsaturated, monocyclic or condensed ring, heterocyclic group. As an example of the heterocyclic oxy group, a pyridyloxy group, a pyrazolyloxy group, or a furyloxy group can be mentioned. When the heterocyclic oxy group is substituted, examples of the substituent include those mentioned as examples of the substituent which may be possessed by $X^1$ mentioned above. Among them, preferable substituents are those wherein at least one substituent is an alkyl group, an aryl group, a carboxyl group, an alkoxy group, a halogen atom, an alkoxycarbonyl group, an aryloxycarbonyl group, an alkylthio group, an acylamino group, a sulfonamido group, a nitro group, a carbamoyl group, or a sulfonyl group.

When Z represents a heterocyclic thio group, preferably the heterocyclic moiety has 1 to 20 carbon atoms, and more preferably 1 to 10 carbon atoms and at least one heteroatom, for example, one nitrogen atom, one oxygen atom, or one sulfur atom and is 3- to 12-membered, more preferably 5- to 6-membered, substituted or unsubstituted, saturated or unsaturated, monocyclic or condensed ring, heterocyclic group. As an example of the heterocyclic thio group, a tetrazolylthio group, a 1,3,4-thiadiazolylthio group, a 1,3,4-oxadiazolylthio group, a 1,3,4-triazolylthio group, a benzoimidazolylthio group, a benzothiazolylthio group, or a 2-pyridylthio group can be mentioned. When the heterocyclic thio group is substituted, examples of the substituent include those mentioned as examples of the substituent which may be possessed by $X^1$ mentioned above. Among them, preferable substituents are those wherein at least one substituent is an alkyl group, an aryl group, a carboxyl group, an alkoxy group, a halogen atom, an alkoxycarbonyl group, an aryloxycarbonyl group, an alkylthio group, an acylamino group, a sulfonamido group, a nitro group, a carbamoyl group, a heterocyclic group, or a sulfonyl group.

When Z represents an acyloxy group, the acyloxy group is a monocyclic or condensed ring, substituted or unsubstituted, aromatic acyloxy group preferably having 6 to 10 carbon atoms or a substituted or unsubstituted aliphatic acyloxy group preferably having 2 to 30 carbon atoms, and more preferably 2 to 20 carbon atoms. When the acyloxy group is substituted, examples of the substituent include those mentioned as examples of the substituent which may be possessed by $X^1$ mentioned above.

When Z represents a carbamoyloxy group, the carbamoyloxy group is an aliphatic or aromatic or heterocyclic, substituted or unsubstituted carbamoyloxy group preferably having 1 to 30 carbon atoms, and more preferably 1 to 20 carbon atoms. As an example, N,N-diethylcarbamoyloxy, N-phenylcarbamoyloxy, 1-imidazolylcarbonyloxy, or 1-pyrrolocarbonyloxy can be mentioned. When the carbamoyloxy group is substituted, examples of the substituent include those mentioned as examples of the substituent which may be possessed by $X^1$ mentioned above.

When Z represents an alkylthio group, the alkylthio group is a substituted or unsubstituted, straight-chain, branched chain, or cyclic, saturated or unsaturated alkylthio group having 1 to 30 carbon atoms, more preferably 1 to 20 carbon atoms. When the alkylthio group is substituted, examples of the substituent include those mentioned as examples of the substituent which may be possessed by $X^1$ mentioned above.

Now, couplers represented by formulas (II) and (III) that fall in a particularly preferable range will be described.

The group represented by $X^1$ in formula (II) is preferably an alkyl group, and particularly preferably an alkyl group having 1 to 10 carbon atoms.

The group represented by Y in formulas (II) and (III) is preferably an aromatic group, and particularly preferably a phenyl group having at least one substituent in the ortho position. The substituent includes those mentioned above, which may be possessed by the aromatic group represented by Y. Preferable substituents include preferable ones mentioned above, which may be possessed by the aromatic group represented Y.

The group represented by Z in formulas (II) and (III) includes preferably a 5- to 6-membered nitrogen-containing heterocyclic group bonded to the coupling site through the nitrogen atom, an aromatic oxy group, a 5- to 6-membered heterocyclic oxy group, or a 5- to 6-membered heterocyclic thio group.

Preferable couplers in formulas (II) and (III) are represented by the following formula (A), (B), or (C):

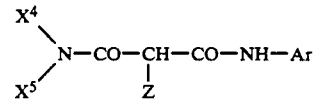

Formula (A)

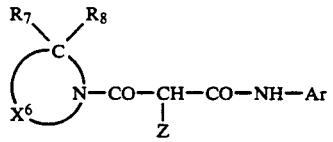

Formula (B)

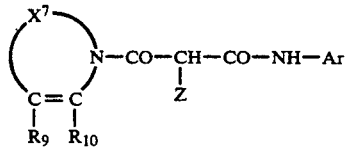

Formula (C)

wherein Z has the same meaning as defined in formula (II), $X^4$ represents an alkyl group, $X^5$ represents an alkyl group or an aromatic group, Ar represents a phenyl group having at least one substituent in the ortho position, $X^6$ represents an organic residue required to form a nitrogen-containing cyclic group (monocyclic or condensed ring) together with the —C($R_7R_8$)—N<, $X^7$ represents an organic residue required to form a nitrogen heterocyclic group (monocyclic or condensed ring) together with the —C($R_9$)=C($R_{10}$)—N<, and $R_7$, $R_8$, $R_9$, and $R_{10}$ each represent a hydrogen atom or a substituent. As substituent in the ortho position of Ar are included, in particularly preferably, for example, a chlorine atom, a fluorine atom, an alkyl group having 1 to 6 carbon atoms (e.g., methyl, trifluoromethyl, ethyl, isopropyl, and t-butyl), an alkoxy group having 1 to 8 carbon atoms (e.g., methoxy, ethoxy, methoxyethoxy, and butoxy), and an aryloxy group having 6 to 24 carbon atoms (e.g., phenoxy, p-tolyloxy, and p-methoxyphenoxy), with most preferred a chlorine atom, methoxy, and trifluoromethyl group.

With respect to a detailed description and a preferable range of the groups represented by $X^4$ to $X^7$, Ar, and Z in formulas (A) to (C), the description in the relevant range described for formulas (II) and (III) is applied. When $R_7$ to $R_{10}$ represent a substituent, examples include those substituents that may be possessed by $X^1$ mentioned above.

Among the couplers represented by the above mentioned formulas, particularly preferable couplers are those represented by formula (B) or (C).

The couplers represented by formulas (II) and (III) or (A), (B), and (B) may form a dimer or higher polymer (e.g., a telomer or a polymer) by bonding at the groups represented by $X^1$ to $X^7$, Y, Ar, $R_7$ to $R_{10}$, and Z through a divalent group or more higher polyvalent group. In that case, the number of carbon atoms may fall outside the range of the number of carbon atoms defined in the above-mentioned substituents.

Preferable examples of the couplers represented by formulas (II) and (II) or (A), (B), and (C) are nondiffusible couplers. The term "nondiffusible couplers" refers to couplers having in the molecule a group with a molecular weight large enough to make the molecule immobilized in the layer in which the molecule is added. Generally an alkyl group having a total number of carbon atoms of 8 to 30, preferably 10 to 20, or an aryl group having a total number of carbon atoms of 4 to 40, is used. These nondiffusible groups may be substituted on any position in the molecule, and two or more of them may be present in the molecule.

Specific examples of the couplers represented by formulas (II) and (II) or (A) to (C) are shown below, but the present invention is not restricted to them.

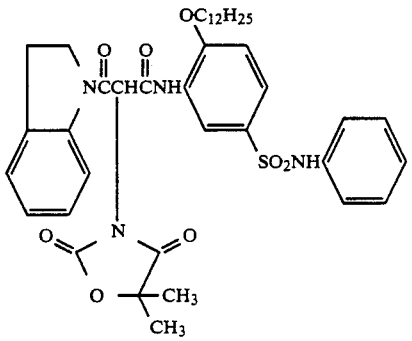

$Y_1$-1

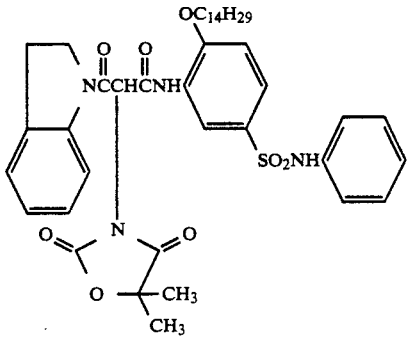

$Y_1$-2

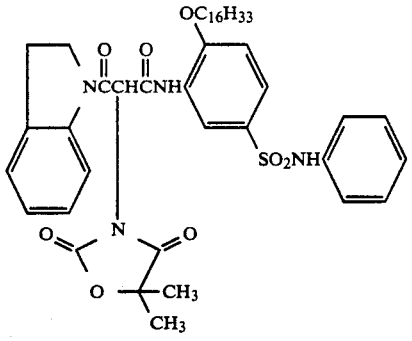

$Y_1$-3

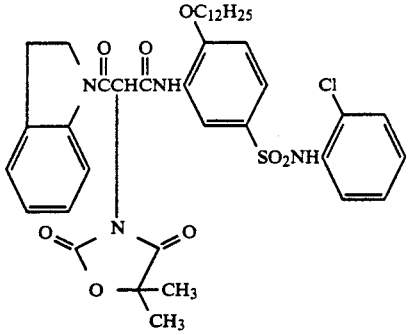

$Y_1$-4

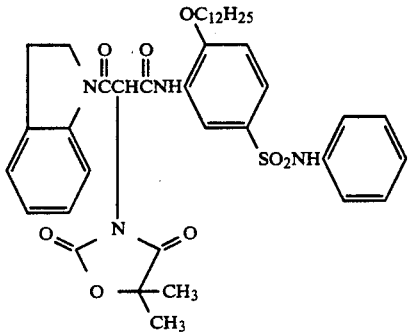

$Y_1$-5

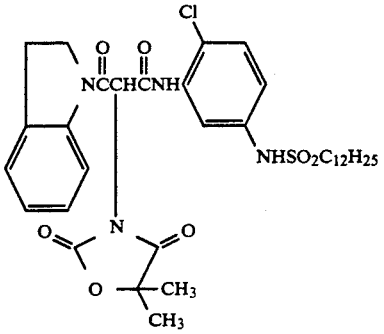

$Y_16$

-continued
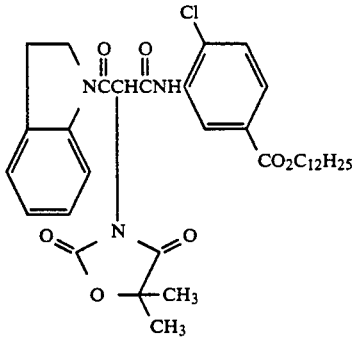
$Y_1$-7
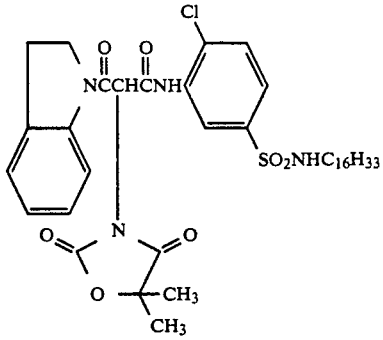
$Y_1$-8
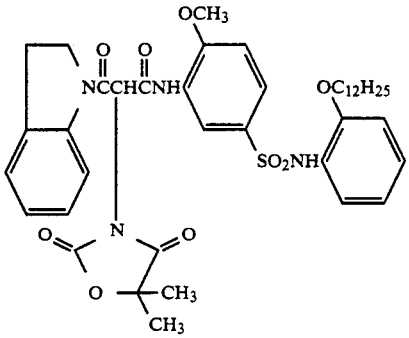
$Y_1$-9
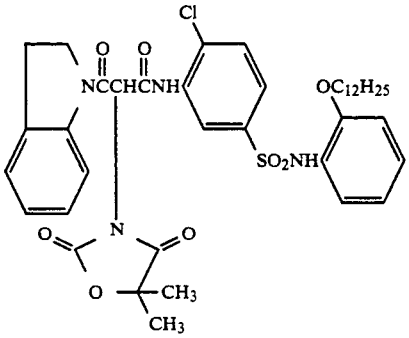
$Y_1$-10
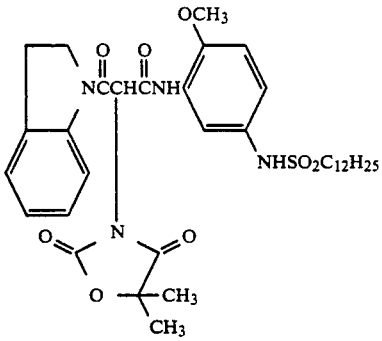
$Y_1$-11
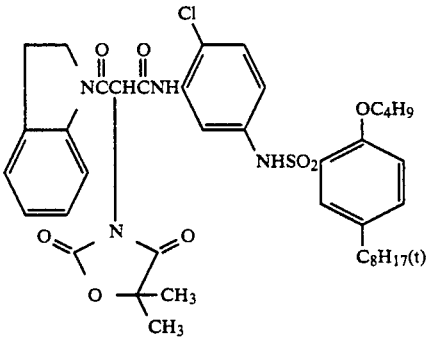
$Y_1$-12
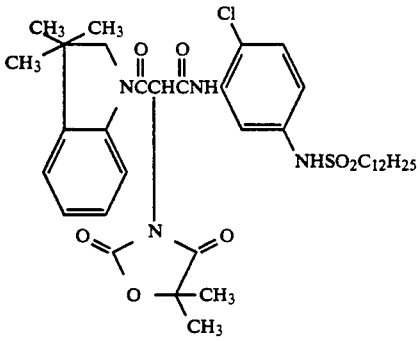
$Y_1$-13
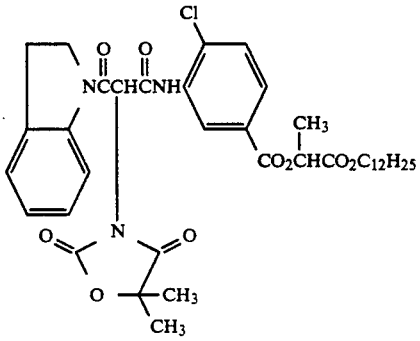
$Y_1$-14

-continued
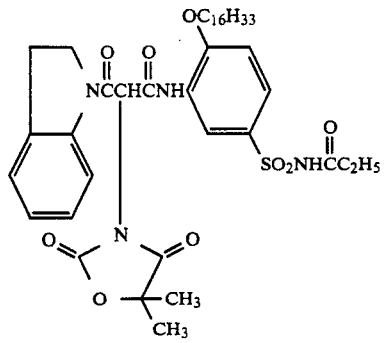
$Y_1$-15
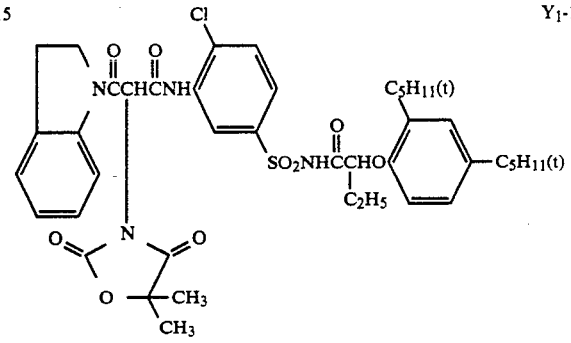
$Y_1$-16
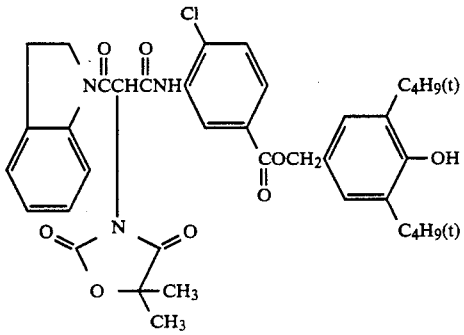
$Y_1$-17
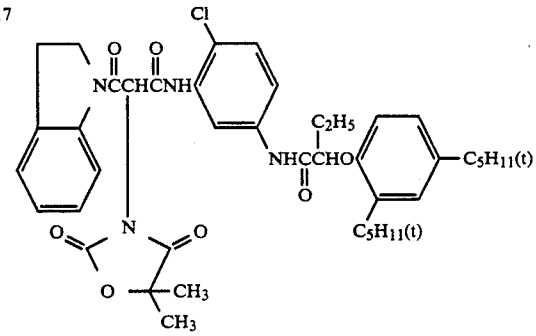
$Y_1$-18
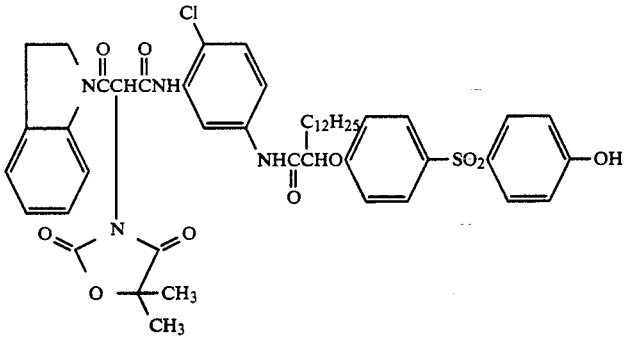
$Y_1$-19
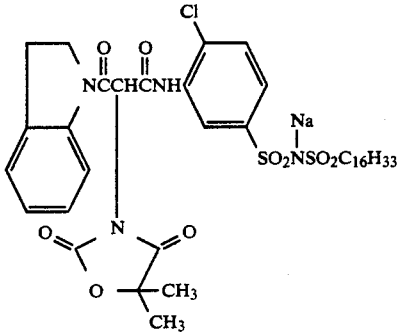
$Y_1$-20
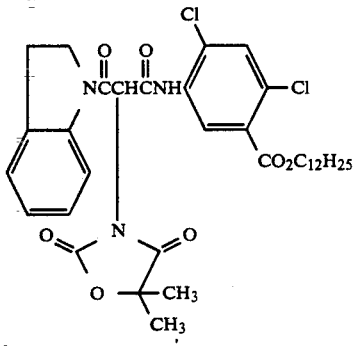
$Y_1$-21

-continued
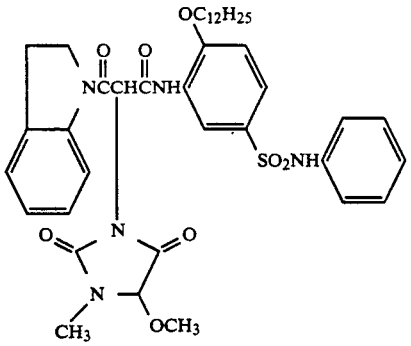
Y1-22
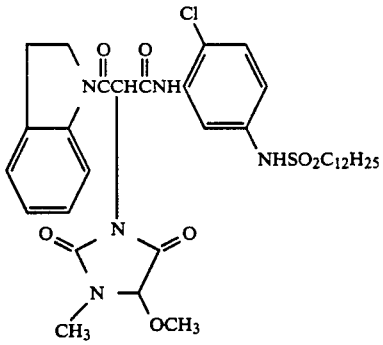
Y1-23
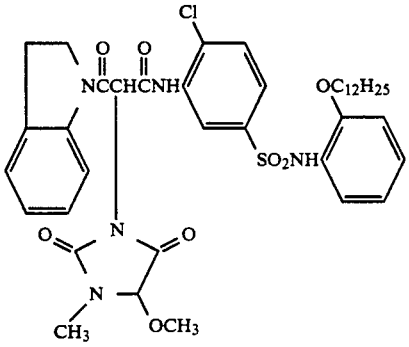
Y1-24
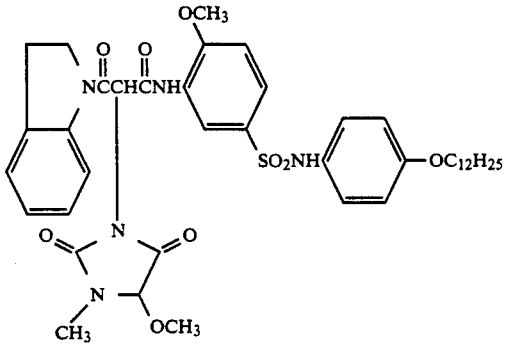
Y1-25
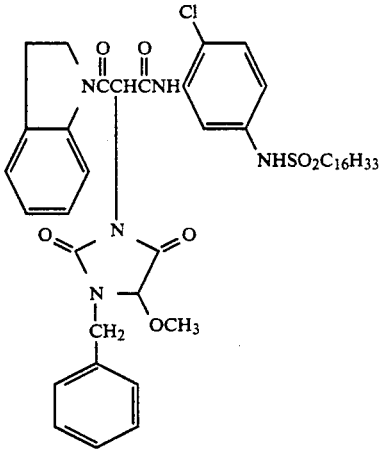
Y1-26
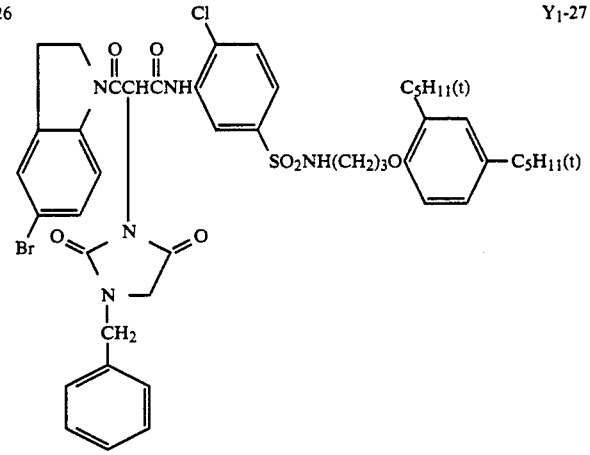
Y1-27
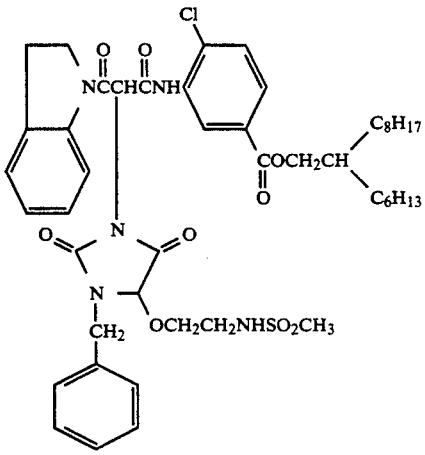
Y1-28
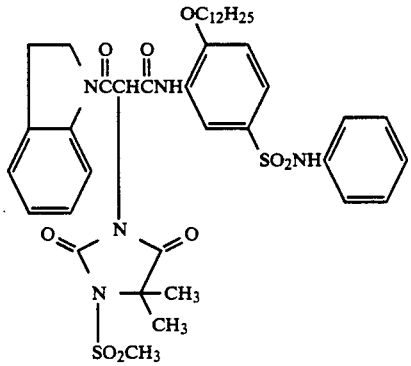
Y1-29

-continued
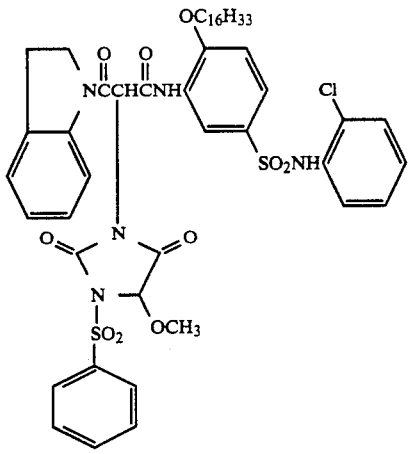
$Y_1$-30
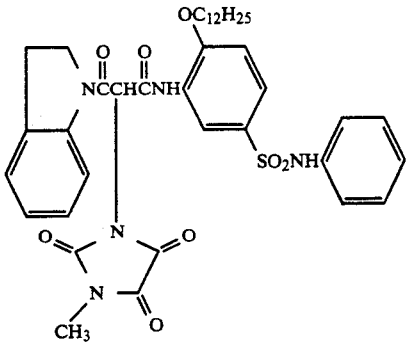
$Y_1$-31
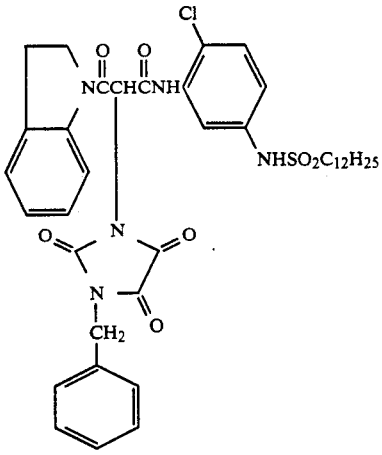
$Y_1$-32
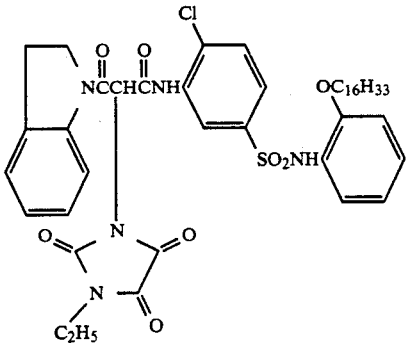
$Y_1$-33
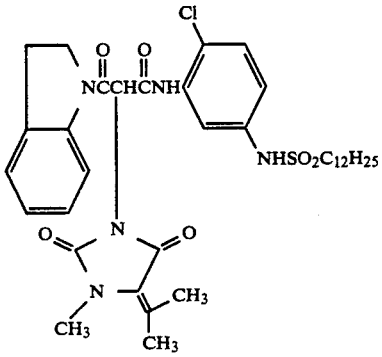
$Y_1$-34
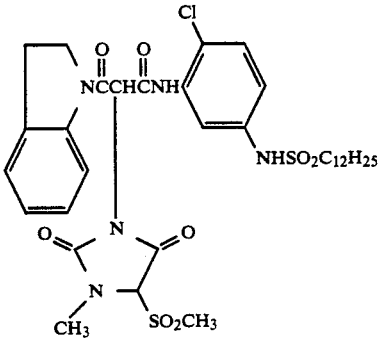
$Y_1$-35

-continued
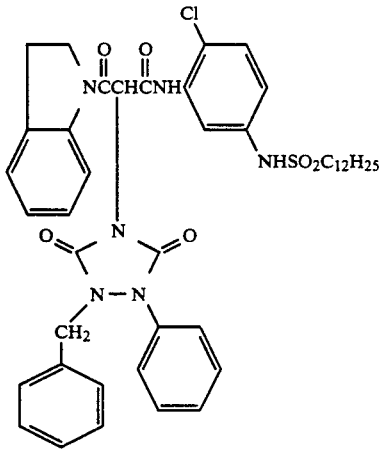
Y1-36
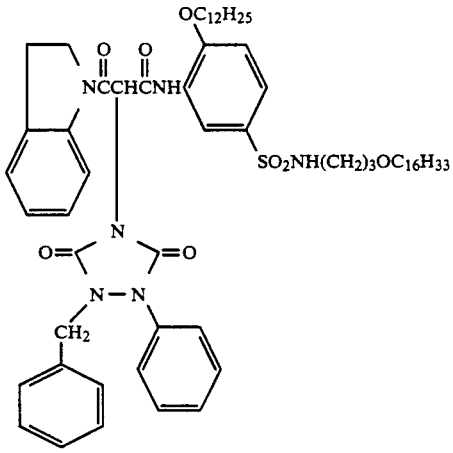
Y1-37
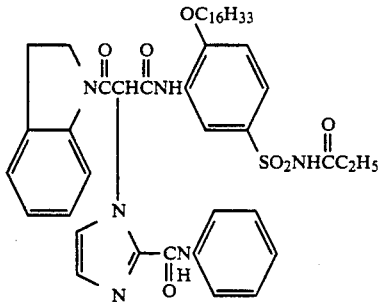
Y1-38
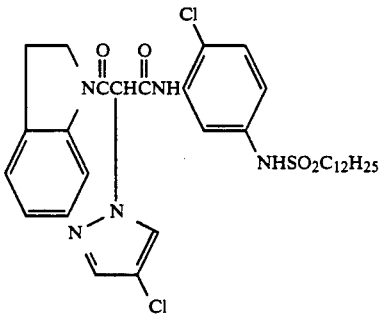
Y1-39
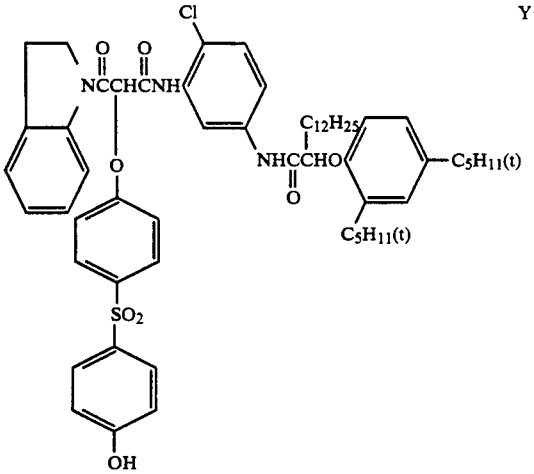
Y1-40
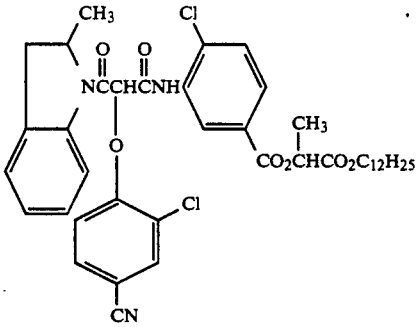
Y1-41

-continued
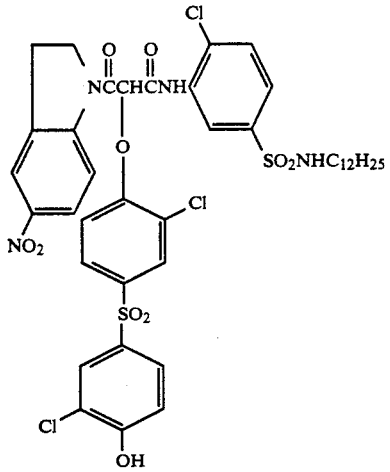
$Y_1$-42
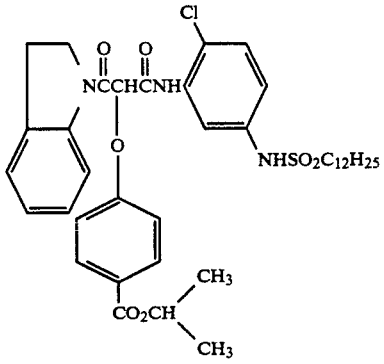
$Y_1$-43
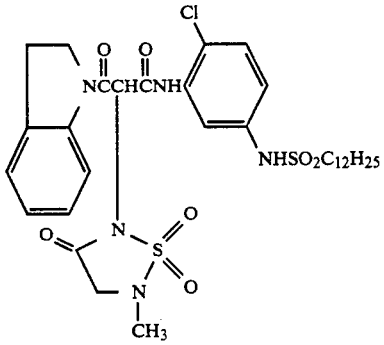
$Y_1$-44
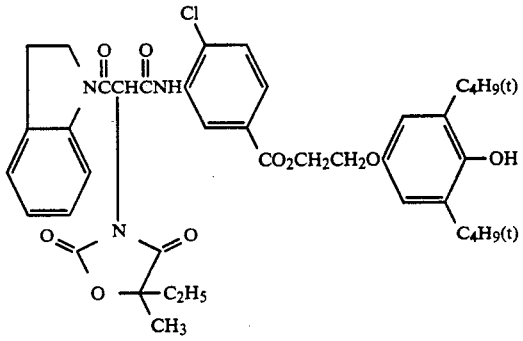
$Y_1$-45
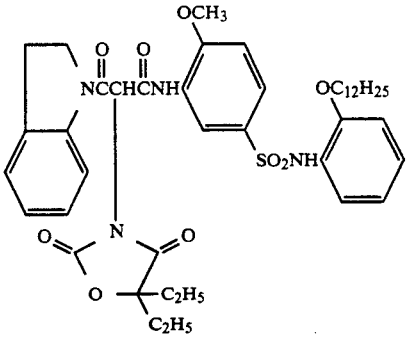
$Y_1$-46
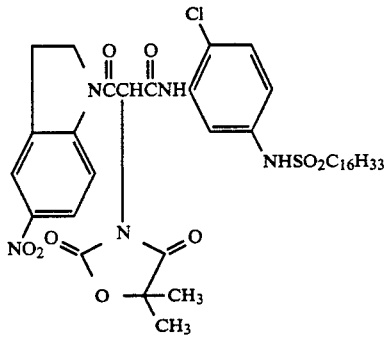
$Y_1$-47
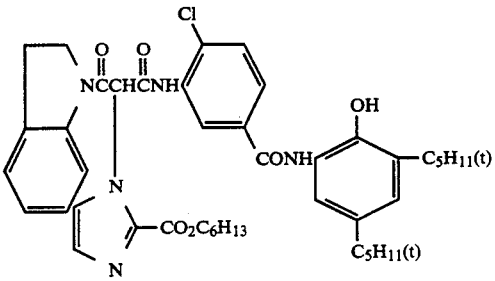
$Y_1$-48
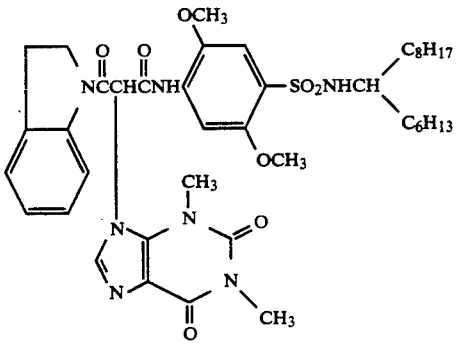
$Y_1$-49

-continued
$Y_1$-50
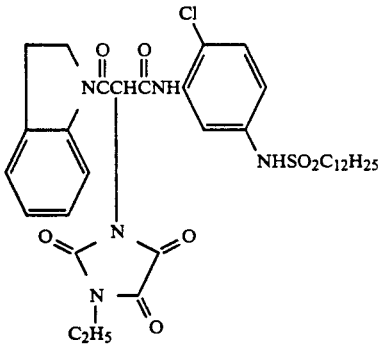
$Y_1$-51
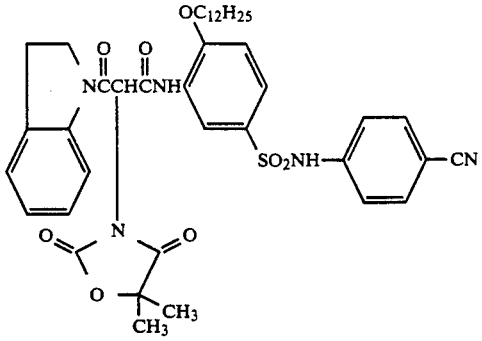
$Y_1$-52
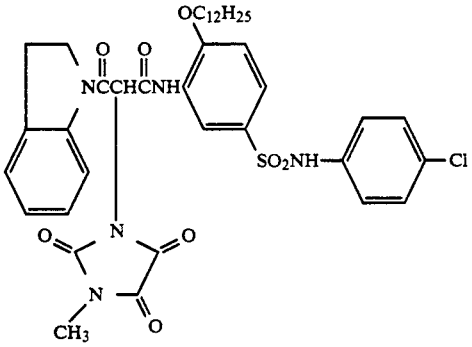
$Y_1$-53
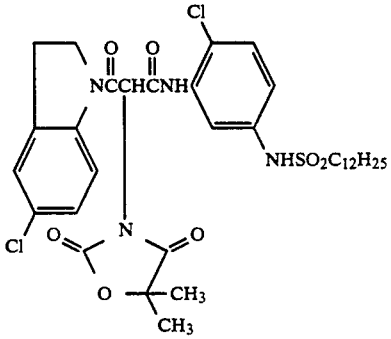
$Y_1$-54
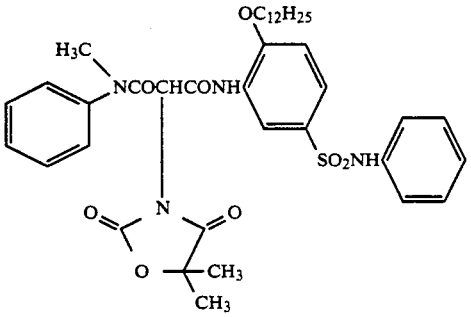
$Y_1$-55
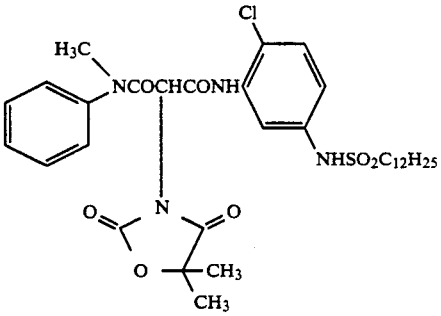
$Y_1$-56
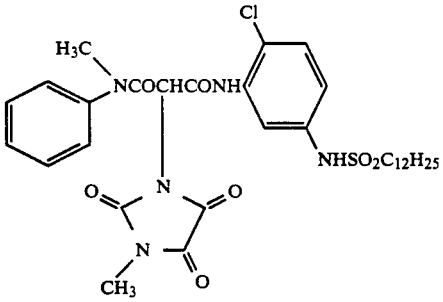
$Y_1$-57
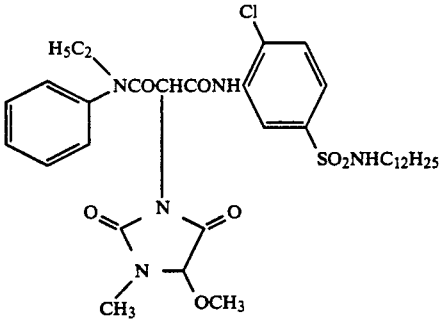
$Y_1$-58
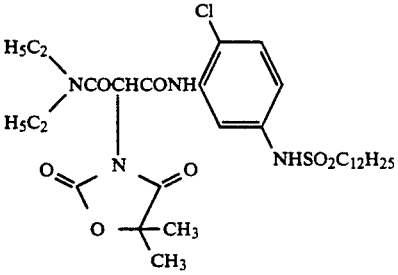
$Y_1$-59
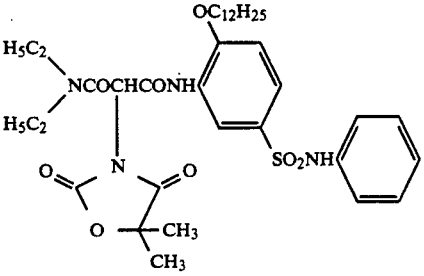

-continued
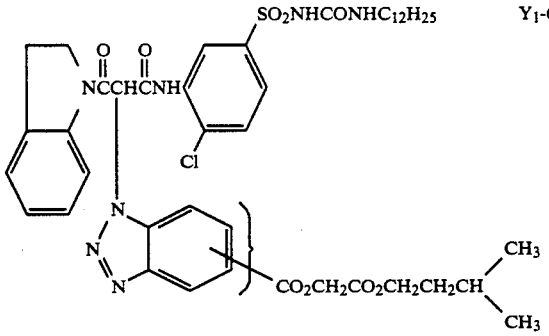
Y1-60
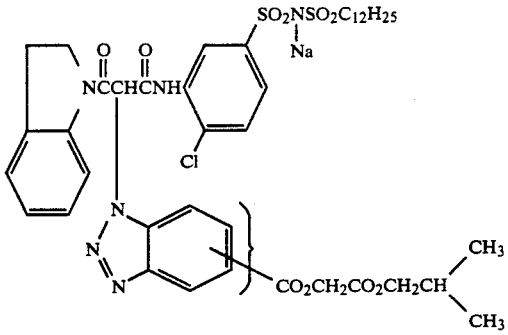
Y1-61
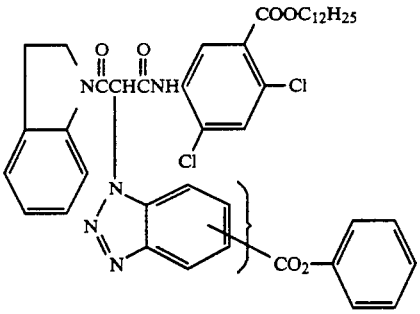
Y1-62
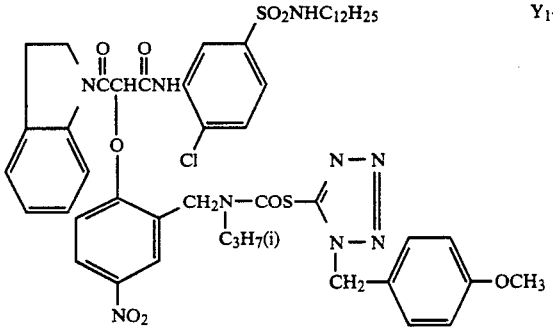
Y1-63
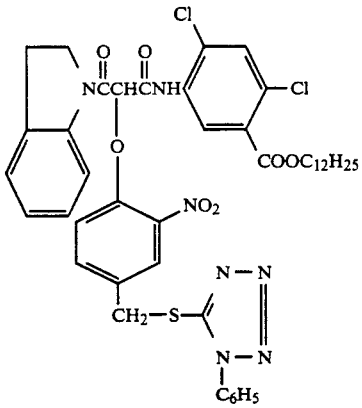
Y1-64
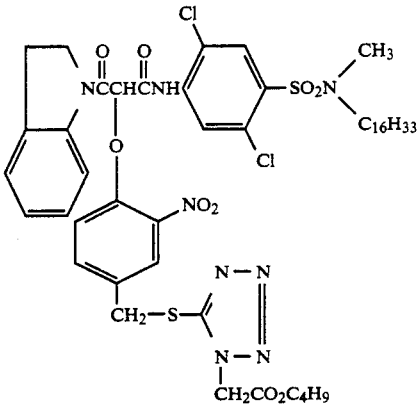
Y1-65
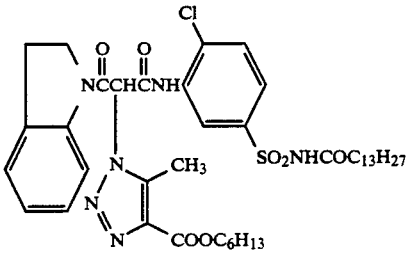
Y1-66
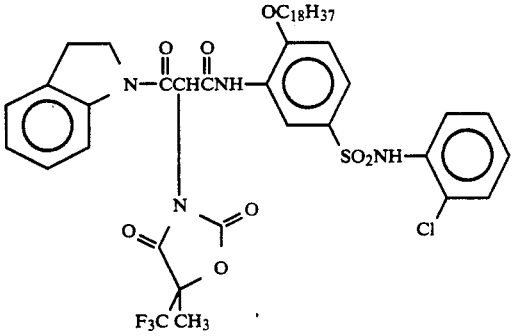
Y1-67

-continued
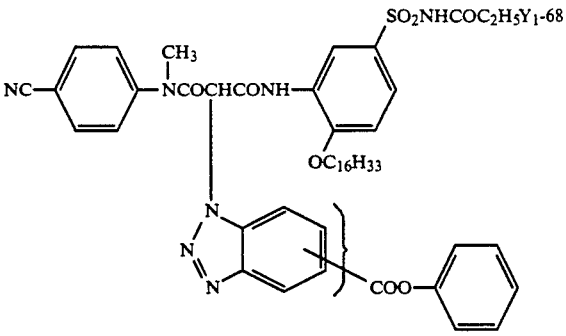
Y1-68
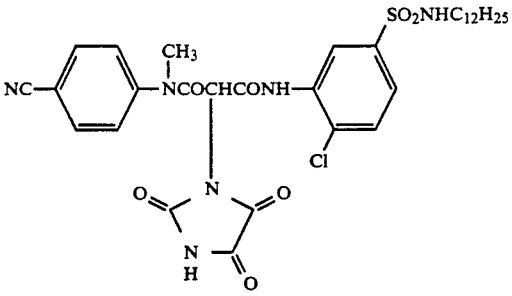
Y1-69
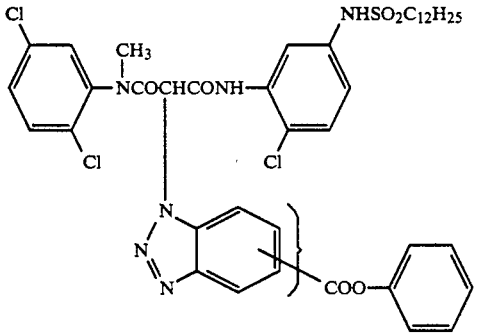
Y1-70
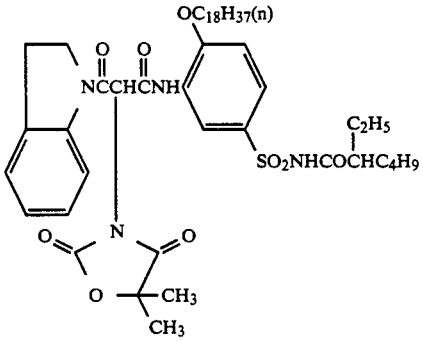
Y1-71
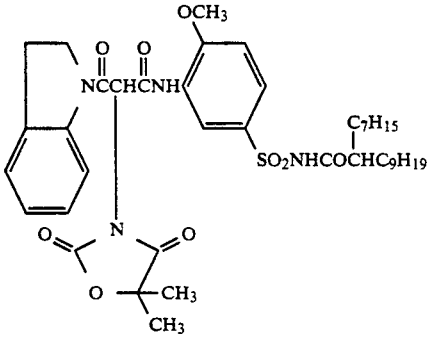
Y1-72
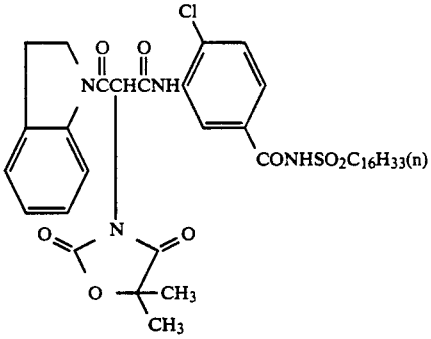
Y1-73
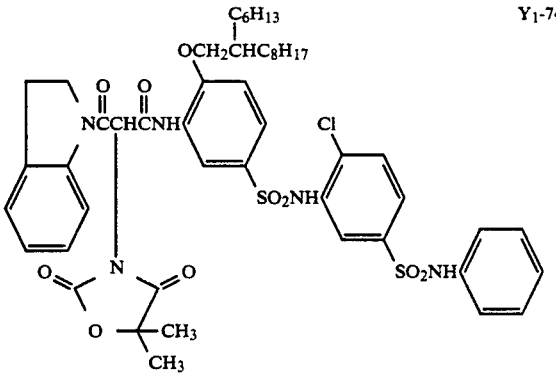
Y1-74
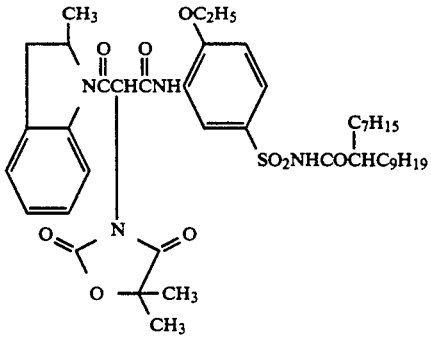
Y1-75

-continued
$Y_1$-76
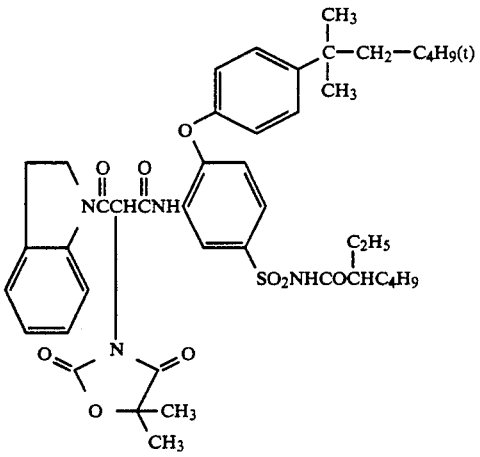
$Y_1$-77
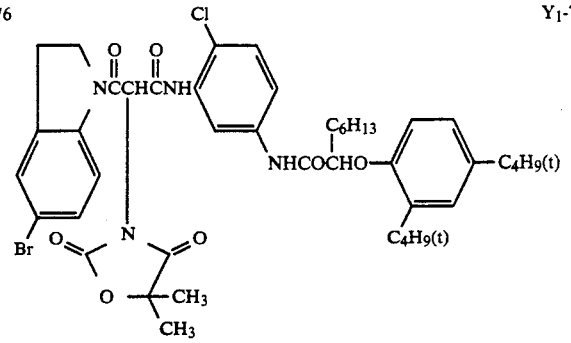
$Y_1$-78
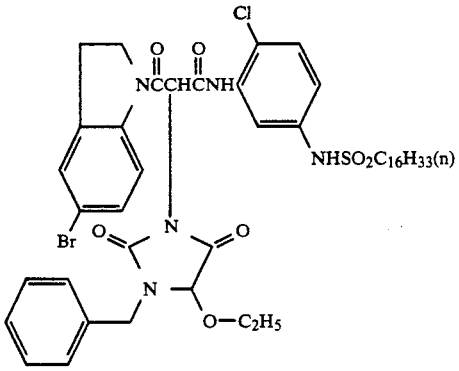
$Y_1$-79
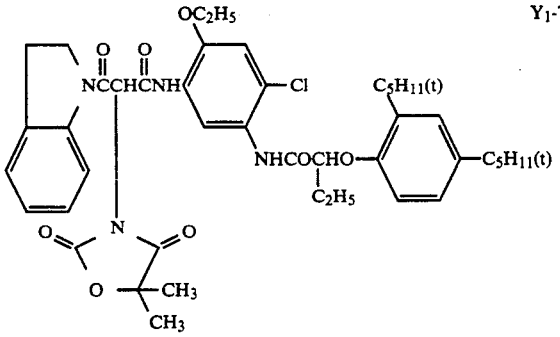
$Y_1$-80
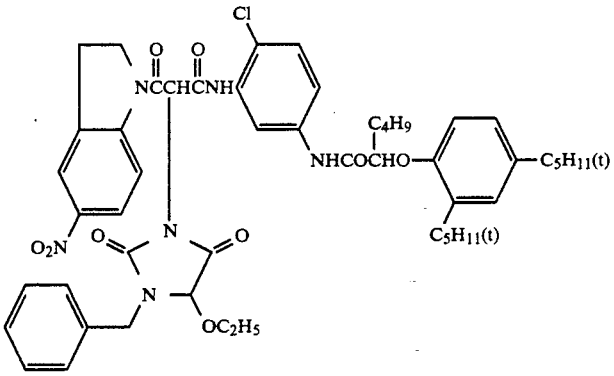
$Y_1$-81
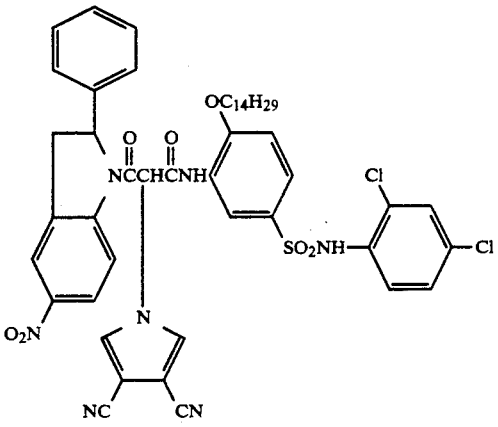

Synthesis examples of compounds represented by formula (II) and (III) are shown below.
Synthesis Example 1
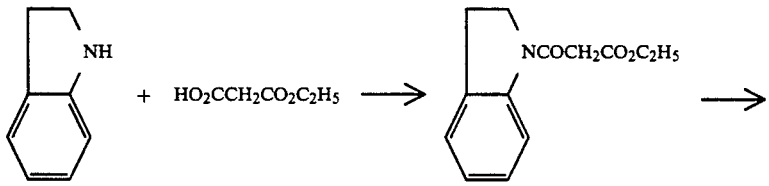
Compound A Compound B Intermediate A
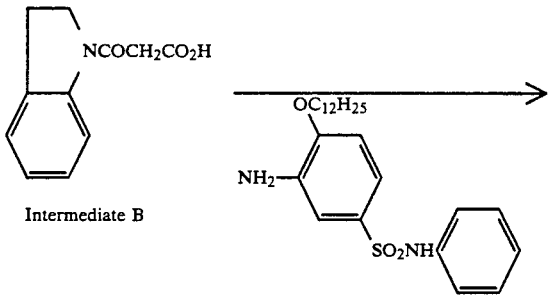
Intermediate B Compound C
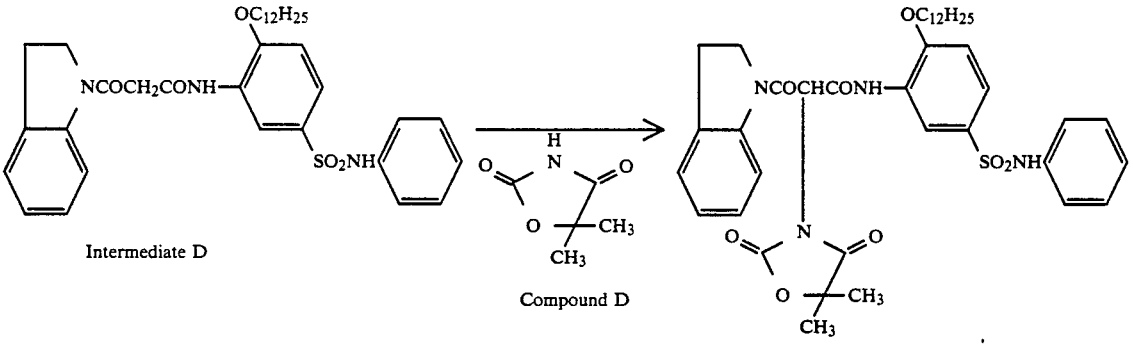
Intermediate D Compound D Exemplified Coupler $Y_1$-1
Synthesis Example 2
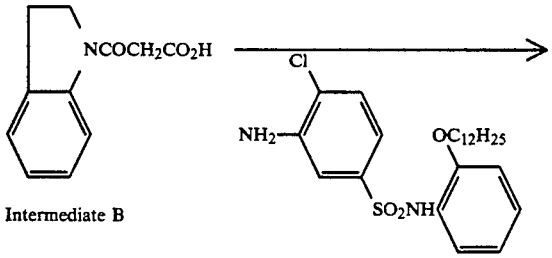
Intermediate B Compound E -continued
Synthesis Example 2
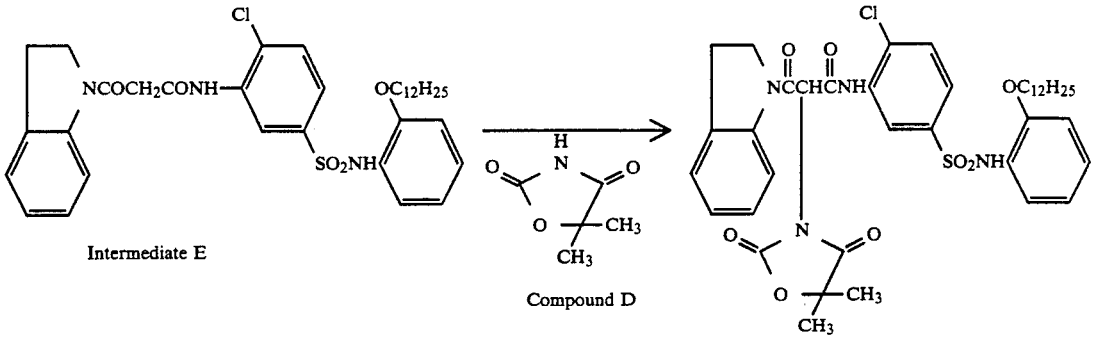
Synthesis Example 3
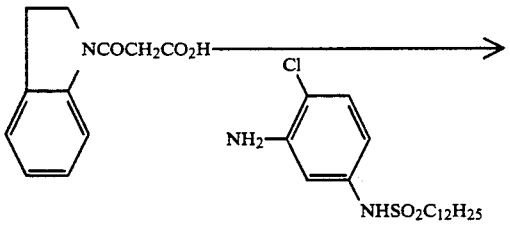
-continued
Synthesis Example 3
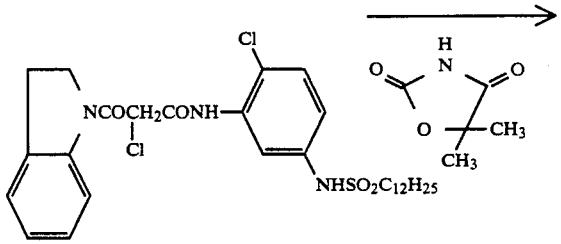
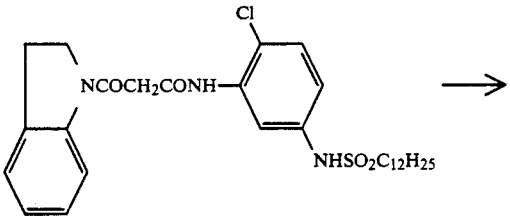
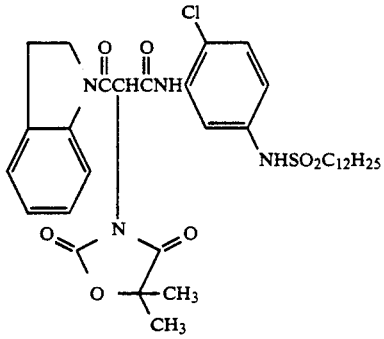
Synthesis Example 4
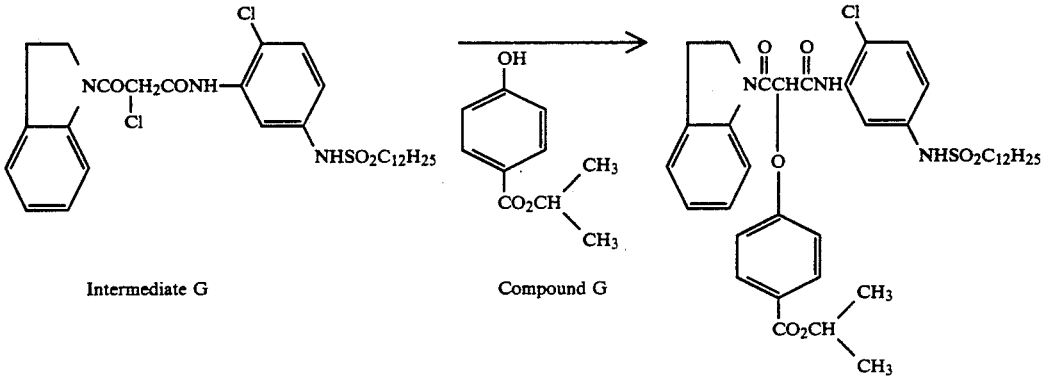

Synthesis of Intermediate B 357.5 g (3.0 mol) of Compound A and 396.3 g (3.0 mol) of Compound B were dissolved in 1.2 liters of ethyl acetate and 0.6 liters of dimethylformamide. To the resulting solution, a solution of 631 g (3.06 mol) of dicyclohexylcarbodiimide in acetonitrile (400 ml) was added dropwise at 15° to 35° C. with stirring. After reacting for 2 hours at 20° to 30° C., the deposited dicyclohexyl urea was filtered off.

500 ml of ethyl acetate and 1 liter of water were added to the filtrate and the water layer was removed. Then, the organic layer was washed twice with 1 liter of water each time. After the organic layer was dried over anhydrous sodium sulfate, the ethyl acetate was distilled off under reduced pressure, to obtain an oil of 92 g (98.9%) of Intermediate A.

692 g (2.97 mol) of the Intermediate A was dissolved in 3 liters of ethyl alcohol and, to the resulting solution, 430 g of 30% sodium hydroxide was added dropwise at 75° to 80° C. with stirring. After the addition, the reaction was continued for 30 min at the same temperature and the deposited crystals were filtered (yield: 658 g).

The crystals were suspended in 5 liters of water and 300 ml of concentrated hydrochloric acid was added dropwise to the suspension at 40° to 50° C. After stirring for 1 hour at the same temperature, the crystals were filtered to obtain 579 g (95%) of Intermediate B (decomposition point: 127° C.).

Synthesis of Intermediate D 45.1 g (0.22 mol) of the Intermediate B and 86.6 g (0.2 mol) of Compound C were dissolved in 400 ml of ethyl acetate and 200 ml of dimethylacetamide. To the solution, a solution of 66 g (0.32 mol) of dicylcohexylcarbodiimide in acetonitrile (100 ml) was added dropwise with stirring. After reacting for 2 hours at 20° to 30° C., the deposited dicyclohexyl urea was filtered off.

400 ml of ethyl acetate and 600 ml of water were added to the filtrate, and after the water layer was removed, the organic layer was washed with water twice. After the organic layer was dried over anhydrous sodium sulfate, the ethyl acetate was distilled off, to obtain 162 g of an oil.

This oil was crystallized from 100 ml of ethyl acetate and 300 ml of n-hexane, to obtain 108 g (87.1%) of Intermediate D. (melting point: 132° to 134° C.)

Elemental analysis of Intermediate D

| | C% | H% | N% |
|---|---|---|---|
| Calculated | 67.82 | 7.32 | 6.78 |
| Found | 67.81 | 7.32 | 6.76 |

Synthesis of Exemplified Coupler $Y_1$-1

49.6 g (0.08 mol) of the Intermediate D was dissolved in 300 ml of dichloromethane. To the solution, 11.4 g (0.084 mol) of sulfuryl chloride was added dropwise at 10° to 15° C. with stirring.

After reacting for 30 min at the same temperature, 200 g of a 5% aqueous sodium bicarbonate solution was added dropwise to the reaction mixture. After the organic layer was separated, it was washed with 200 ml of water and dried over anhydrous sodium sulfate. The dichloromethane was distilled off under reduced pressure, to obtain 47 g of an oil.

47 g of this oil was dissolved in 200 ml of acetonitrile and, to the solution, 28.4 g (0.22 mol) of Compound D and 22.2 g (0.22 mol) of triethylamine were added with stirring. After reacting for 4 hours at 40° to 50° C., the reaction mixture was poured into 300 ml of water, and the deposited oil was extracted with 300 ml of ethyl acetate. The organic layer was washed with 200 g of 5% aqueous sodium hydroxide solution and then twice with 300 ml of water each time. After the organic layer was acidified with diluted hydrochloric acid, the organic layer was washed with water twice and was concentrated under reduced pressure, to obtain a residue (yield: 70 g).

The obtained oily substance was crystallized from 50 ml of ethyl acetate and 100 ml of n-hexane, to obtain 47.8 g (80%) of Exemplified Coupler $Y_1$-1. (melting point: 145° to 147° C.)

Elemental analysis of Exemplified Coupler $Y_1$-1

| | C% | H% | N% |
|---|---|---|---|
| Calculated | 64.32 | 6.75 | 7.50 |
| Found | 64.31 | 6.73 | 7.50 |

Synthesis of Intermediate E 90.3 g (0.44 mol) of the Intermediate B and 187 g (0.4 mol) of Compound E were dissolved in 500 ml of ethyl acetate and 300 ml of dimethylformamide. To the solution, a solution of 131.9 g (0.64 mol) of dicyclohexylcarbodiimide in acetonitrile (200 ml) was added dropwise at 15° to 30° C. with stirring.

After reacting for 2 hours at 20° to 30° C., the deposited dicyclohexyl urea was filtered off. To the filtrate, 500 ml of ethyl acetate and 600 ml of water were added, and after the water layer was removed, the organic layer was washed with water twice. After the organic layer was dried over anhydrous sodium sulfate, the ethyl acetate was distilled off under reduced pressure, to obtain 281 g of an oil. The oil was dissolved in 1.5 liters of n-hexane by heating, and undissolved matter was filtered and removed. The n-hexane solution was cooled with water, and the deposited Intermediate E was filtered. The yield was 243.4 g (93%) and the melting point was 103° to 105° C.

Elemental analysis of Intermediate E

| | C% | H% | N% |
|---|---|---|---|
| Calculated | 64.25 | 6.78 | 6.42 |
| Found | 64.24 | 6.76 | 6.43 |

Synthesis of Exemplified Coupler $Y_1$-10

39.3 g (0.06 mol) of the Intermediate E was dissolved in 200 ml of dichloromethane. To the solution, 8.7 g (0.064 mol) of sulfuryl chloride was added dropwise at 10° to 15° C. with stirring.

After reacting for 30 min at the same temperature, 200 g of a 4% aqueous sodium bicarbonate solution was added dropwise to the reaction mixture. After the organic layer was separated, it was washed with 200 ml of water and dried over anhydrous sodium sulfate. The dichloromethane was distilled off under reduced pressure, to obtain 41.3 g of an oil.

41.3 g of this oil was dissolved in 100 ml of acetonitrile and 200 ml of dimethylacetamide and, to the solution, 20.8 g (0.16 mol) of Compound D and 16.2 g of triethylamine were added with stirring. After reacting for 3 hours at 30° to 40° C., the reaction mixture was poured into 400 ml of water, and the deposited oil was extracted with 300 ml of ethyl acetate. The organic layer was washed with 300 g of 2% aqueous sodium hydroxide solution, and then with water twice. Then after the organic layer was acidified with diluted hydrochloric acid, the organic layer was washed with water twice and was concentrated under reduced pressure, to obtain 42 g of a residue.

The residue was crystallized from 200 ml of methanol, to obtain 39.8 g (85%) of Exemplified Coupler $Y_1$-10. (melting point: 110° to 112° C.)

| Elemental analysis of Exemplified Coupler $Y_1$-10 | | | |
|---|---|---|---|
| | C% | H% | N% |
| Calculated | 61.48 | 6.32 | 7.17 |
| Found | 61.46 | 6.30 | 7.18 |

Synthesis of Intermediate F 104.7 g (0.51 mol) of the Intermediate B and 187.5 g (0.5 mol) of Compound F were dissolved in 1 liter of ethyl acetate and 400 ml of dimethylformamide. To the solution, a solution of 107.3 g (0.525 mol) of dicyclohexylcarbodiimide in dimethylformamide (100 ml) was added dropwise at 15° to 30° C. with stirring.

After reacting for 1 hour at 20° to 30° C., 500 ml of ethyl acetate was added; then the reaction mixture was heated to 50° to 60° C., and dicyclohexyl urea was filtered off.

To the filtrate, 600 ml of water was added, and after the water layer was removed, washing with water was carried out twice. After the organic layer was dried over anhydrous sodium sulfate, the ethyl acetate was distilled off under reduced pressure, to obtain 290 g of an oil. The oil was heated together with 1 liter of ethyl acetate and 2 liters of methanol; then undissolved matter was filtered and removed, and upon cooling of the filtrate with water, crystals of Intermediate F deposited, which were filtered. The yield was 267 g (95%) and the melting point was 163° to 164° C.

| Elemental analysis of Intermediate F | | | |
|---|---|---|---|
| | C% | H% | N% |
| Calculated | 61.95 | 7.17 | 7.48 |
| Found | 61.93 | 7.17 | 7.46 |

Synthesis of Intermediate G 114.0 g (0.2 mol) of the Intermediate G was dissolved in 500 ml of dichloromethane. To the solution, 28.4 g (0.21 mol) of sulfuryl chloride was added dropwise at 10° to 15° C. with stirring.

After reacting for 30 min at the same temperature, 500 g of a 6% aqueous sodium bicarbonate solution was added dropwise to the reaction mixture. After the organic layer was separated, it was washed with 500 ml of water and dried over anhydrous sodium sulfate. The dichlorides was distilled off under reduced pressure, to deposit crystals of Intermediate G, which were filtered. Yield: 108.6 g (91%)

Synthesis of Exemplified Coupler $Y_1$-6

29.8 g (0.05 mol) of the Intermediate G was dissolved in 80 ml of dimethylformamide, 12.9 g (0.1 mol) of Compound D was added to the solution, and then 10.1 g (0.01 mol) of triethylamine was added dropwise thereto at 20° to 30° C. with stirring. After reacting at 40° to 45° C. for 1 hour, 300 ml of ethyl acetate and 200 ml of water were added to the reaction mixture.

After the organic layer was washed twice with 400 g of 2% aqueous sodium hydroxide solution, the organic layer was washed with water once. After the organic layer was acidified with diluted hydrochloric acid, the organic layer was washed with water twice and was concentrated, to obtain 24 g of a residue. The residue was crystallized from a mixed solvent of 50 ml of ethyl acetate and 150 ml of n-hexane, to obtain 19 g of Exemplified Coupler Y-106.

The crystals were recrystallized from 120 ml of a mixed solvent of ethyl acetate/n-hexane (1/3 in vol/vol), to obtain 15 g (43.5%) of Exemplified Coupler $Y_1$-6. (melting point: 135° to 136° C.)

| Elemental analysis of Exemplified Coupler $Y_1$-6 | | | |
|---|---|---|---|
| | C% | H% | N% |
| Calculated | 59.24 | 6.58 | 8.13 |
| Found | 59.27 | 6.56 | 8.12 |

Synthesis Example $Y_1$-43

27.0 g (0.15 mol) of the Intermediate G and 15.2 g (0.15 mol) of triethylamine were dissolved in 50 ml of dimethylformamide. To this mixture, a solution of 9.8 g (0.005 mol) of the Intermediate G in dimethylformamide (30 ml) was added dropwise with stirring.

After reacting for 4 hours at 30° to 40° C., 400 ml of ethyl acetate and 300 ml of water were added to the reaction mixture. The organic layer was washed twice with 400 g of 2% aqueous sodium hydroxide solution and then with water twice. After the organic layer was acidified with diluted hydrochloric acid, the organic layer was washed with water twice and was dried over anhydrous sodium sulfate. The ethyl acetate was distilled off under reduced pressure, to obtain 54 g of a residue.

The residue was crystallized from 300 ml of a mixed solvent of ethyl acetate/methanol (1/2 in vol/vol) and the crystals were filtered, to obtain Exemplified Coupler Y-143. The obtained crystals were recrystallized from 200 ml of a mixed solvent of ethyl acetate/methanol (1/2 in vol/vol) to obtain 28.8 g (77.8%) of Exemplified Coupler $Y_1$-43. (melting point: 190° to 191° C.)

| Elemental analysis of Exemplified Coupler $Y_1$-43 | | | |
|---|---|---|---|
| | C% | H% | N% |
| Calculated | 63.26 | 6.81 | 5.68 |
| Found | 63.24 | 6.79 | 5.67 |

The α-acylacetamide-type yellow dye-forming coupler represented by Formula (IV) will now be described in detail.

The α-acylacetamide yellow coupler of the present invention is preferably represented by the following formula (Y):

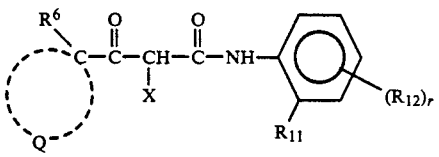

Formula (Y)

In formula (Y), $R^6$ represents a monovalent group other than hydrogen; Q represents a group of non-metallic atoms required to form together with the C a substituted or unsubstituted 3- to 5-membered cyclic hydrocarbon group or a substituted or unsubstituted 3- to 5-membered heterocyclic group having in the group at least one heteroatom selected from a group consisting of N, S, O, and P; $R_{11}$ represents a hydrogen atom, a halogen atom (e.g., F, Cl, Br, and I, which is applied hereinafter to the description of formula (Y)), an alkoxy group, an aryloxy group, an alkyl group, or an amino group; $R_{12}$ represents a group capable of substitution onto a benzene ring, X represents a hydrogen atom or a group capable of being released upon a coupling reaction thereof with the oxidized product of an aromatic primary amine developing agent (hereinafter referred to as coupling releasing group), r is an integer of 0 to 4, and when r is 2 or more, the $R_{12}$ groups may be the same or different.

In formula (IV), $Y_R$ represents a residue remaining after removing the acyl group

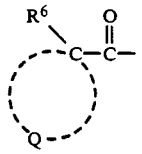

at the α position of the acetamide moiety from the acylacetamide yellow dye-forming coupler represented by formula (IV). In other words, $Y_R$ represents the remaining portion of formula (IV) that does not correspond to the acyl group referred to above. Preferably $Y_R$ represents the following residue as shown in formula (Y)

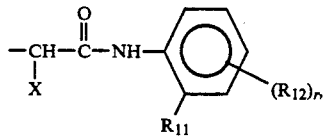

wherein the substituents are as defined in formula (Y). $Y_R$ may also be represented by the corresponding residues as shown in publications.

When any of the substituents in formula (Y) is an alkyl group or contains an alkyl group, unless otherwise specified, the alkyl group means a straight-chain, branched-chain, or cyclic alkyl group, which may be substituted and/or unsaturated (e.g., methyl, isopropyl, t-butyl, cyclopentyl, t-pentyl, cyclohexyl, 2-ethylhexyl, 1,1,3,3-tetramethylbutyl, dodecyl, hexadecyl, allyl, 3-cyclohexenyl, oleyl, benzyl, trifluoromethyl, hydroxymethylmethoxyethyl, ethoxycarbonylmethyl, and phenoxyethyl).

When any of the substituents in formula (Y) is an aryl group or contains an aryl group, unless otherwise specified, the aryl group means a monocyclic or condensed cyclic aryl group, which may be substituted, containing (e.g., phenyl, 1-naphthyl, p-tolyl, o-tolyl, p-chlorophenyl, 4-methoxyphenyl, 8-quinolyl, 4-hexadecyloxyphenyl, pentafluorophenyl, p-hydroxyphenyl, p-cyanophenyl, 3-pentadecylphenyl, 2,4-di-t-pentylphenyl, p-methanesulfonamidophenyl, and 3,4-dichlorophenyl).

When any of the substituents in formula (Y) is a heterocyclic group or contains a heterocyclic group, unless otherwise specified, the heterocyclic group means a 3- to 8-membered monocyclic or condensed ring heterocyclic group that contains at least one heteroatom selected from the group consisting of O, N, S, P, Se, and Te (e.g., 2-furyl, 2-pyridyl, 4-pyridyl, 1-pyrazolyl, 1-imidazolyl, 1-benzotriazolyl, 2-benzotriazolyl, succinimido, phthalimido, and 1-benzyl-2,4-imidazolidinedion-3-yl).

Substituents preferably used in formula (Y) will now be described below.

In formula (Y), preferably $R_6$ represents a halogen atom, a cyano group, a monovalent aliphatic-type group that may be substituted and has a total number of carbon atoms (hereinafter abbreviated to a C-number) of 1 to 30 (e.g., alkyl and alkoxy) or a monovalent aryl-type group that may be substituted and has a C-number of 6 to 30 (e.g., aryl and aryloxy), whose substituent includes, for example, a halogen atom, an alkyl group, an alkoxy group, a nitro group, an amino group, a carbonamido group, a sulfonamido group, and an acyl group.

In formula (Y), Q preferably represents a group of non-metallic atoms required to form together with the C a substituted or unsubstituted 3- to 5-membered hydrocarbon ring having a C-number of 3 to 30 or a substituted or unsubstituted 3- to 5-membered heterocyclic ring moiety having a C-number of 2 to 30 and in the group at least one heteroatom selected from a group consisting of N, S, O, and P. The ring formed by Q together with the C may have an unsaturated bond in the ring. Examples of the ring formed by Q together with the C include a cyclopropane ring, a cyclobutane ring, a cyclopentane ring, a cyclopropene ring, a cyclobutene ring, a cyclopentene ring, an oxetane ring, an oxolane ring, a 1,3-dioxolane ring, a thiethane ring, a thiolane ring, and a pyrrolidine ring. Examples of the substituent for the rings include a halogen atom, a hydroxyl group, an alkyl group, an aryl group, an acyl group, an alkoxy group, an aryloxy group, a cyano group, an alkoxycarbonyl group, an alkylthio group, and an arylthio group.

In formula (Y), $R_{11}$ preferably represents a halogen atom, an alkoxy group that may be substituted and has a C-number of 1 to 30, an aryloxy group that may be substituted and has a C-number of 6 to 30, an alkyl group that may be substituted and has a C-number of 1 to 30, or a amino group that may be substituted and has a C-number of 0 to 30, and the substituent includes, for example, a halogen atom, an alkyl group, an alkoxy group, and an aryloxy group.

Examples of $R_{12}$ in formula (Y) include a halogen atom, an alkyl group (as defined above), an aryl group (as defined above), an alkoxy group, an aryloxy group, an alkoxycarbonyl group, an aryloxycarbonyl group, a carbonamido group, a sulfonamido group, a carbamoyl group, a sulfamoyl group, an alkylsulfonyl group, a ureido group, a sulfamoylamino group, an alkoxycarbonylamino group, an alkoxysulfonyl group, an acyloxy group, a nitro group, a heterocyclic group (as defined above), a cyano group, an acyl group, an acyloxy group, an alkylsulfonyloxy group, and an arylsulfonyloxy group; and examples of the coupling releasing group include a heterocyclic group (as defined above) bonded to the coupling active site through the nitrogen atom, an aryloxy group, an arylthio group, an acyloxy group, an alkylsulfonyloxy group, an arylsulfonyloxy group, a heterocyclic oxy group (wherein heterocyclic is as defined above), and a halogen atom.

In formula (Y), $R_{12}$ represents a halogen atom, an alkyl group that may be substituted and has a C-number of 1 to 30, an aryl group that may be substituted and has a C-number of 6 to 30, an alkoxy group that may be substituted and has a C-number of 1 to 30, an alkoxycarbonyl group that may be substituted and has a C-number of 2 to 30, an aryloxycarbonyl group that may be substituted and has a C-number of 7 to 30, a carbonamido group that may be substituted and has a C-number of 1 to 30, a sulfonamido group that may be substituted and has a C-number of 1 to 30, a carbamoyl group that may be substituted and has a C-number of 1 to 30, a sulfamoyl group that may be substituted and has a C-number of 0 to 30, an alkylsulfonyl group that may be substituted and has a C-number of 1 to 30, a ureido group that may be substituted and has a C-number of 1 to 30, a sulfamoylamino group that may be substituted and has a C-number of 0 to 30, an alkoxycarbonylamino group that may be substituted and has a C-number of 2 to 30, a heterocyclic group that may be substituted and has a C-number of 1 to 30, an acyl group that may be substituted and has a C-number of 1 to 30, an alkylsulfonyloxy group that may be substituted and has a C-number of 1 to 30, and an arylsulfonyloxy group that may be substituted and has a C-number of 6 to 30; and examples of substituent include a halogen atom, an alkyl group, an aryl group, a heterocyclic group, an alkoxy group, an aryloxy group, a hetrocyclic oxy group, an alkylthio group, an arylthio group, a heterocyclic thio group, an alkylsulfonyl group, an arylsulfonyl group, an acyl group, a carbonamido group, a sulfonamido group, a carbamoyl group, a sulfamoyl group, an alkoxycarbonylamino group, a sulfamoylamino group, a ureido group, a cyano group, a nitro group, an acyloxy group, an alkoxycarbonyl group, an aryloxycarbonyl group, an alkylsulfonyloxy group, and an arylsulfonyloxy group.

In formula (Y), r is preferably an integer of 1 or 2, and the position of the substitution of $R_{12}$ is preferably the meta-position or para-position to

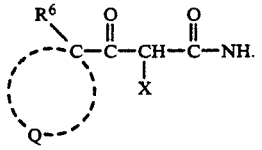

In formula (Y), X preferably represents a heterocyclic group bonded to the coupling active site through the nitrogen atom or an aryloxy group.

When X represents a heterocyclic group, X is preferably a 5- to 7-membered monocyclic group or condensed ring that may be substituted. Exemplary of such groups are succinimido, maleinimido, phthalimido, diglycolimido, pyrrole, pyrazole, imidazole, 1,2,4-triazole, tetrazole, indole, indazole, benzimidazole, benzotriazole, imidazolidine-2,4-dione, oxazolidine-2,4-dione, thiazolidine-2,4-dione, imidazolidine-2-one, oxazolidine-2-one, thiazolidine-2-one, benzimidazolidine-2-one, benzoxazolidine-2-one, benzothiazoline-2-one, 2-pyrroline-5-one, 2-imidazoline-5-one, indoline-2,3-dione, 2,6-dioxypurine, parabanic acid, 1,2,4-triazolidine-3,5-dione, 2-pyridone, 4-pyridone, 2-pyrimidone, 6-pyridazone-2-pyrazone, 2-amino-1,3,4-thiazolidine, 2-imino-1,3,4-thiazolidine-4-one, and the like, any of which heterocyclic rings may be substituted. Examples of the substituent on the heterocyclic group include a halogen atom, a hydroxyl group, a nitro group, a cyano group, a carboxyl group, a sulfo group, an alkyl group, an aryl group, an alkoxy group, an aryloxy group, an alkylthio group, an arylthio group, an alkylsulfonyl group, an arylsulfonyl group, an alkoxycarbonyl group, an aryloxycarbonyl group, an acyl group, an acyloxy group, an amino group, a carbonamido group, a sulfonamido group, a carbamoyl group, a sulfamoyl group, a ureido group, an alkoxycarbonylamino group, and a sulfamoylamino group. When X represents an aryloxy group, preferably X represents an aryloxy group having 6 to 30 carbon atoms, and when X is a heterocyclic group, it may be substituted by a group selected from the group consisting of those substituents mentioned in the case wherein X represents a heterocyclic group. A preferable substituent on the aryloxy group is a halogen atom, a cyano group, a nitro group, a carboxyl group, a trifluoromethyl group, an alkoxycarbonyl group, a carbonamido group, a sulfonamido group, a carbamoyl group, a sulfamoyl group, an alkylsulfonyl group, an arylsulfonyl group, or a cyano group.

Now, substituents which are particularly preferably used in formula (Y) will now be described.

$R_7$ is particularly preferably a halogen atom or an alkyl group having a C-number of 1 to 4, most preferably a methyl group, an ethyl group and n-propyl group. Q particularly preferably represents a group of non-metallic atoms which form together with the C a 3- to 5-membered cyclic hydrocarbon group, such as $[C(R)_2]_2$—, —$[C(R)_2]_3$—, and —$[C(R)_2]_4$— wherein R represents a hydrogen atom, a halogen atom, or an alkyl group, the R groups may be the same or different, and $C(R)_2$ groups may be the same or different.

Most preferably Q represents —$[C(R)_2]_2$— which forms a 3-membered ring together with the C bonded thereto.

Particularly preferably $R_{11}$ represents a chlorine atom, a fluorine atom, an alkyl group having a C-number of 1 to 6 (e.g., methyl, trifluoromethyl, ethyl, isopropyl, and t-butyl), an alkoxy group having a C-number of 1 to 8 (e.g., methoxy, ethoxy, methoxyethoxy, and butoxy), or an aryloxy group having a C-number of 6 to 24 (e.g., phenoxy, p-tolyloxy, and p-methoxyphenoxy), most preferably a chlorine atom, a methoxy group, or a trifluoromethyl group.

Particularly preferably R12 represents a halogen atom, an alkoxy group, an alkoxycarbonyl group, an aryloxycarbonyl group, a carbonamido group, a sulfonamido group, a carbamoyl group, or a sulfamoyl group, most preferably an alkoxy group, an alkoxycarbonyl group, a carbonamido group, or a sulfonamido group.

Particularly preferably X is a group represented by the following formula (Y-1), (Y-2), or (Y-3): Formula (Y-1)

Formula (Y-1)

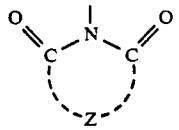

In formula (Y-1), Z represents —O—$CR_{13}(R_{14})$—, —S—$CR_{13}(R_{14})$—, —$NR_{15}$—$CR_{13}(R_{14})$—, —$NR_{15}NR_{16}$—, —$NR_{15}$—C(O)—, —$CR_{13}(R)$-$_{14}$—$CR_{17}(R_{18})$— or —$CR_{19}$=$CR_{20}$—.

Herein $R_{13}$, $R_{14}$, $R_{17}$, and $R_{18}$ each represent a hydrogen atom, an alkyl group, an aryl group, an alkoxy group, an aryloxy group, an alkylthio group, an arylthio group, an alkylsulfonyl group, an arylsulfonyl group, or an amino group. $R_{15}$ and $R_{16}$ each represent a hydrogen atom, an alkyl group, an aryl group, an alkylsulfonyl group, an arylsulfonyl group, or an alkoxycarbonyl group, and $R_{19}$ and $R_{20}$ each represent a hydrogen atom, an alkyl group, or an aryl group. $R_{19}$ and $R_{20}$ may bond together to form a benzene ring. $R_{13}$ and $R_{14}$, $R_{14}$ and $R_{15}$, $R_{15}$ and $R_{16}$, or $R_{13}$ and $R_{17}$ may bond together to form a ring (e.g., cyclobutane, cyclohexane, cycloheptane, cyclohexene, pyrrolidine, and piperidine).

Out of the heterocyclic groups represented by formula (Y-1), particularly preferable ones are those wherein Z represents —O—$CR_{13}(R_{14})$—, $NR_{15}$—$CR_{13}(R_{14})$—, or —$NR_{15}$—$NR_{16}$—. The number of carbon atoms in the heterocyclic group represented by formula (Y-1) is 2 to 30, preferably 4 to 20, and more preferably 5 to 16.

Formula (Y-2)

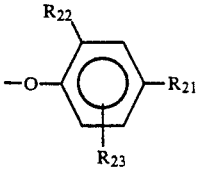

In formula (Y-2), at least one of $R_{21}$ and $R_{22}$ is a group selected from the group consisting of a halogen atom, a cyano group, a nitro group, a trifluoromethyl group, a carboxyl group, an alkoxycarbonyl group, a carbonamido group, a sulfonamido group, a carbamoyl group, a sulfamoyl group, an alkylsulfonyl group, an arylsulfonyl group, and an acyl group, and the other may be a hydrogen atom, an alkyl group, or an alkoxy group. $R_{23}$ has the same meaning as $R_{21}$ or $R_{22}$, and m is an integer of 0 to 2. The number of carbon atoms of the aryloxy group represented by formula (I-2) is 6 to 30, preferably 6 to 24, and more preferably 6 to 15.

Formula (Y-3)

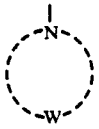

In formula (Y-3), W represents a group of nonmetallic atoms required to form together with the N a pyrrole ring, a pyrazole ring, an imidazole ring, or a triazole ring. Herein the ring represented by formula (Y-3) may be substituted, and a preferable example of the substituent is a halogen atom, a nitro group, a cyano group, an alkoxycarbonyl group, an alkyl group, an aryl group, an amino group, an alkoxy group, an aryloxyl group, or a carbamoyl group. The number of carbon atoms of the heterocyclic group represented by formula (Y-3) is 2 to 30, preferably 2 to 24, and more preferably 2 to 16.

Most preferably X is a group represented by formula (Y-1).

The coupler represented by formula (Y) may form a dimer or more higher polymer by bonding through a divalent or higher polyvalent group at the substituent $R_{11}$, Q, X or

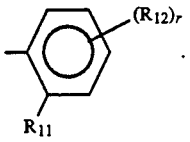

In this case, the number of carbon atoms in the substituents stated above may fall outside the specified ranges.

Specific examples of each of the substituents in formula (Y) are given below:

(1) Examples of the

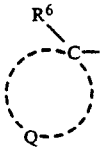

group formed by $R_7$ and Q with C

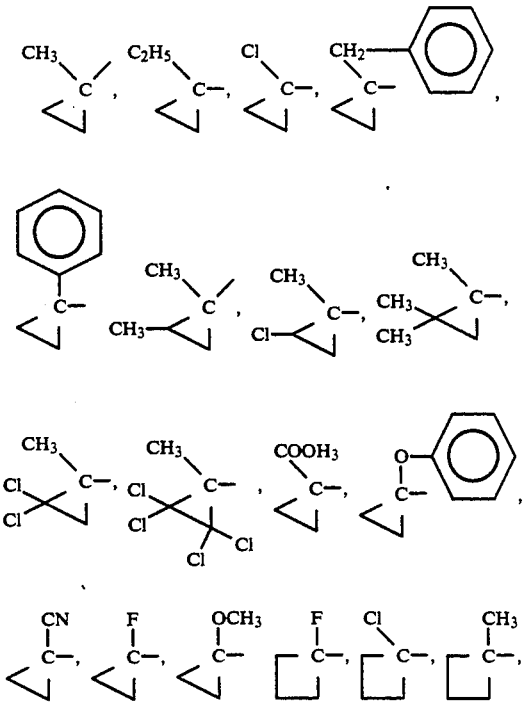

-continued

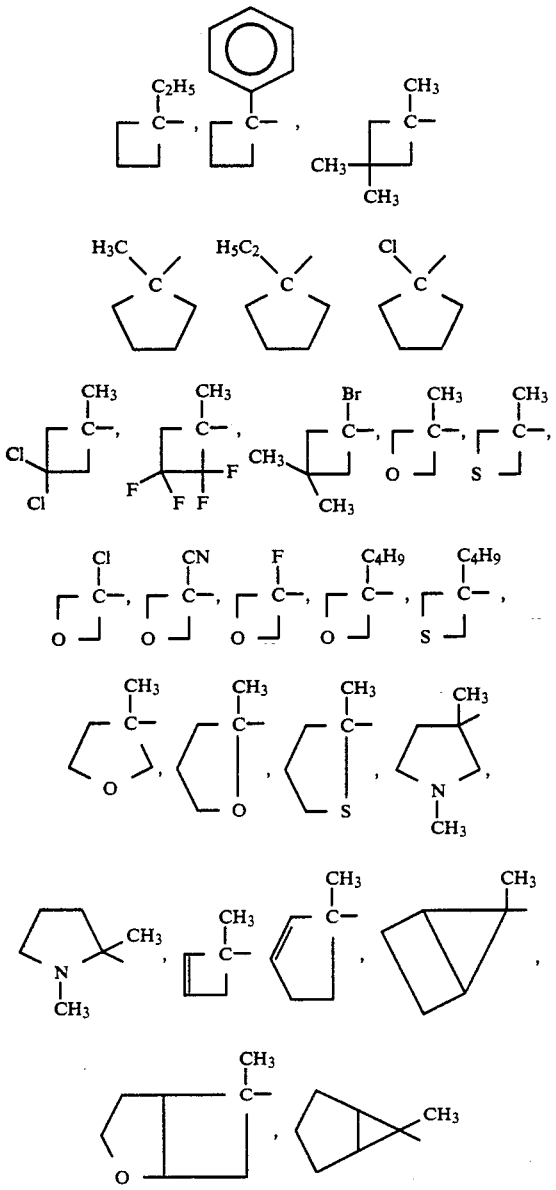

(2) Examples of $R_{11}$

F, Cl, Br, I, $CH_3O$—, 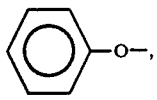

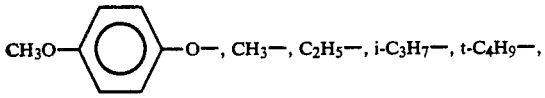

$CH_3OCH_2CH_2O$—, $CF_3$—, $(CH_3)_2N$—, 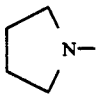

n-$C_4H_9O$—, n-$C_{14}H_{29}O$—, n-$C_{16}H_{33}O$—,

-continued

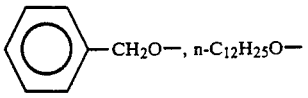

(3) Examples of $R_{12}$

F, Cl, Br, I, $CH_3O$—, $C_2H_6O$—, n-$C_{12}H_{25}O$—, $CH_3$, t-$C_4H_9$—, —$COOCH_3$, $COOC_2H_5$,

—$COOC_4H_9$-$^n$, —$COOC_{12}H_{25}$-$^n$, —$OCH_2CH(C_6H_{13}$-$^n)C_8H_{17}$-$^n$

—$COOCH(CH_3)COOC_{12}H_{25}$-$^n$, —$COOCH(C_4H_9$-$^n)COOC_{12}H_{29}$-$^n$,

—COO— 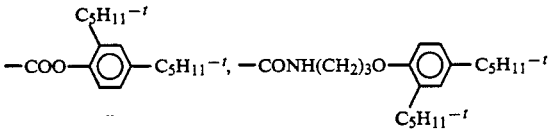

—$SO_2NH(CH_2)_4O$— 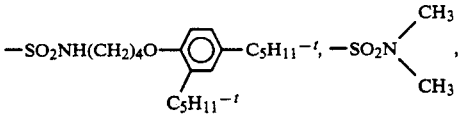

—$SO_2NHCOC_2H_5$, —$SO_2NHC_{16}H_{33}$-$^n$,

—$NHCOC_{13}H_{27}$-$^n$, —$NHCOC_{15}H_{31}$-$^n$, —$NHCOC_{17}H_{35}$-$^n$

—$NHCOCH(C_6H_{13}$-$^n)$—$C_3H_{17}$-$^n$, —$NHCOCH(CHCH_2C_4H_9$-$^t)$—$CH_2CH_2CH(CH_3)CH_2C_4H_9$-$^t$

—$NHCOCH(CH_3)CH_2SO_2C_{16}H_{33}$-$^n$

—$NHCO(CH_2)_3O$— 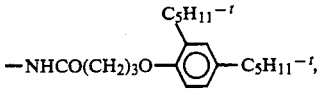

—$NHCOCH(C_2H_5)O$— 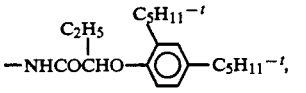

—$NHCOCH(C_3H_7$-$^i)SO_2C_{16}H_{33}$-$^n$, —$NHSO_2C_{12}H_{25}$-$^n$,

—$NHSO_2C_{16}H_{33}$-$^n$,

—$NHSO_2$— 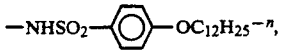

—$NHSO_2$— 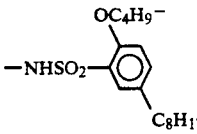 , —$SO_2NHCH_3$,

-continued
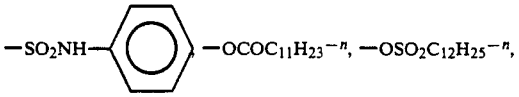
$-NHCOOC_{12}H_{25}-^{n}$,
(4) Examples of X
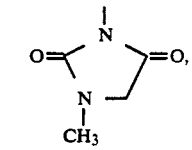
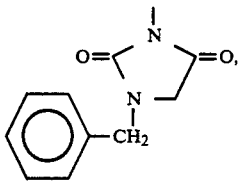
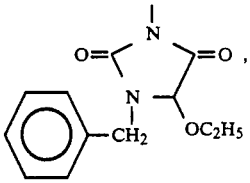
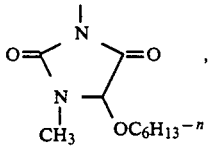
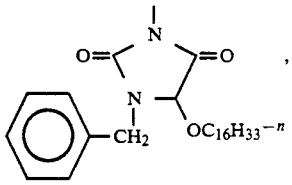
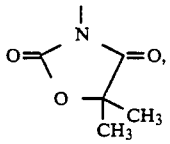
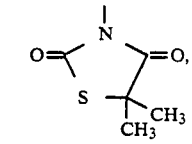
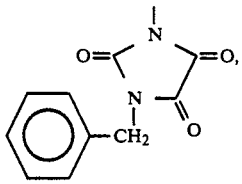
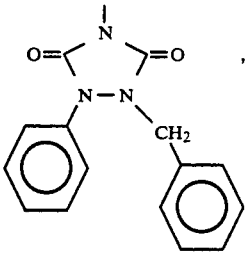
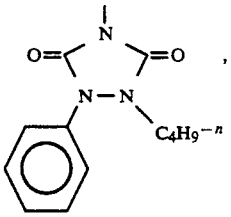
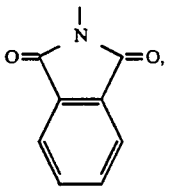
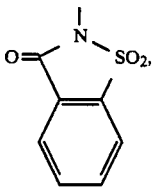
-continued
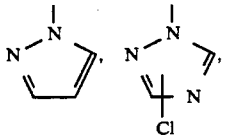
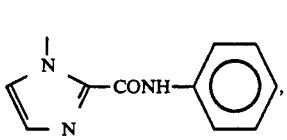
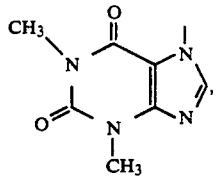
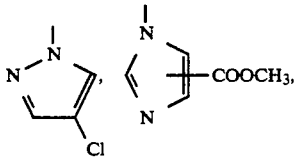
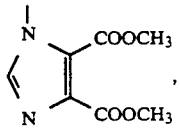
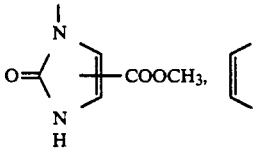
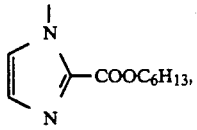
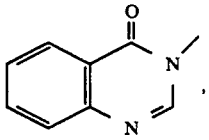
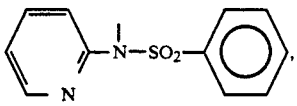
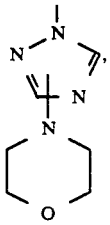
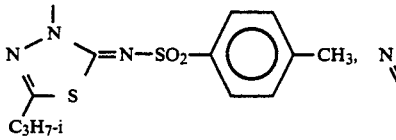
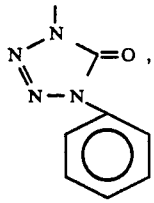
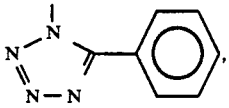
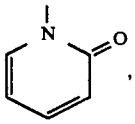
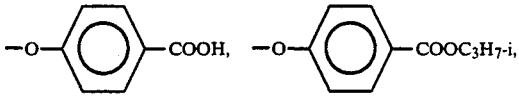

-continued
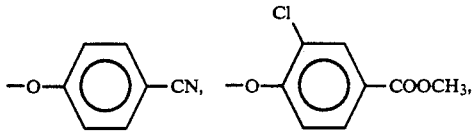
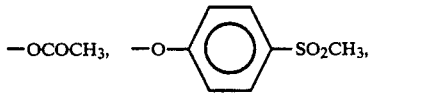
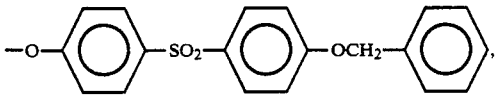
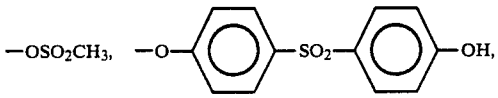
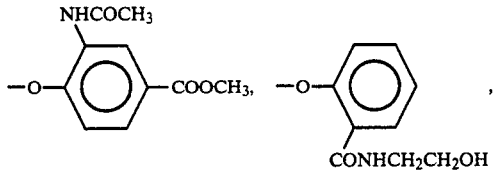
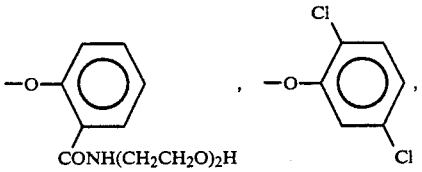
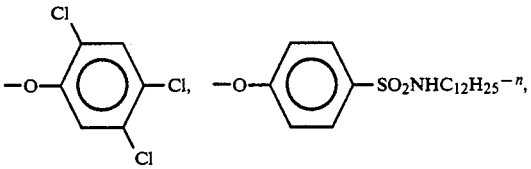
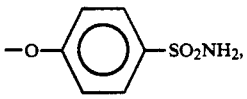
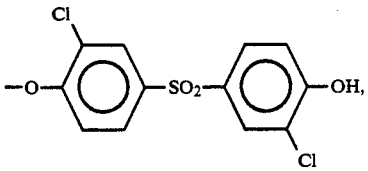
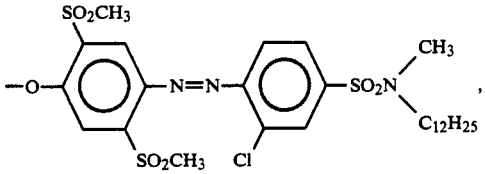
-continued
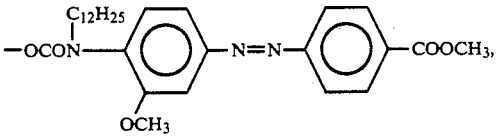
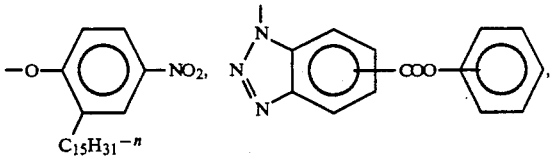
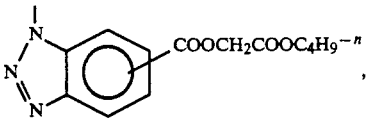
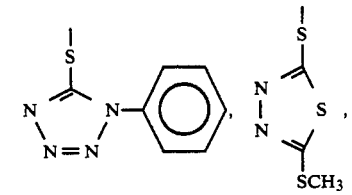
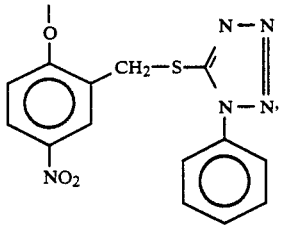
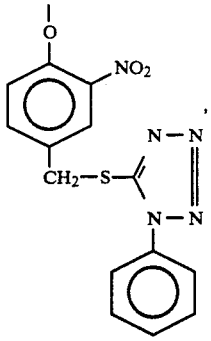
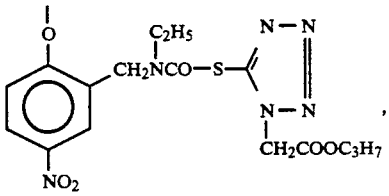
Exemplified yellow couplers represented by (Y) are shown below.

Y2-1
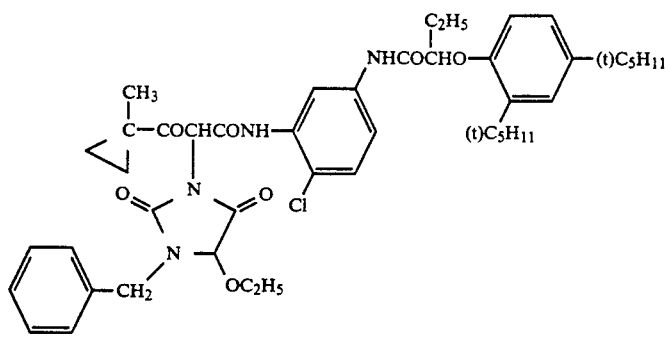
Y2-2
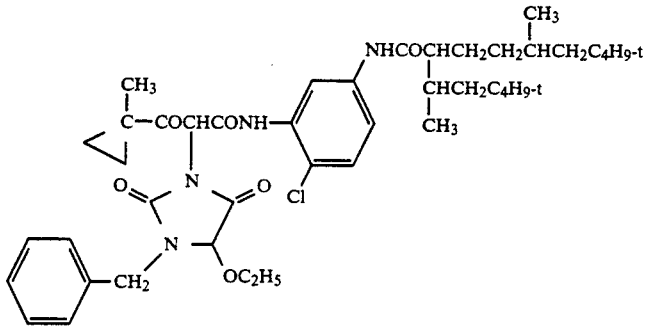
Y2-3
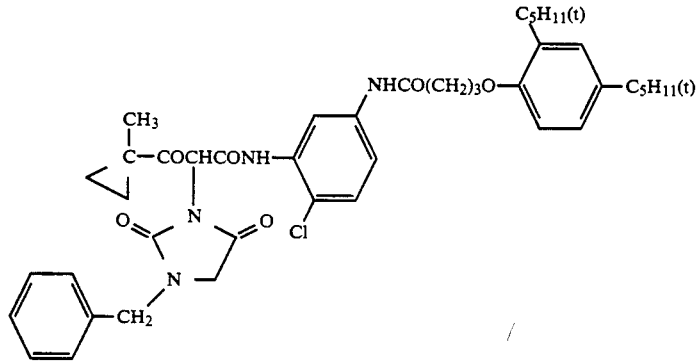
Y2-4
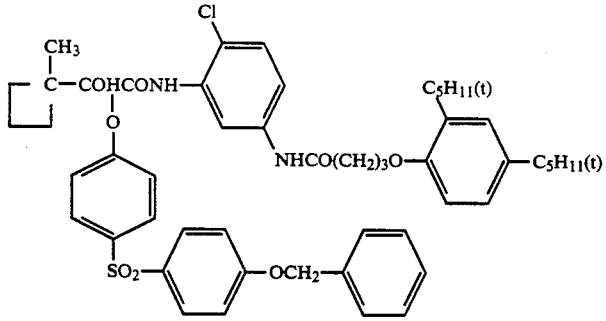
Y2-5
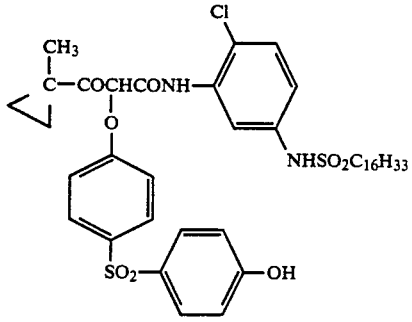

-continued
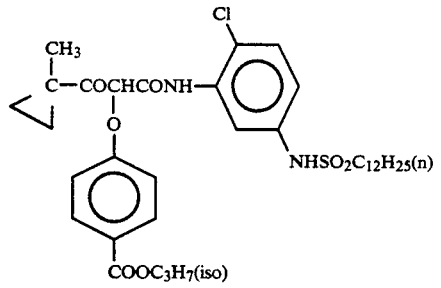
$Y_2$-6
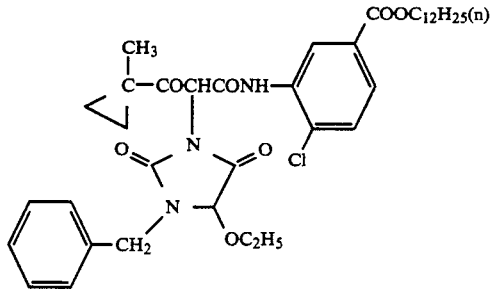
$Y_2$-7
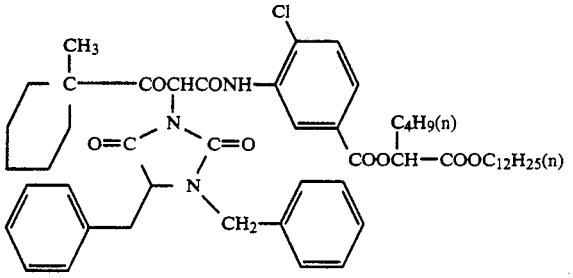
$Y_2$-8
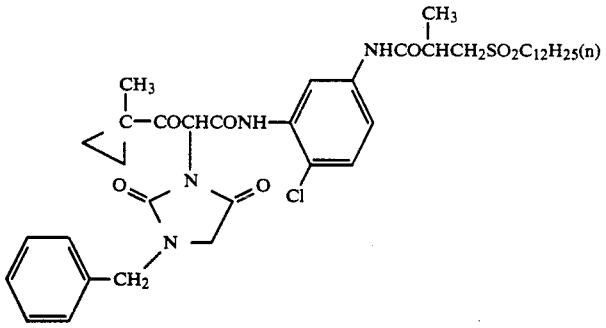
$Y_2$-9
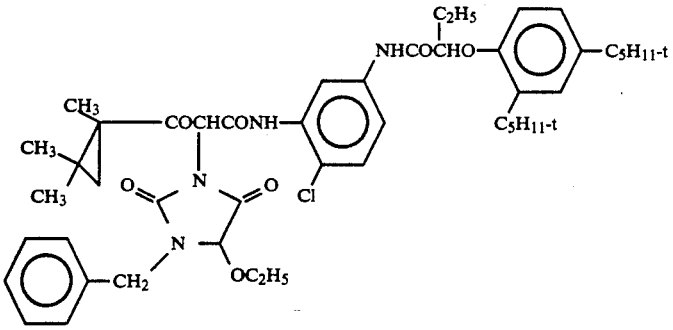
$Y_2$-10

-continued
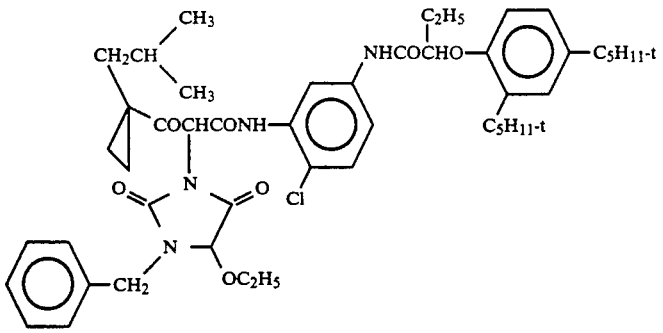
$Y_2$-11
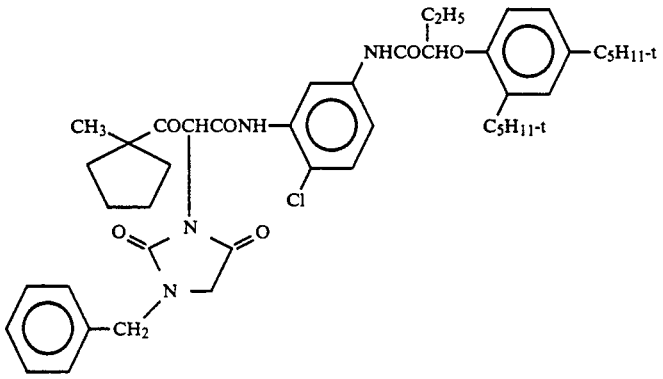
$Y_2$-12
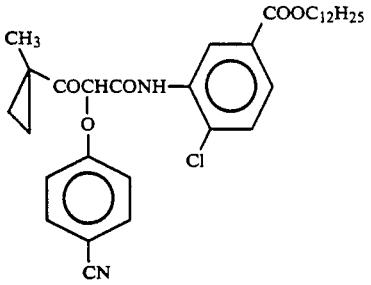
$Y_2$-13
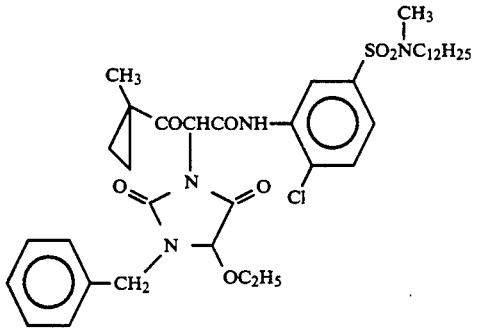
$Y_2$-14

-continued
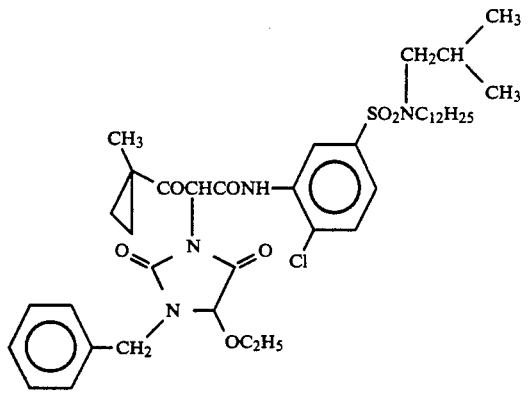
$Y_2$-15
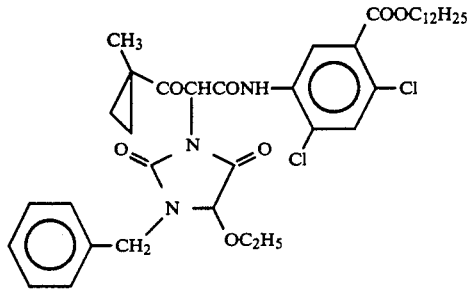
$Y_2$-16
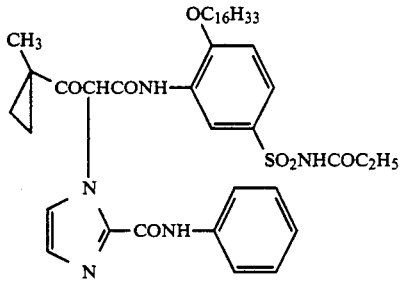
$Y_2$-17
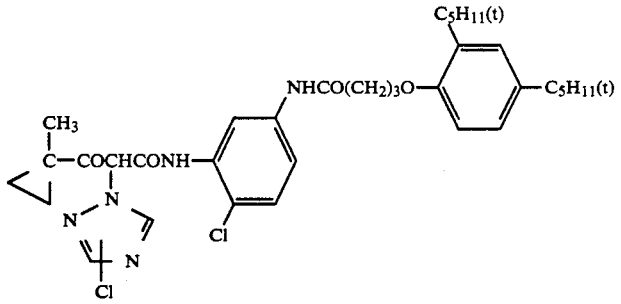
$Y_2$-18
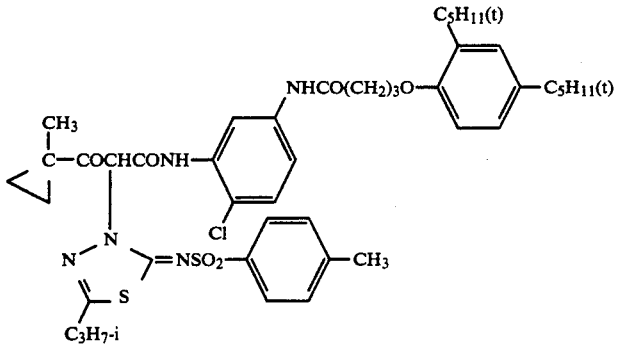
$Y_2$-19

-continued
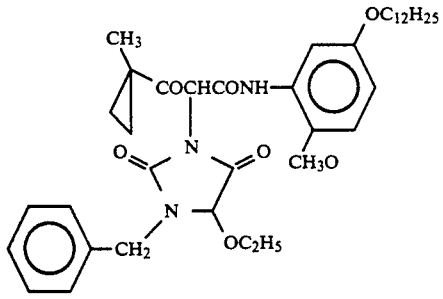
Y2-20
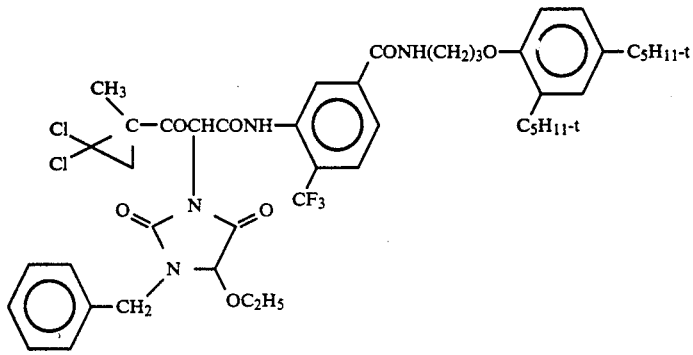
Y2-21
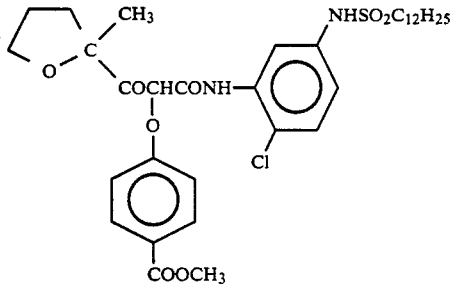
Y2-22
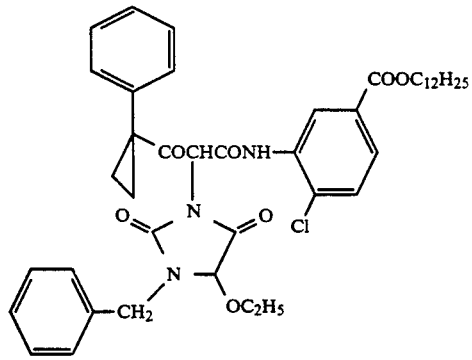
Y2-23
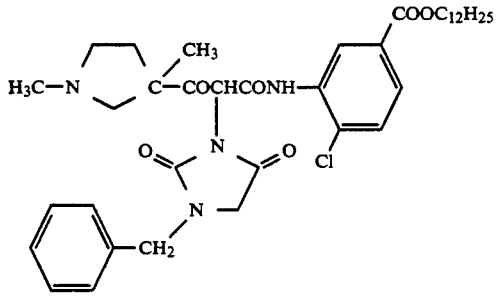
Y2-24

-continued
$Y_2$-25
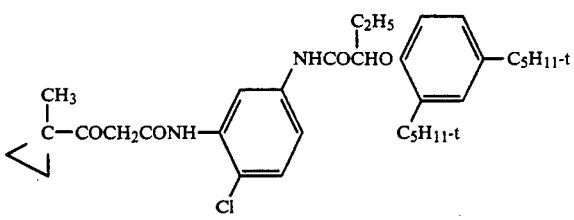
$Y_2$-26
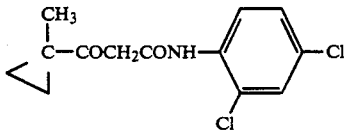
$Y_2$-27
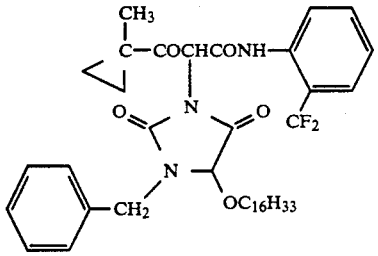
$Y_2$-28
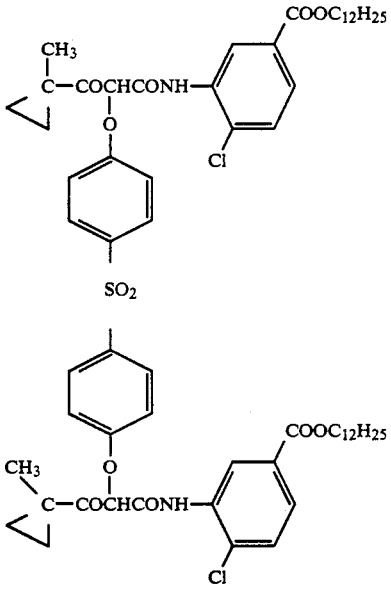
$Y_2$-29
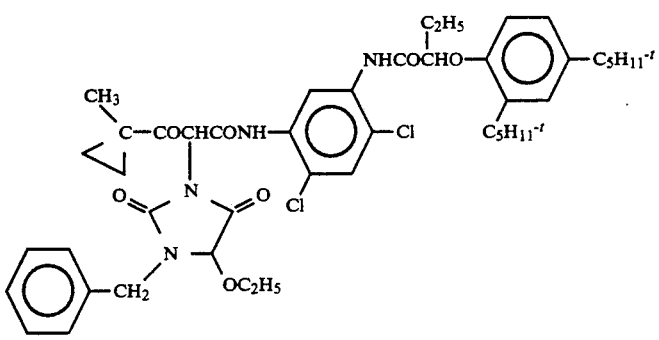

-continued
Y2-30
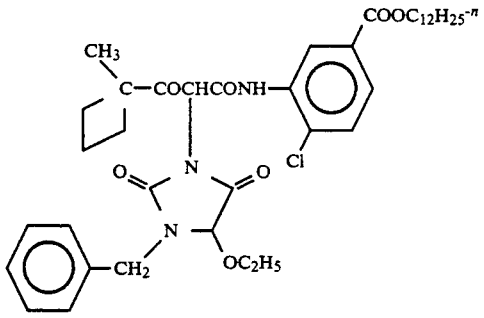
Y2-31
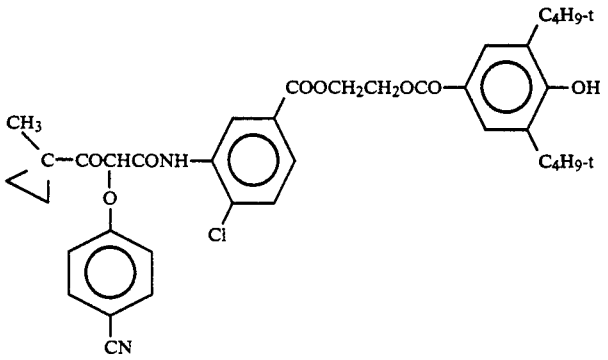
Y2-32
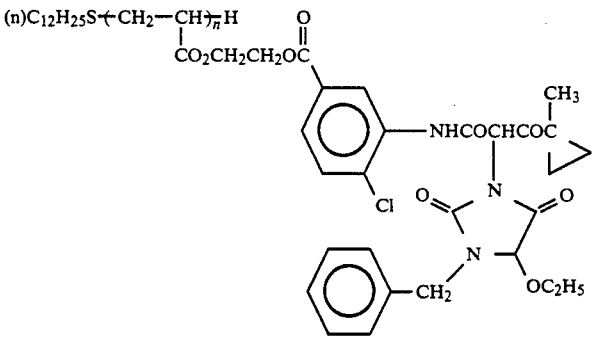
n = 3 (Average)
Y2-33
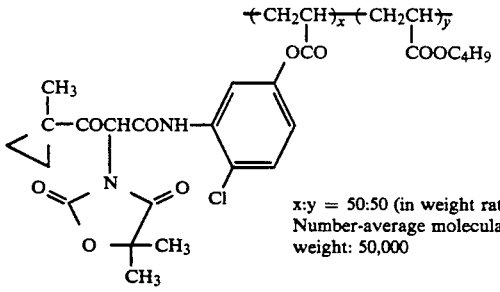
x:y = 50:50 (in weight ratio)
Number-average molecular weight: 50,000
Y2-34
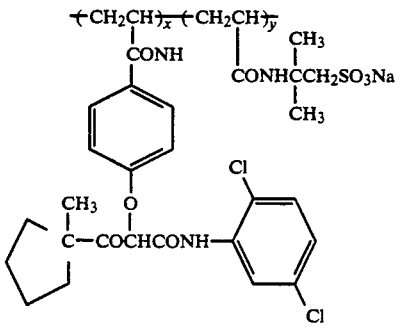

-continued
x:y = 80:20 (in weight ratio)
Number-average molecular weight: 70,000
Y2-35
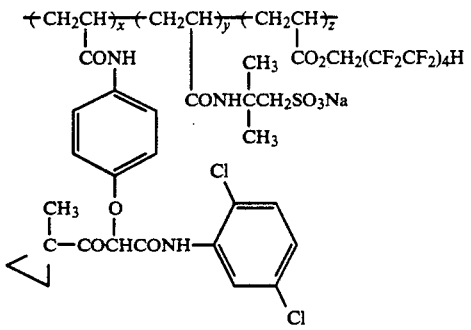
x:y:z = 50:30:20 (in weight ratio)
Number-average molecular weight: 70,000
Y2-36
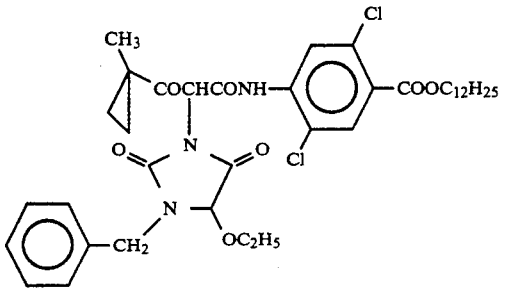
Y2-37
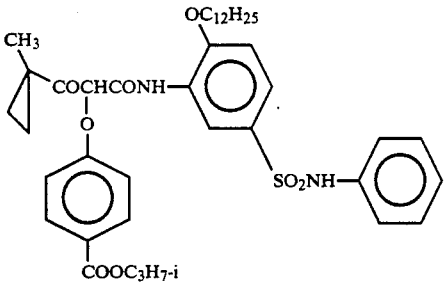
Y2-38
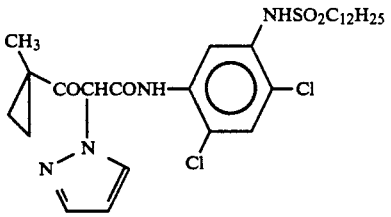
Y2-39
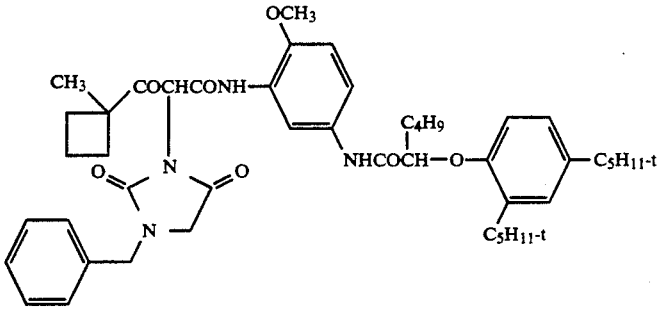

-continued
Y2-40
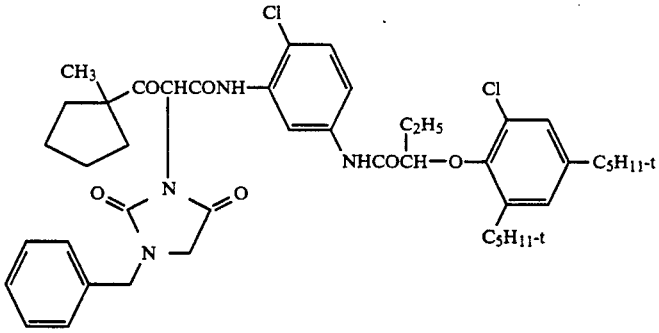
Y2-41
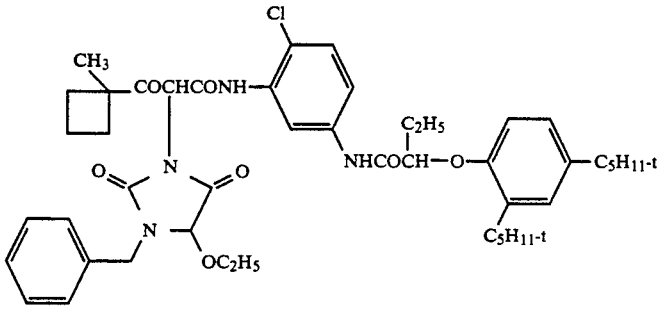
Y2-42
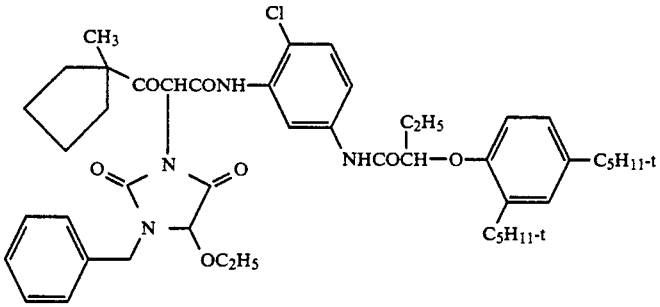
Y2-43
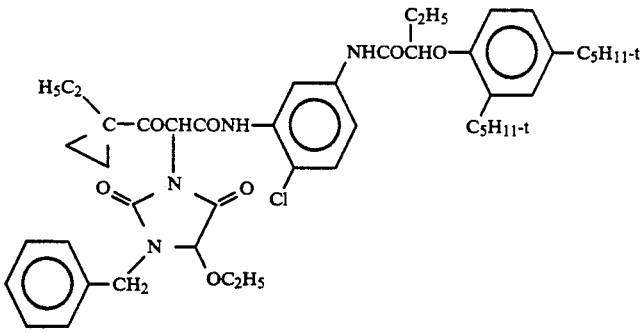
Y2-44
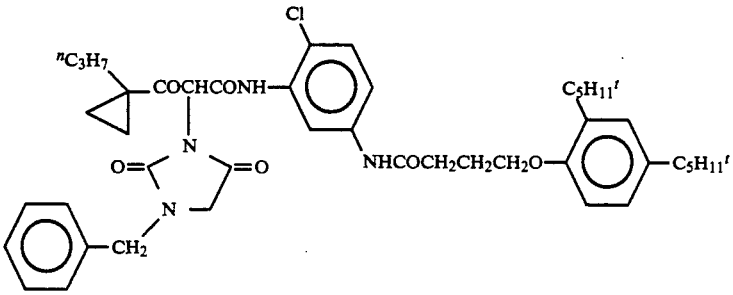

-continued
Y2-45
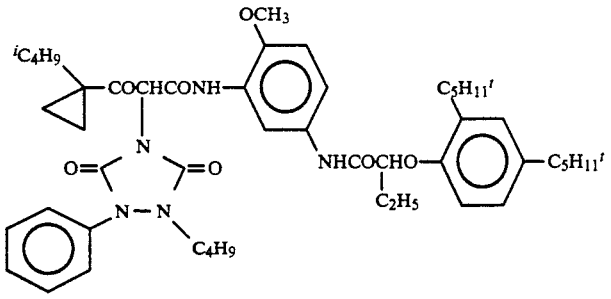
Y2-46
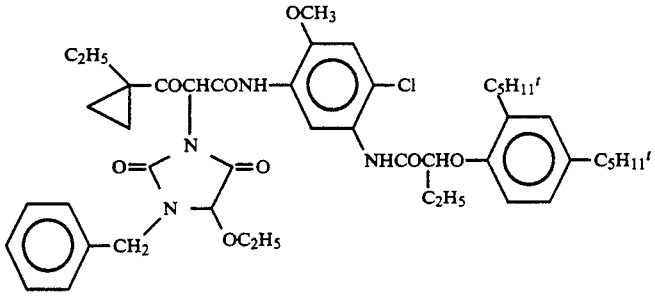
Y2-47
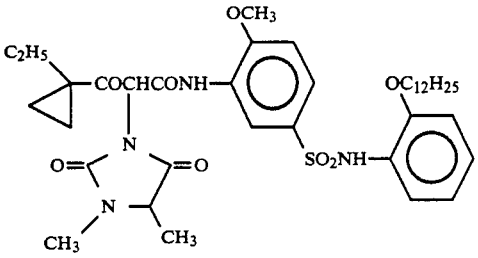
Y2-48
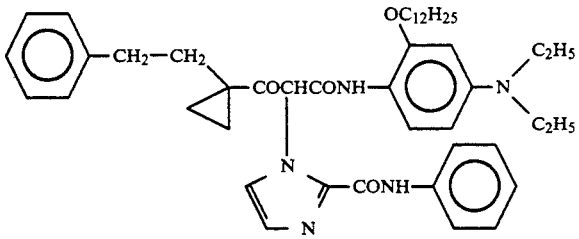
Y2-49
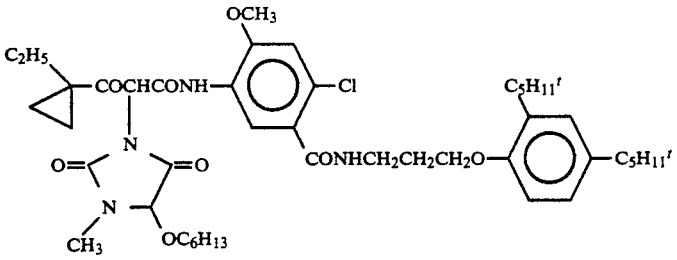
Y2-50
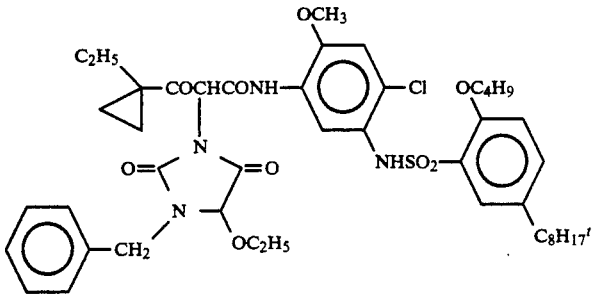

-continued
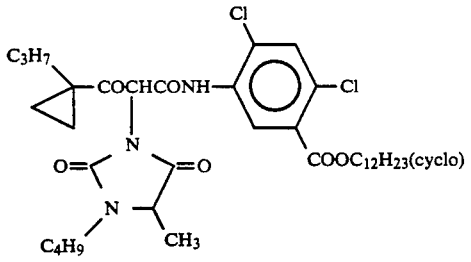
Y2-51
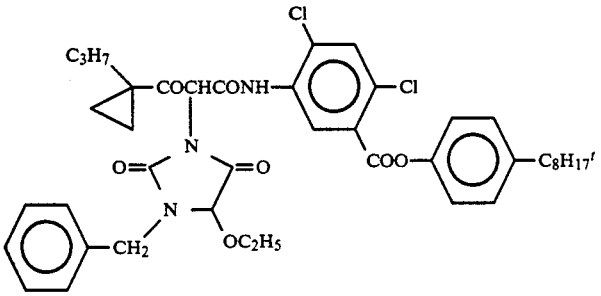
Y2-52
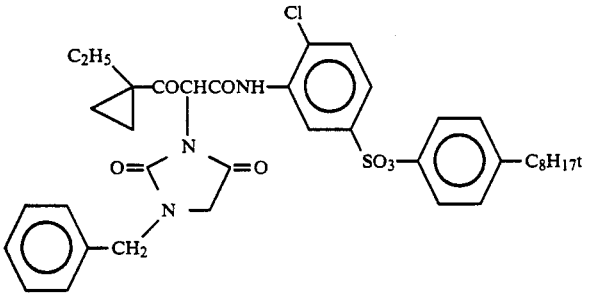
Y2-53
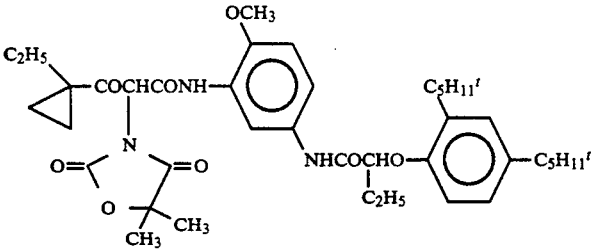
Y2-54
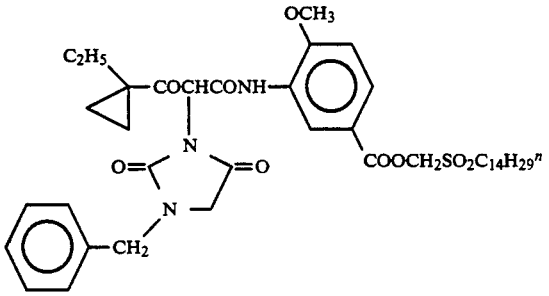
Y2-55

-continued
Y2-56
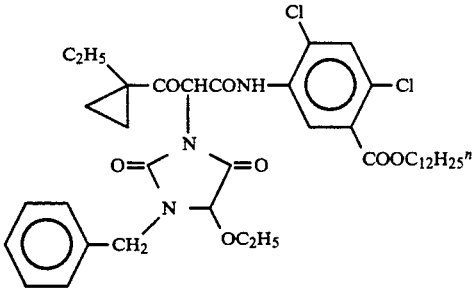
Y2-57
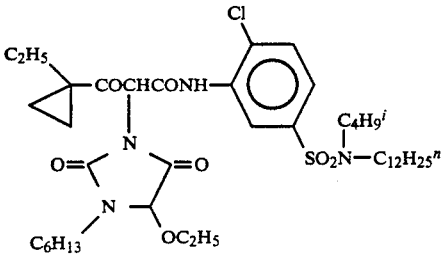
Y2-58
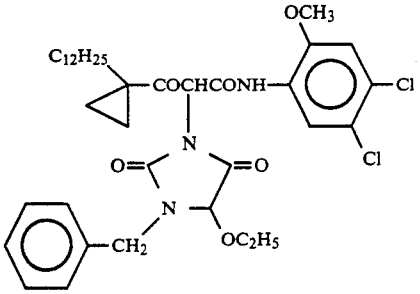
Y2-59
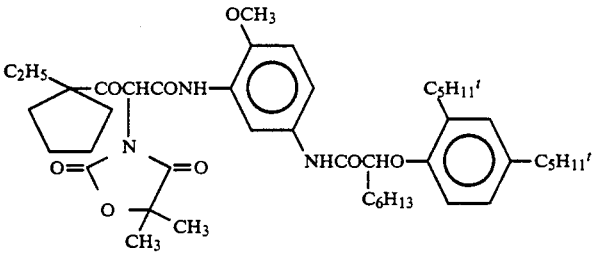
Y2-60
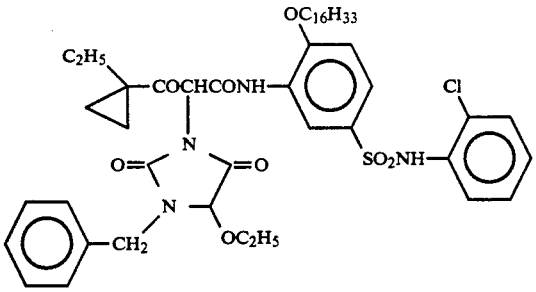
The yellow coupler represented by formula (Y) of the present invention can be synthesized by the following synthesis route:
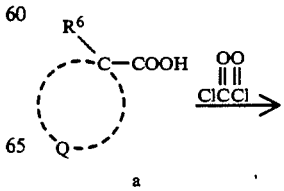

-continued

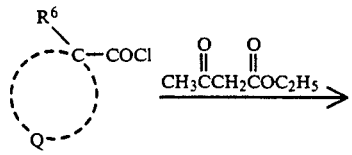

b

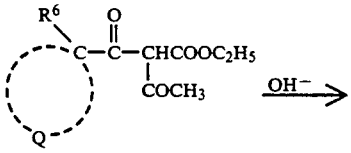

c

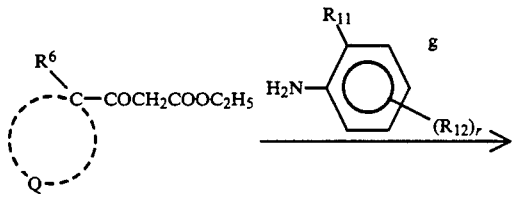

d

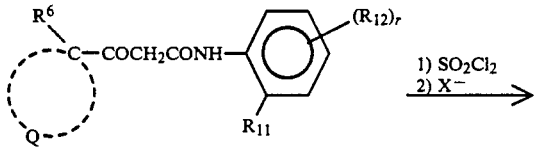

e

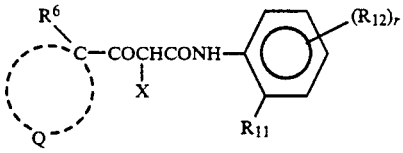

f

Compound a can be synthesized by an process described, for example, in J. Chem. Soc. (C), 1968, 2548, J. Am. Chem. Soc., 1934, 56, 2710, Synthesis, 1971, 285, J. Org. Chem., 1978, 43, 1729, or CA, 1960, 66, 18533y.

The synthesis of Compound b is carried out by a reaction using thionyl chloride, oxalyl chloride, etc., without a solvent or in a solvent such as methylene chloride, chloroform, carbon tetrachloride, dichloroethane, toluene, N,N-dimethylformamide, or N,N-dimethylacetamide. The reaction temperature is generally about −20° to about 150° C., preferably about −10° to about 80° C.

Compound c is synthesized by converting ethyl acetoacetate into an anion using magnesium methoxide or the like and adding b thereinto. The reaction is carried out without a solvent or in tetrahydrofuran, ethyl ether, or the like, and the reaction temperature is generally about −20° to about 60° C., preferably about −10° to about 30° C. Compound d is synthesized by a reaction using Compound c and, as a base, aqueous ammonia, an aqueous $NaHCO_3$ solution, an aqueous sodium hydroxide solution, or the like, without a solvent or in a solvent such as methanol, ethanol, and acetonitrile. The reaction temperature is about −20° to about 50° C., preferably about −10° to about 30° C.

Compound e is synthesized by reacting Compounds d and g without a solvent. The reaction temperature is generally about 100° to about 150° C., preferably about 100° to about 120° C. When X is not H, after chlorination or bromination the split-off group X is introduced to synthesize Compound f. Compound e is converted, in a solvent such as dichloroethane, carbon tetrachloride, chloroform, methylene chloride, or tetrahydrofuran, to the chlorine-substituted product by using sulfuryl chloride, N-chlorosuccinimide, or the like, or to the bromine-substituted product by using bromine, N-bromosuccinimide, or the like. At that time the reaction temperature is about −20° to about 70° C., preferably about −10° to about 50° C.

Then the chlorine-substituted product or the bromine-substituted product and the proton adduct H-X of the split-off group are reacted in a solvent, such as methylene chloride, chloroform, tetrahydrofuran, acetone, acetonitrile, dioxane, N-methylpyrrolidone, N,N'-dimethylimidazolidine-2-one, N,N-dimethylformamide, or N,N-dimethylacetamide at a reaction temperature of about −20° to about 150° C., preferably about −10° to about 100° C., so that Coupler f of the present invention can be obtained. At that time a base can be used, such as triethylamine, N-ethylmorpholine, tetramethylguanidine, potassium carbonate, sodium hydroxide, or sodium bicarbonate.

Synthesis Examples of couplers of the present invention are shown below.

SYNTHESIS EXAMPLE 5

Synthesis of Exemplified Compound $Y_2$-30

38.1 g of oxalyl chloride was added dropwise over 30 min to a mixture 25 g of 1-methylcyclopropanecarboxylic acid, which was synthesized by the method described by Gotkis, D., et al., J. Am. Chem. Soc., 1934, 56, 2710, 100 ml of methylene chloride, and 1 ml of N,N-dimethylformamide. After the addition the reaction was carried out for 2 hours at room temperature, and then the methylene chloride and excess oxalyl chloride were removed under reduced pressure by an aspirator, thereby producing an oil of 1-methylcyclopropanecarbonyl chloride.

100 ml of methanol was added dropwise over 30 min at room temperature to a mixture of 6 g of magnesium and 2 ml of carbon tetrachloride, after which the mixture was heated for 2 hours under reflux, and then 32.6 g of ethyl 3-oxobutanate was added dropwise over 30 min under heating and reflux. After the addition the mixture was heated under reflux for 2 hours, and then the methanol was distilled off completely under reduced pressure by an aspirator. 100 ml of tetrahydrofuran was added to and dispersed in the resultant solution, and the previously prepared 1-methylcyclopropanecarbonyl chloride was added dropwise to the dispersion at room temperature. After reacting for 30 min, the reaction liquid was subjected to extraction with 300 ml of ethyl acetate and diluted sulfuric acid, the organic layer was washed with water and dried over anhydrous sodium sulfate, and then the solvent was distilled off, to produce 55.3 g of an oil of ethyl 2-(1-methylcyclopropanecarbonyl)-3-oxobutanate.

A solution of 55 g of the ethyl 2-(1-methylcyclopropanecarbonyl)-3-oxobutanate and 160 ml of ethanol was stirred at room temperature, and 60 ml of a 30% aqueous ammonia was added thereto over 10 min. Thereafter the resulting mixture was stirred for 1 hour and then was subjected to extraction with 300 ml of ethyl acetate and diluted hydrochloric acid, followed by neutralizing and washing with water; then the organic layer was dried over anhydrous sodium sulfate and the solvent was distilled off, to produce 43 g of an oil of ethyl (1-methylcyclopropanecarbonyl)acetate.

34 g of the ethyl (1-methylcyclopropanecarbonyl-)acetate and 44.5 g of N-(3-amino-4-chlorophenyl)-2-(2,4-di-t-pentylphenoxy)butaneamide were heated at an internal temperature of 100° to 120° C. under reflux and reduced pressure by an aspirator. After reacting for 4 hours, the reaction solution was purified by column chromatography with a mixed solvent of n-hexane and ethyl acetate, to produce a viscous oil of 49 g of the Exemplified Compound $Y_2$-30. The structure of the compound was identified by MS spectrum, NMR spectrum, and elemental analysis.

SYNTHESIS EXAMPLE 6

Synthesis of Exemplified Compound $Y_2$-1

22.8 of the Exemplified Compound $Y_2$-30 was dissolved in 300 ml of methylene chloride, and 5.4 g of sulfuryl chloride was added dropwise over 10 min to the resulting solution under cooling with ice. After reacting for 30 min, the reaction liquid was washed well with water and was dried over anhydrous sodium sulfate, followed by concentration, to obtain the chloride of the Exemplified Compound Y-25. A solution of the thus synthesized chloride of the Exemplified Compound Y-25 in 50 ml of N,N-dimethylformaldehyde was added dropwise over 30 min at room temperature to a solution of 18.7 g of 1-benzyl-5-ethoxyhydantoin, 11.2 ml of triethylamine, and 50 ml of N,N-dimethylformamide.

Thereafter the reaction was allowed to continue for four hours at 40° C., and then the reaction liquid was subjected to extraction with 300 ml of ethyl acetate, thereafter washed with water and then washed with 300 ml of a 2% aqueous triethylamine solution. This was followed by neutralization with diluted hydrochloric acid. After the organic layer was dried over anhydrous sodium sulfate, the solvent was distilled off, and the thus obtained oil was crystallized from a mixed solvent of n-hexane and ethyl acetate. After the thus obtained crystals were filtered off, followed by washing with a mixed solvent of n-hexane and ethyl acetate, they were dried, to obtain 2.8 g of crystals of the Exemplified Compound $Y_2$-1. The structure of the compound was identified by MS spectrum, NMR spectrum, and elemental analysis. The melting point was 132° to 133° C.

Two or more of yellow couplers represented by formulae (II) and (III) and acylacetamide-type yellow dye-forming coupler represented by formula (IV) may be used in combination, and they may be used in combination with a yellow coupler other than couplers of this invention.

The amount of the yellow coupler of the present invention is contained generally in a range of 0.1 to 1.0 mol, preferably 0.1 to 0.5 mol, per mol of silver halide in a silver halide emulsion layer constituting the photosensitive layer.

Although, as a silver halide used in the present invention, for example, silver chloride, silver bromide, silver bromo(iodo)chloride, and silver bromoiodide can be used, particularly if rapid processing is intended, a silver chloride emulsion or a silver bromochloride emulsion substantially being free from silver iodide and having a silver chloride content of 90 mol % or more, preferably 95 mol % or more, particularly preferably 98 mol % or more, is used preferably.

In the photographic material according to the present invention, in order to improve, for example, sharpness of the image, preferably a dye that can be decolored by processing (in particular an oxonol dye), as described in European Patent EP 0,337,490A2, pages 27 to 76, is added to a hydrophilic layer, so that the optical reflection density of the photographic material at 680 nm may be 0.70 or over, or 12 wt% or more (preferably 14 wt% or more) of titanium oxide the surface of which has been treated with secondary to quaternary alcohol (e.g., trimethylolethane) or the like is contained in a water-resistant resin layer of the support.

As a high-boiling organic solvent for photographic additives, such as cyan, magenta, and yellow couplers that can be used in the present invention, any compound can be used if the compound has a melting point of 100° C. or below and a boiling point of 140° C. or over; if it is immiscible with water; and if it is a good solvent for the coupler. The melting point of the high-boiling organic solvent is preferably 80° C. or below and the boiling point of the high-boiling organic solvent is preferably 160° C. or over, more preferably 170° C. or over.

Details of these high-boiling organic solvents are described in JP-A No. 215272/1987, from page 137 (right lower column) to page 144 (right upper column).

The cyan, magenta, or yellow coupler can be emulsified and dispersed into a hydrophilic colloid, by impregnating into a loadable latex polymer (e.g., see U.S. Pat. No. 4,203,716) in the presence or absence of the above high-boiling organic solvent or by dissolving into a polymer insoluble in water but soluble in organic solvents.

Preferably, homopolymers and copolymers described in U.S. Pat. No. 4,857,449 (7th column to 15th column) and International Publication WO 88/00723 (pages 12 to 30), are used, and more preferably methacrylate polymers or acrylamide polymers, particularly preferably acrylamide polymers, are used because, for example, the color image is stabilized.

In the photographic material according to the present invention, preferably together with the coupler a color image preservability-improving compound, as described in European Patent EP 0,277,589A2, is used. Particularly a combination with a pyrazoloazole coupler is preferable.

That is, when a compound (F), which will chemically combine with the aromatic amine developing agent remaining after the color development processing to form a chemically inactive and substantially colorless compound, and/or a compound (G), which will chemically combine with the oxidized product of the aromatic amine color developing agent remaining after the color development processing to form a chemically inactive and substantially colorless compound, are used simultaneously or singly, it is preferable because occurrence of stain and other side effects, for example, due to the production of a color-formed dye by reaction of the coupler with the color-developing agent or its oxidized product remaining in the film during the storage after the processing, can be prevented.

To the photographic material according to the present invention, a mildew-proofing agent described, for example, in JP-A No. 271247/1988, is preferably added in order to prevent the growth of a variety of mildews and fungi that will propagate in the hydrophilic layer and deteriorate the image thereon.

As a support to be used for the photographic material of the present invention, a white polyester support for display may be used, or a support wherein a layer containing white pigment is provided on the side that will have a silver halide layer. Further, in order to improve sharpness, preferably an anti-halation layer is applied on the side of the support where the silver halide layer is applied or on the undersurface of the support. In particular, preferably the transmission density of the base is set in the range of 0.35 to 0.8, so that the display can be appreciated through either reflected light or transmitted light.

The photographic material of the present invention may be exposed to visible light or infrared light. The method of exposure may be low-intensity exposure or high-intensity short-time exposure, and particularly in the later case, the laser scan exposure system, wherein the exposure time per picture element is less than $10^{-4}$ sec is preferable.

When exposure is carried out, the band stop filter, described in U.S. Pat. No. 4,880,726, is preferably used. Thereby light color mixing is eliminated and the color reproduction is remarkably improved.

The exposed photographic material may be subjected to conventional color development processing, and then preferably it is subjected to bleach-fix processing for the purpose of rapid processing. In particular, when the above-mentioned high-silver-chloride emulsion is used, the pH of the bleach-fix solution is preferably about 6.5 or below, more preferably about 6 or below, for the purpose of the acceleration of desilvering.

With respect to silver halide emulsions, other materials (e.g., additives) and photographic component layers (e.g., layer arrangement) that will be applied to the photographic material of the present invention, as well as processing methods and processing additives that will be applied to the photographic material of the present invention, particularly those described in below-mentioned patent publications, particularly in European Patent EP 0,355,660A2 (JP-A No. 139544/1990), are preferably used.

| Element constituting photographic material | JP-A No. 215272/1987 | JP-A No. 33144/1990 | EP 0,355,660A2 |
|---|---|---|---|
| Silver halide emulsion | p. 10 upper right column line 6 to p. 12 lower left column line 5, and p. 12 lower right column line 4 from the bottom to p. 13 upper left column line 17 | p. 28 upper right column line 16 to p. 29 lower right column line 11 and p. 30 lines 2 to 5 | p. 45 line 53 to p. 47 line 3 and p. 47 lines 20 to 22 |
| Solvent for silver halide | p. 12 lower left column line 6 to 14 and p. 13 upper left column line 3 from the bottom to p. 18 lower left column last line | — | — |
| Chemical sensitizing agent | p. 12 lower left column line 3 from the bottom to lower right column line 5 from the bottom and p. 18 lower right column line 1 to p. 22 upper right column line 9 from the bottom | p. 29 lower right column line 12 to last line | p. 47 lines 4 to 9 |
| Spectral sensitizing agent (method) | p. 22 upper right column line 8 from the bottom to p. 38 last line | p. 30 upper left column lines 1 to 13 | p. 47 lines 10 to 15 |
| Emulsion stabilizer | p. 39 upper left column line 1 to p. 72 upper right column last line | p. 30 upper left column line 14 to upper right column line 1 | p. 47 lines 16 to 19 |
| Developing accelerator | p. 72 lower left column line 1 to p. 91 upper right column line 3 | — | — |
| Color coupler (Cyan, Magent, and Yellow coupler) | p. 91 upper right column line 4 to p. 121 upper left column line 6 | p. 3 upper right column line 14 to p. 18 upper left column last line and p. 30 upper right column line 6 to p. 35 lower right column line 11 | p. 4 lines 15 to 27, p. 5 line 30 to p. 28 last line, p. 45 lines 29 to 31 and p. 47 line 23 to p. 63 line 50 |
| Color Formation-strengthen agent | p. 121 upper left column line 7 to p. 125 upper right column line 1 | — | — |
| Ultra violet absorbent | p. 125 upper right column line 2 to p. 127 lower left column last line | p. 37 lower right column line 14 to p. 38 upper left column line 11 | p. 65 lines 22 to 31 |
| Discoloration inhibitor (Image-dye stabilizer) | p. 127 lower right column line 1 to p. 137 lower left column line 8 | p. 36 upper right column line 12 to p. 37 upper left column line 19 | p. 4 line 30 to p. 5 line 23, p. 29 line 1 to p. 45 line 25 p. 45 lines 33 to 40 and p. 65 lines 2 to 21 |
| High-boiling and /or low-boiling solvent | p. 137 lower left column line 9 to p. 144 upper right column last line | p. 35 lower right column line 14 to p. 36 upper left column line 4 | p. 64 lines 1 to 51 |
| Method for dispersing additives for photograph | p. 144 lower left column line 1 to p. 146 upper right coulumn line 7 | p. 27 lower right column line 10 to p. 28 upper left column last line and p. 35 lower right column line 12 to p. 36 upper right column line 7 | p. 63 line 51 to p. 64 line 56 |
| Film Hardener | p. 146 upper right column line 8 | — | — |

-continued

| Element constituting photographic material | JP-A No. 215272/1987 | JP-A No. 33144/1990 | EP 0,355,660A2 |
|---|---|---|---|
| | to p. 155 lower left column line 4 | | |
| Developing Agent precursor | p. 155 lower left column line 5 to p. 155 lower right column line 2 | — | — |
| Compound releasing development restrainer | p. 155 lower right column lines 3 to 9 | — | — |
| Base | p. 155 lower right column line 19 to p. 156 upper left column line 14 | p. 38 upper right column line 18 to p. 39 upper left column line 3 | p. 66 line 29 to p. 67 line 13 |
| Constitution of photosensitive layer | p. 156 upper left column line 15 to p. 156 lower right column line 14 | p. 28 upper right column lines 1 to 15 | p. 45 lines 41 to 52 |
| Dye | p. 156 lower right column line 15 to p. 184 lower ringt column last line | p. 38 upper left column line 12 to upper right column line 7 | p. 66 lines 18 to 22 |
| Color-mix inhibitor | p. 185 upper left column line 1 to p. 188 lower right column line 3 | p. 36 upper right column lines 8 to 11 | p. 64 line 57 to p. 65 line 1 |
| Gradation controller | p. 188 lower right column lines 4 to 8 | — | — |
| Stain inhibitor | p. 188 lower right column line 9 to p. 193 lower right column line 10 | p. 37 upper left column last line to lower right column line 13 | p. 65 line 32 to p. 66 line 1 |
| Surface-active agent | p. 201 lower left column line 1 to p. 210 upper right column last line | p. 18 upper right column line 1 to p. 24 lower right column last line and p. 27 lower left column line 10 from the bottom to lower right column line 9 | — |
| Fluorine-containing agent (As Antistatic agent, coating aid, lubricant, adhesion inhibitor, or the like) | p. 210 lower left column line 1 to p. 222 lower left column line 5 | p. 25 upper left column line 1 to 1 to p. 27 lower right column line 9 | — |
| Binder (Hydrophilic colloid) | p. 222 lower left column line 6 to p. 225 upper left column last line | p. 38 upper right column lines 8 to 18 | p. 66 lines 23 to 28 |
| Thickening agent | p. 225 upper right column line 1 to p. 227 upper right column line 2 | — | — |
| Antistatic agent | p. 227 upper right column line 3 to p. 230 upper left column line 1 | — | — |
| Polymer latex latex | p. 230 upper left column line 2 to p. 239 last line | — | — |
| Matting agent | p. 240 upper left column line 1 to p. 240 upper right column last line | — | — |
| Photographic processing method (processing process, additive, etc.) | p. 3 upper right column line 7 to p. 10 upper right column line 5 | p. 39 upper left column line 4 to p. 42 upper left column last line | p. 67 line 14 to p. 69 line 28 |

Note:
In the cited part of JP-A No. 21572/1987, amendment filed on March 16, 1987 is included.

Further, as cyan couplers, diphenylimidazole cyan couplers described in JP-A No. 33144/1990, as well as 3-hydroxypyridine cyan couplers described in European Patent EP 0,333,185A (in particular one obtained by causing Coupler (42), which is a four-equivalent coupler, to have a chlorine coupling releasing group, thereby rendering it two-equivalent, and Couplers (6) and (9), which are listed as specific examples, are preferable) and cyclic active methylene cyan couplers described in JP-A No. 32260/1989 (in particular, specifically listed Coupler Examples 3, 8, and 12 are preferable) are preferably used.

As a method for processing a silver halide color photographic material using a high-silver-chloride emulsion having a silver chloride content of 90 mol % or more, the method described in JP-A No. 207250/1990 (left upper column of page 27 to right upper column of page 34) is preferably used.

According to the present silver halide color photographic material, a photographic material excellent in emulsion stability and spectral properties and light fastness of the yellow color formed dye can be obtained. In that case, the photographic material is not attended with adverse effects on other photographic characteristics, for example, typically on fastness to heat and humidity and color forming properties of the couplers.

The present invention will be described in more detail in accordance with Examples, but the invention is not limited to these Examples.

EXAMPLE 1

A multilayer color print paper (Sample 1) having layer compositions shown below was prepared on a transparent support of triacetate cellulose provided a gelatin subbing layer containing sodium dodecylbenzenesulfonate. Coating solutions were prepared as follows:

Preparation of the First Layer Coating Solution

To a mixture of 19.1 g of yellow coupler ($ExY_1$), 0.12 g of image-dye stabilizer (Cpd-1), and 0.7 g of image-dye stabilizer (Cpd-6) were added and dissolved 27.2 ml of ethyl acetate and each 4.1 g of solvent (Solv-3) and solvent (Solv-7). The resulting solution was dispersed and emulsified in 185 ml of 10% aqueous gelatin solution containing 8 ml of sodium dodecylbenzenesulfonate, thereby prepared emulsified dispersion A. Separately silver chlorobromide emulsion A (cubic grains, 3:7 (silver molar ratio) blend of large size grain emulsion A having an average grain size of 0.88 μm and small size grain emulsion A having an average grain size of 0.70 μm, each of whose deviation coefficients of grain size was 0.08 and 0.10, respectively, and each in which emulsion 0.3 mol % of silver bromide was located at the surface of grains) was prepared. In this emulsion A, blue-sensitive sensitizing dyes A and B, shown below, were added in such amount of $2.0\times10^{-4}$ mol to the large size emulsion A and $2.5\times10^{-4}$ mol to the small size emulsion B, per mol of silver, respectively. The chemical ripening was carried out by adding sulfur sensitizing agent and gold sensitizing agent. The above-described emulsified dispersion A and this emulsion A were mixed together and dissolved to give the composition shown below, thereby preparing the first layer coating solution.

Coating solutions for the second to the seventh layer were also prepared in the same manner as the first layer coating solution. As a gelatin hardener for the respective layers, 1-hydroxy-3,5-dichloro-s-triazine sodium salt was used.

As spectral-sensitizing dyes for the respective layers, the following compounds were used:

Blue-Sensitive Emulsion Layer

Sensitizing dye A

-continued

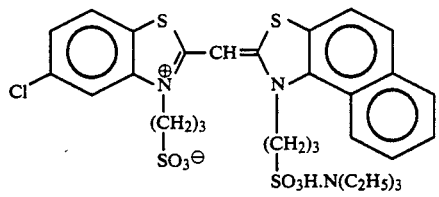

and

Sensitizing dye B

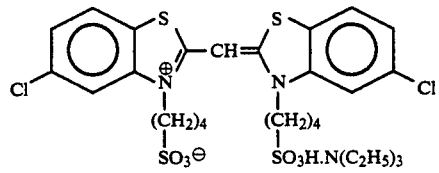

(each $2.0\times10^{-4}$ mol to the large size emulsion A and $2.5\times10^{-4}$ mol to the small size emulsion B, per mol of silver halide.)

Green-Sensitive Emulsion Layer

Sensitizing dye C

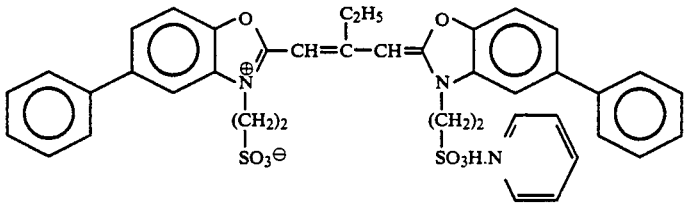

($4.0\times10^{-4}$ mol to the large size emulsion and $5.6\times10^{-4}$ mol to the small size emulsion, per mol of silver halide), and Sensitizing dye D

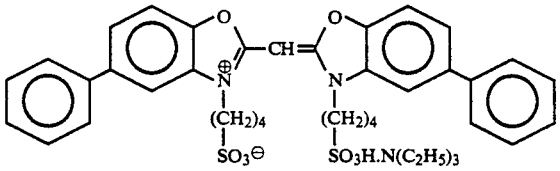

($7.0\times10^{-5}$ mol to the large size emulsion B and $1.0\times10^{-5}$ mol to the small size emulsion B, per mol of silver halide)

Red-Sensitive Emulsion Layer

Sensitizing dye E

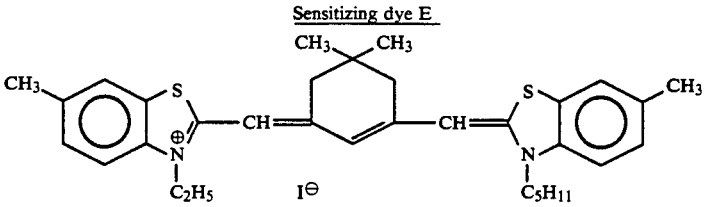

($0.9\times10^{-4}$ mol to the large size emulsion C and $1.1\times10^{-4}$ mol to the small size emulsion C, per mol of silver halide)

To the red-sensitive emulsion layer, the following compound was added in an amount of $2.6\times10^{-3}$ mol per mol of silver halide:

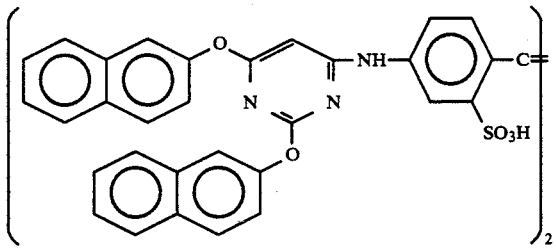

Further, 1-(5-methylureidophenyl)-5-mercaptotetrazole was added to the yellow color-forming emulsion layer, the magenta color-forming emulsion layer, and the cyan color-forming emulsion layer in amount of $8.5\times10^{-5}$ mol, $7.0\times10^{-4}$ mol, and $2.5\times10^{-4}$ mol, per mol of silver halide, respectively.

Further, 4-hydroxy-6-methyl-1,3,3a,7-tetrazaindene was added to the yellow color-forming emulsion layer and the magenta color-forming emulsion layer in amount of $1\times10^{-4}$ and $2\times10^{-4}$ mol, per mol of silver halide, respectively.

The dyes shown below (figure in parentheses represents coating amount) were added to the emulsion layers for prevention of irradiation.

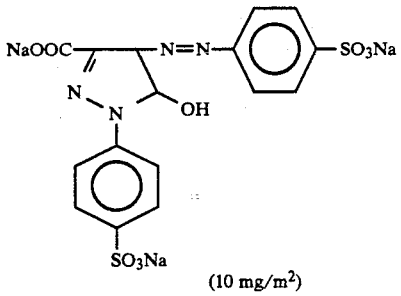

(10 mg/m²)

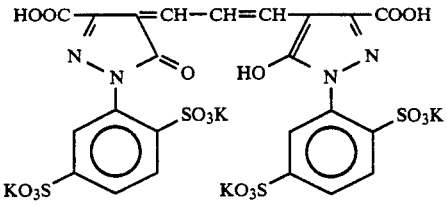

(10 mg/m²)

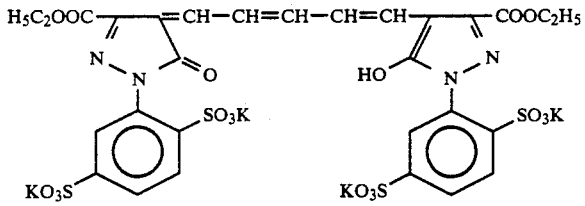

(40 mg/m²)

and

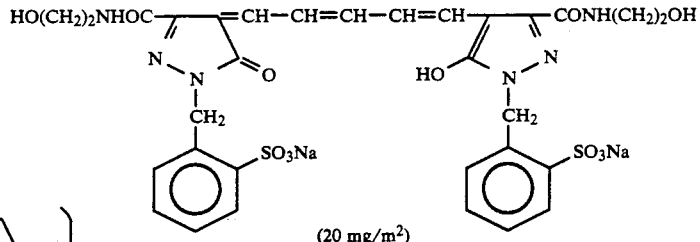

(20 mg/m²)

Composition of Layers

The composition of each layer is shown below. The figures represent coating amount (g/m²). The coating amount of each silver halide emulsion is given in terms of silver.

| | |
|---|---|
| Support | |
| Transparent support made of triacetate cellulose | |
| First Layer (Blue-sensitive emulsion layer) | |
| Silver chlorobromide emulsion described above | 0.30 |
| Gelatin | 1.22 |
| Yellow coupler ($ExY_1$) | 0.80 |

-continued

| | |
|---|---|
| Image-dye stabilizer (Cpd-1) | 0.01 |
| Solvent (Solv-3) | 0.18 |
| Solvent (Solv-7) | 0.18 |
| Image-dye stabilizer (Cpd-6) | 0.06 |
| Second Layer (Color-mix preventing layer) | |
| Gelatin | 0.64 |
| Color-mix inhibitor (Cpd-4) | 0.08 |
| Solvent (Solv-1) | 0.16 |
| Solvent (Solv-4) | 0.08 |
| Third Layer (Green-sensitive emulsion layer) | |
| Silver chlorobromide emulsions (cubic grains, 1:3 (Ag mol ratio) blend of large size emulsion B having average grain size of 0.55 μm and small size emulsion B having average grain size of 0.39 μm, each of whose deviation coefficient of grain size distribution is 0.10 and 0.08, respectively, each in which 0.8 mol % of AgBr was located at the surface of grains) | 0.12 |
| Gelatin | 1.28 |
| Magenta coupler (ExM) | 0.23 |
| Image-dye stabilizer (Cpd-1) | 0.03 |
| Image-dye stabilizer (Cpd-2) | 0.16 |
| Image-dye stabilizer (Cpd-3) | 0.02 |
| Image-dye stabilizer (Cpd-8) | 0.02 |
| Solvent (Solv-2) | 0.40 |
| Fourth Layer (Ultraviolet rays-absorbing layer) | |
| Gelatin | 1.58 |
| Ultraviolet-absorber (UV-1) | 0.47 |
| Color-mix inhibitor (Cpd-4) | 0.05 |
| Solvent (Solv-5) | 0.24 |

-continued

| | |
|---|---|
| Fifth Layer (Red-sensitive emulsion layer) | |
| Silver chlorobromide emulsions (cubic grains, 1:4 (Ag mol ratio) blend of large size emulsion C having average grain size of 0.58 μm and small size emulsion C having average grain size of 0.45 μm, each of whose deviation coefficient of grain size distribution is 0.09 and 0.11, respectively, each in which 0.6 mol % of AgBr was located at the surface of grains) | 0.23 |
| Gelatin | 1.04 |
| Cyan coupler (ExC) | 0.32 |
| Image-dye stabilizer (Cpd-1) | 0.03 |
| Image-dye stabilizer (Cpd-3) | 0.02 |
| Image-dye stabilizer (Cpd-5) | 0.18 |
| Image-dye stabilizer (Cpd-6) | 0.40 |
| Image-dye stabilizer (Cpd-7) | 0.05 |
| Solvent (Solv-6) | 0.14 |
| Sixth layer (Ultraviolet rays-absorbing layer) | |
| Gelatin | 0.48 |
| Ultraviolet absorber (UV-1) | 0.16 |
| Color-mix inhibitor (Cpd-4) | 0.02 |
| Solvent (Solv-5) | 0.08 |
| Seventh layer (Protective layer) | |
| Gelatin | 1.10 |
| Acryl-modified copolymer of polyvinyl alcohol (modification degree: 17%) | 0.17 |
| Liquid paraffin | 0.03 |

Compounds used are as follows:

(ExY$_1$) Yellow coupler

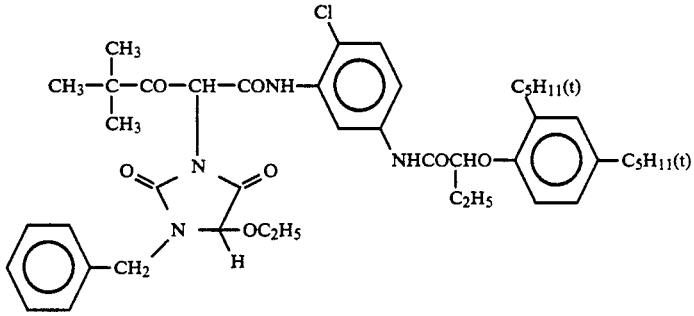

(ExY$_2$) Yellow coupler

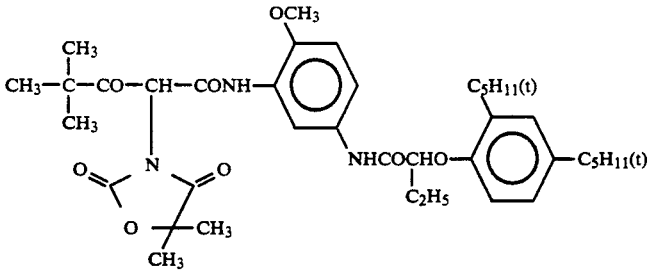

(ExM) Magenta coupler

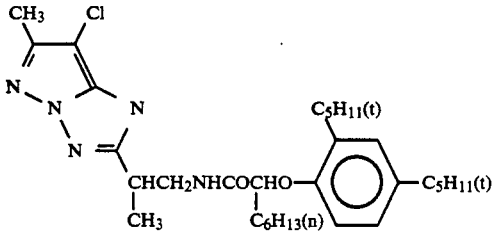

(ExC) Cyan coupler

Mixture (1:1 in molar ratio) of

-continued
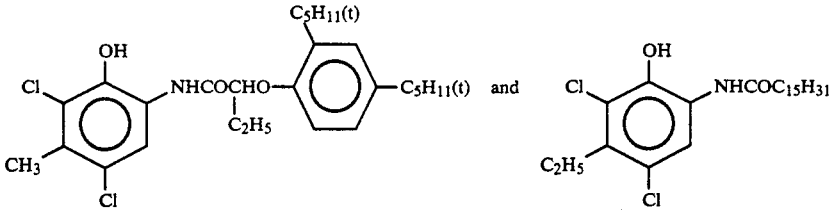
(Cpd-1) Image-dye stabilizer
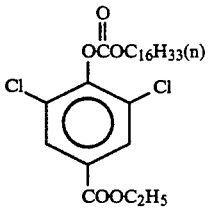
(Cpd-2) Image-dye stabilizer
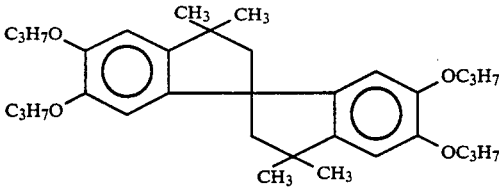
(Cpd-3) Image-dye stabilizer
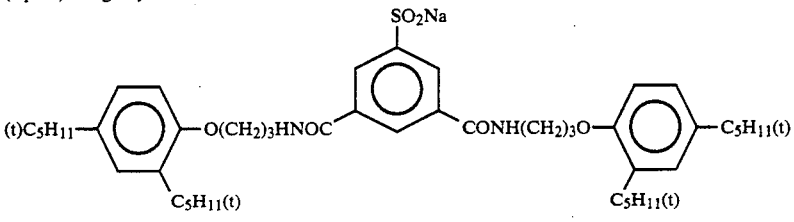
(Cpd-4) Color-mix inhibitor
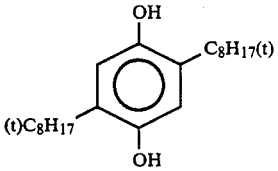
(Cpd-5) Image-dye stabilizer
Mixture (2:4:4 in weight ratio) of
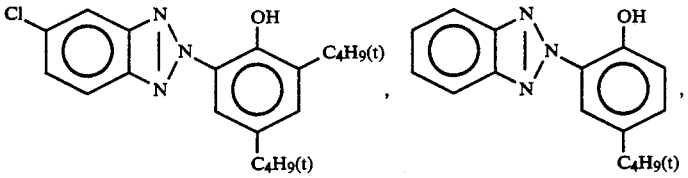
and
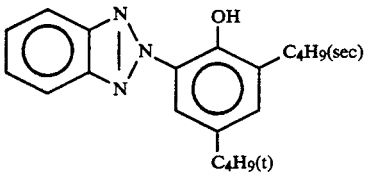
(Cpd-6) Image-dye stabilizer -continued
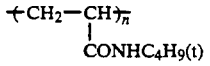
Average molecular weight: 60,000
(Cpd-7) Image-dye stabilizer
Mixture (1:1 in weight ratio) of
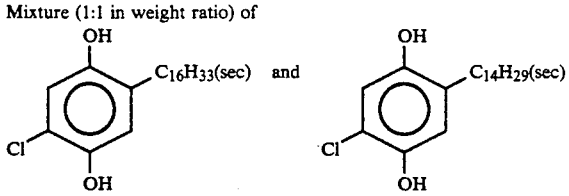
(Cpd-8) Image-dye stabilizer
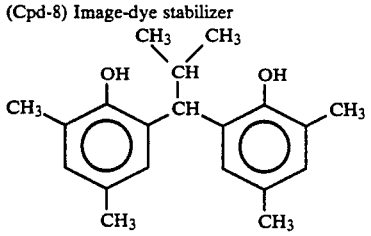
(Cpd-9) Antiseptic
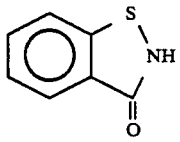
(Cpd-10) Antiseptic
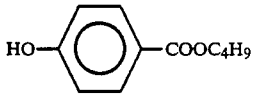
(Cpd-11) Image-dye stabilizer
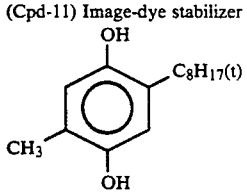
(UV-1) Ultraviolet ray absorber)
Mixture (4:2:4 in weight ratio) of
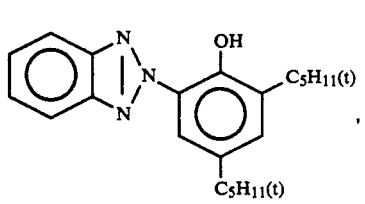
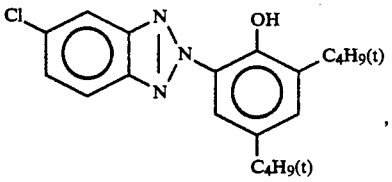
and
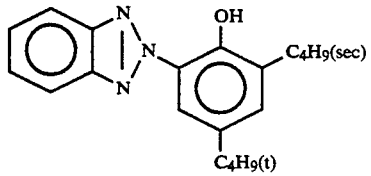
(Solv-1) Solvent -continued

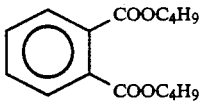

(Solv-2) Solvent
Mixture (1:1 in volume ratio) of

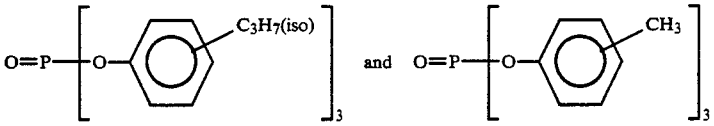

(Solv-3) Solvent
$O{=}P{-}[O{-}C_9H_{19}(iso)]_3$ (Solv-4) Solvent

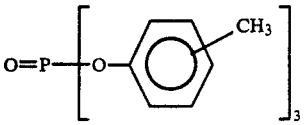

(Solv-5) Solvent

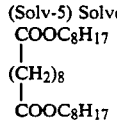

(Solv-6) Solvent
Mixture (80:20 in volume ratio) of

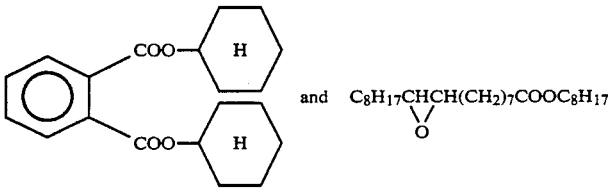

(Solv-7) Solvent

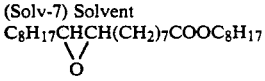

Samples 2 to 32 were prepared in the same manner as Sample 1, except that the yellow coupler and image-dye stabilizer S represented by formula (I) in the first layer were changed as shown in Table A. (Image-dye stabilizer S was coated in a coating amount 0.40 g/m$^2$.)

Then, each of samples was subjected to a gradation exposure to light through three color separated filter for sensitometry using a sensitometer (FWH model made by Fuji Photo Film Co., Ltd., the color temperature of light source was 3200K). At that time, the exposure was carried out in such a manner that the exposure amount was 250 CMS with the exposure time being 0.1 sec.

After exposure to light, each sample was subjected to a processing according to the processing step and processing solution shown below by using a paper processor.

| Processing step | Temperature | Time | Replenisher* | Tank Volume |
|---|---|---|---|---|
| Color developing | 35° C | 45 sec | 161 ml | 17 liter |
| Bleach-fixing | 30–35° C. | 45 sec | 215 ml | 17 liter |
| Rinse (1) | 30–35° C. | 20 sec | | 10 liter |
| Rinse (2) | 30–35° C. | 20 sec | | 10 liter |
| Rinse (3) | 30–35° C. | 20 sec | 350 ml | 10 liter |

-continued

| Processing step | Temperature | Time | Replenisher* | Tank Volume |
|---|---|---|---|---|
| Drying | 70–80° C. | 60 sec | | |

Note:
*Replenisher amount per m$^2$ of photographic material.

Rinsing steps were carried out in 3-tanks countercurrent mode from the tank of rinsing (3) toward the tank of rinsing (1).

The composition of each processing solution is as followed, respectively:

| Color-developer | Tank Solution | Replenisher |
|---|---|---|
| Water | 800 ml | 800 ml |
| Ethylenediamine-N,N,N',N,-tetramethylene phosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-ethyl-N-(β-methanesulfonamidoethyl)-3-methyl-4-aminoaniline sulfate | 5.0 g | 7.0 g |
| N,N-Bis(carboxymethyl)hydrazine | 4.0 g | 5.0 g |
| Monosodium N,N-di(sulfoethyl)- | 4.0 g | 5.0 g |

-continued

| Color-developer | Tank Solution | Replenisher |
|---|---|---|
| hydroxylamine | | |
| Fluorescent whitening agent (WHITEX-4B, made by Sumitomo Chemical Ind.) | 1.0 g | 2.0 g |
| Water to make | 1000 ml | 1000 ml |
| pH (25° C.) | 10.05 | 10.45 |
| Bleach-fixing solution | | |
| (Both tank solution and replenisher) | | |
| Water | | 400 ml |
| Ammonium thiosulfate (70 g/1) | | 100 ml |
| Sodium sulfite | | 17 g |
| Iron (III) ammonium ethylenediamine-tetraacetate dihydrate | | 55 g |
| Disodium ethylenediaminetetraacetate | | 5 g |
| Ammonium bromide | | 40 g |
| Water to make | | 1000 ml |
| pH (25°) | | 6.0 |
| Rinse solution | | |
| (Both tank solution and replenisher) | | |
| Ion-exchanged water (calcium and magnesium each are 3 ppm or below) | | |

With respect to the thus obtained Samples, the absorption spectra of transmitted light were determined, and the maximum absorption wavelength (λmax) at the point where the absorbance was 1.0, and the differences ($\Delta\lambda_{0.5}$ and $\Delta\lambda_{0.1}$) between the wavelengths on the longer wavelength sides that gave densities of 0.5 and 0.1 and λmax were measured.

The average particle diameter of each of the emulsions obtained above was measured; then the emulsion was stirred for 7 days under heating at 45° C. with the emulsion being in a dissolved state, and the change in the average particle diameter was checked. For the measurement of the average particle diameter, a Nanosizer made by Coulter Co. in England, was used.

The results of these tests are shown in Table A.

TABLE A

| Sample No. | Yellow Coupler | Image-dye Stabilizer S | Spectral Absorption Characteristics (nm) λ max | Δ $\lambda_{0.5}$ | Δ $\lambda_{0.1}$ | Emulsion Stability (Ave. Grain Diameter) (μm) Fresh | After 7 Days | Remarks |
|---|---|---|---|---|---|---|---|---|
| 1 | $ExY_1$ | — | 445 | 42.1 | 79.5 | 0.20 | 0.39 | Comparison |
| 2 | $Y_1$-1 | — | 445 | 37.3 | 68.9 | 0.20 | 0.37 | " |
| 3 | $Y_1$-6 | — | 446 | 36.8 | 69.9 | 0.21 | 0.37 | " |
| 4 | $Y_1$-7 | — | 446 | 35.8 | 69.5 | 0.20 | 0.36 | " |
| 5 | $Y_1$-9 | — | 444 | 33.6 | 66.8 | 0.19 | 0.36 | " |
| 6 | $Y_2$-1 | — | 442 | 37.6 | 74.7 | 0.19 | 0.38 | " |
| 7 | $Y_2$-4 | — | 443 | 38.9 | 79.0 | 0.20 | 0.38 | " |
| 8 | $Y_2$-9 | — | 443 | 38.5 | 76.1 | 0.20 | 0.39 | " |
| 9 | $Y_2$-12 | — | 443 | 40.9 | 79.0 | 0.20 | 0.39 | " |
| 10 | $Y_2$-29 | — | 444 | 36.7 | 71.6 | 0.19 | 0.38 | " |
| 11 | $Y_2$-30 | — | 444 | 38.8 | 77.5 | 0.19 | 0.40 | " |
| 12 | $Y_2$-41 | — | 444 | 39.0 | 78.1 | 0.20 | 0.39 | " |
| 13 | $ExY_1$ | — | 445 | 42.2 | 79.5 | 0.19 | 0.49 | " |
| 14 | $ExY_1$ | — | 445 | 42.1 | 79.6 | 0.19 | 0.48 | " |
| 15 | $ExY_1$ | — | 445 | 42.2 | 79.6 | 0.19 | 0.49 | " |
| 16 | $Y_1$-1 | I-18 | 445 | 37.4 | 68.9 | 0.20 | 0.37 | This Invention |
| 17 | $Y_1$-6 | " | 446 | 36.8 | 69.8 | 0.20 | 0.37 | " |
| 18 | $Y_1$-7 | " | 446 | 35.9 | 69.5 | 0.21 | 0.37 | " |
| 19 | $Y_1$-9 | " | 444 | 33.7 | 66.9 | 0.19 | 0.36 | " |
| 20 | $Y_2$-1 | " | 442 | 37.7 | 74.7 | 0.19 | 0.37 | " |
| 21 | $Y_2$-4 | " | 443 | 38.9 | 79.0 | 0.20 | 0.39 | " |
| 22 | $Y_1$-9 | " | 443 | 38.6 | 76.0 | 0.20 | 0.40 | " |
| 23 | $Y_2$-12 | " | 443 | 40.9 | 79.0 | 0.20 | 0.39 | " |
| 24 | $Y_2$-29 | " | 444 | 36.7 | 71.6 | 0.19 | 0.39 | " |
| 25 | $Y_2$-30 | " | 444 | 38.9 | 77.5 | 0.20 | 0.40 | " |
| 26 | $Y_2$-41 | " | 444 | 39.0 | 78.1 | 0.19 | 0.40 | " |
| 27 | $Y_1$-1 | I-3 | 445 | 37.5 | 68.9 | 0.20 | 0.37 | " |
| 28 | " | I-25 | 445 | 37.5 | 68.9 | 0.19 | 0.36 | " |
| 29 | " | I-43 | 445 | 37.4 | 68.9 | 0.20 | 0.37 | " |
| 30 | $Y_2$-41 | I-3 | 444 | 39.0 | 78.1 | 0.20 | 0.39 | " |
| 31 | " | I-43 | 444 | 38.9 | 78.0 | 0.19 | 0.38 | " |
| 32 | " | I-47 | 444 | 39.0 | 78.2 | 0.20 | 0.40 | " |

As is apparent from the results in Table A, the yellow color-formed dyes obtained from yellow couplers of the present invention are low in $\Delta\lambda_{0.5}$ and $\Delta\lambda_{0.1}$ values and give sharp absorption spectra free from undesired absorption. As such, it can be understood that yellow color-formed dyes excellent in spectral absorption properties are given in comparison with Comparative Couplers $ExY_1$.

Further, when the image-dye stabilizer S represented by formula (I) and the yellow coupler of the present invention were used in combination, the change of emulsion stability and the change of spectral absorption characteristics were not observed, thereby showing excellent abilities of yellow coupler of this invention and yellow-colored dye obtained from said coupler.

Further, when these Samples were processed with a paper processing solution which had been used for continuous processing (running test) until the processing solution for color development was replenished in an amount twice as large as the volume of the tank, and the same test as above was carried out, the same effect as above was observed.

EXAMPLE 2

Samples 2-1 to 2-63 were prepared in the same manner as Example 1, except that as the support a paper laminated on both side thereof with polyethylene film, followed by subjecting to a corona discharge treatment of surface, was used, and respective yellow couplers and image-dye stabilizers represented by formula (I) were changed as shown in Table B.

Samples thus prepared were subjected to the same exposure to light and the same processing as Example 1, and irradiated with light for 5 days using a Xenon Fade-O-Meter (100,000 lux). The measure of light-fastness was expressed in terms of percentage (%) of the density (D) after the irradiation with light in relation to the initial density ($D_0$) = 1.5. The greater the value is, excellent light-fastness is meant.

TABLE B

| Sample No. | Yellow Coupler | Image-dye Stabilizer S | Light-fastness of Yellow Coupler (%) | Remarks |
|---|---|---|---|---|
| 2-1 | $ExY_1$ | — | 77 | Comparison |
| 2-2 | $ExY_2$ | — | 75 | " |
| 2-3 | $Y_1$-1 | — | 75 | " |
| 2-4 | $Y_1$-21 | — | 74 | " |
| 2-5 | $Y_1$-31 | — | 75 | " |
| 2-6 | $Y_1$-40 | — | 77 | " |
| 2-7 | $Y_1$-51 | — | 76 | " |
| 2-8 | $Y_1$-71 | — | 76 | " |
| 2-9 | $Y_1$-72 | — | 77 | " |
| 2-10 | $Y_1$-77 | — | 77 | " |
| 2-11 | $Y_2$-1 | — | 73 | " |
| 2-12 | $Y_2$-9 | — | 74 | " |
| 2-13 | $Y_2$-29 | — | 74 | " |
| 2-14 | $Y_2$-41 | — | 73 | " |
| 2-15 | $Y_2$-43 | — | 74 | " |
| 2-16 | $Y_2$-54 | — | 74 | " |
| 2-17 | $ExY_1$ | I-3 | 79 | " |
| 2-18 | " | I-18 | 79 | " |
| 2-19 | " | I-25 | 78 | " |
| 2-20 | " | I-43 | 78 | " |
| 2-21 | " | I-47 | 80 | " |
| 2-22 | " | I-49 | 80 | " |
| 2-23 | $ExY_2$ | I-3 | 78 | " |
| 2-24 | " | I-18 | 78 | " |
| 2-25 | " | I-43 | 79 | " |
| 2-26 | " | I-49 | 77 | " |
| 2-27 | $Y_1$-1 | I-18 | 84 | This Invention |
| 2-28 | $Y_1$-21 | " | 84 | " |
| 2-29 | $Y_1$-31 | " | 83 | " |
| 2-30 | $Y_1$-40 | " | 85 | " |
| 2-31 | $Y_1$-50 | " | 84 | " |
| 2-32 | $Y_1$-72 | " | 84 | " |
| 2-33 | $Y_1$-77 | " | 85 | " |
| 2-34 | $Y_1$-1 | I-3 | 85 | " |
| 2-35 | $Y_1$-77 | " | 83 | " |
| 2-36 | $Y_1$-71 | I-3 | 84 | This Invention |
| 2-37 | $Y_1$-15 | I-43 | 84 | " |
| 2-38 | $Y_1$-50 | " | 84 | " |
| 2-39 | $Y_1$-71 | " | 85 | " |
| 2-40 | $Y_2$-1 | I-18 | 84 | " |
| 2-41 | $Y_2$-9 | " | 84 | " |
| 2-42 | $Y_2$-30 | " | 85 | " |
| 2-43 | $Y_2$-43 | " | 84 | " |
| 2-44 | $Y_2$-41 | " | 84 | " |
| 2-45 | $Y_2$-54 | " | 84 | " |
| 2-46 | $Y_2$-1 | I-8 | 83 | " |
| 2-47 | $Y_2$-9 | " | 82 | " |
| 2-48 | $Y_2$-41 | " | 84 | " |
| 2-49 | $Y_2$-43 | " | 84 | " |
| 2-50 | $Y_2$-54 | " | 82 | " |
| 2-51 | $Y_2$-1 | I-43 | 82 | " |
| 2-52 | $Y_2$-41 | " | 83 | " |
| 2-53 | $Y_2$-54 | " | 83 | " |
| 2-54 | $Y_2$-57 | I-3 | 84 | " |
| 2-55 | " | I-18 | 85 | " |
| 2-56 | " | I-25 | 83 | " |
| 2-57 | " | I-43 | 83 | " |
| 2-58 | $Y_1$-71 | I-47 | 82 | " |
| 2-59 | " | I-49 | 82 | " |
| 2-60 | $Y_2$-43 | I-18 | 84 | " |
| 2-61 | " | I-25 | 83 | " |
| 2-62 | " | I-43 | 83 | " |
| 2-63 | " | I-47 | 84 | " |
| 2-64 | " | I-49 | 82 | " |
| 2-65 | $Y_2$-59 | I-3 | 84 | " |
| 2-66 | " | I-8 | 84 | " |
| 2-67 | " | I-18 | 84 | " |
| 2-68 | " | I-43 | 84 | " |

TABLE B-continued

| Sample No. | Yellow Coupler | Image-dye Stabilizer S | Light-fastness of Yellow Coupler (%) | Remarks |
|---|---|---|---|---|
| 2-69 | " | I-49 | 84 | " |

As is apparent from the results in Table B, in the Samples of the present invention prepared by the combined use of a compound represented by formula (I) and a yellow coupler represented by formula (II) or (III), or an α-acylacetamide yellow coupler represented by formula (IV), the light-fastness was improved.

Further, when these Samples were processed with a paper processing solution which had been used for continuous processing (running test) until the processing solution for color development was replenished in an amount twice as large as the volume of the tank, and the same test as above was carried out, the same effect as above was observed.

Having described our invention as related to the present embodiments, it is our intention that the invention not be limited by any of the details of the description, unless otherwise specified, but rather be construed broadly within its spirit and scope as set out in the accompanying claims.

What we claim is:

1. A silver halide color photographic material having, a blue-sensitive silver halide emulsion layer, a green-sensitive silver halide emulsion layer, a red-sensitive silver halide emulsion layer, and non-photosensitive layers adjacent to these emulsion layers, on a base, wherein said blue-sensitive silver halide emulsion layer comprises at least one compound represented by the following formula (I), and at least one coupler selected from the group consisting of yellow couplers represented by the following formula (II) or (III) and an α-acylacetamide yellow coupler represented by formula (IV):

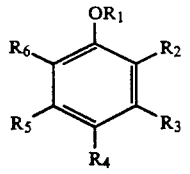

wherein $R_1$ represents an alkyl group, an alkenyl group, an aryl group, a heterocyclic group, a silyl group, an acyl group, a sulfonyl group, or an $R_o$ group shown below in which $R_{1a}$ and $R_{1b}$ are the same or different; $R_2$, $R_3$, $R_4$, $R_5$, and $R_6$, which are the same or different, each represent a hydrogen atom, a halogen atom, an alkyl group, an alkenyl group, an aryl group, a substituted amino group, an alkylthio group, an arylthio group, and $R_p$ group, an $R_q$ group, and $R_r$ group, an $R_s$ group, and $R_t$ group, or an $R_u$ group, shown below; $R_{1a}$, $R_{1b}$, and $R_{1c}$ each have the same meaning as that of $R_1$, $R_2$ and $R_3$ and $R_4$or $R_5$ and $R_6$ may bond together to form a 5- or 6-membered ring or a spiro ring, and v and w each represent 0 or 1, provided that at least one of v and w is 0,

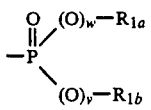

$R_o$

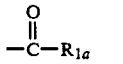

$R_p$ $-SO_2R_{1a}$ $R_q$

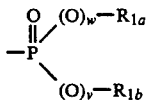

$R_r$

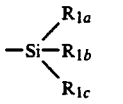

$R_s$

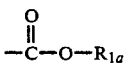

$R_t$ $-OR_{1a}$ $R_u$

Formula (II)

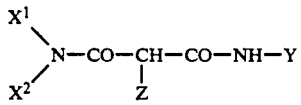

Formula (III)

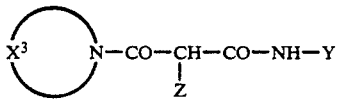

wherein $X^1$ and $X^2$ each represent an alkyl group, an aryl group, or a heterocyclic group, $X^3$ represents an organic residue which forms together with the >N— a nitrogen-containing heterocyclic group, Y represents an aryl group or a heterocyclic group, and Z represents a group which will be released upon a coupling reaction of the coupler represented by the formula (II) or (III) with the oxidized product of a developing agent, Formula (IV)

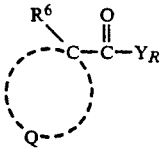

wherein $R_6$ represents a monovalent group, Q represents a group of non-metallic atoms required to form together with C (carbon atom) a substituted or unsubstituted 3- to 5-membered cyclic hydrocarbon group or a substituted or unsubstituted heterocyclic group having the in the group at least one heteroatom selected from the group consisting of N, S, O, and P, and $Y_R$ represents a residue remaining after removing the acyl group

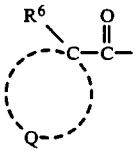

at the α-position of the acetamide moiety from the acetylacetamide yellow coupler represented by formula (IV), provided that $R^6$ is a group other than a hydrogen atom and does not bond to the Q to form a ring.

2. The silver halide color photographic material as claimed in claim 1, wherein $R_1$ and $R_2$ in formula (I) bond together to form a 5- or 6-membered ring or a spiro ring.

3. The silver halide color photographic material as claimed in claim 1, wherein $R_2$ and $R_3$, or $R_3$ and $R_4$, in formula (I), bond together to form a 5- or 6-membered ring or a spiro ring.

4. The silver halide color photographic material as claimed in claim 1, wherein the compound represented by formula (I) is selected from the group consisting of compounds represented by the following formulae (I-a) to (I-h), Formula (I-a)

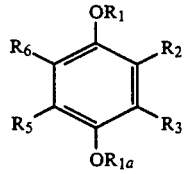

Formula (I-b)

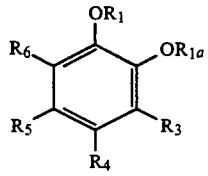

Formula (I-c)

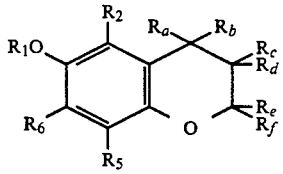

Formula (I-d)

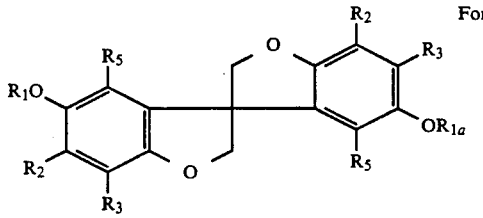

Formula (I-e)

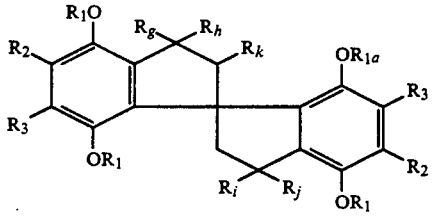

Formula (I-f)

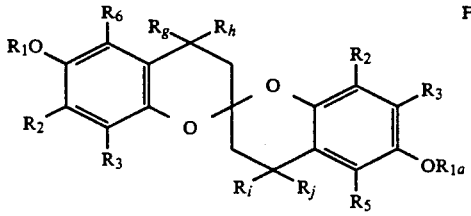

-continued

Formula (I-g)

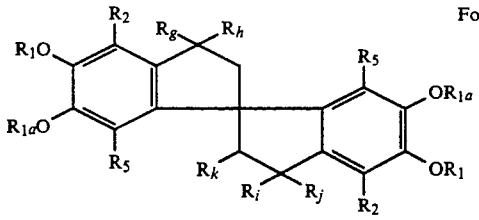

Formula (I-h)

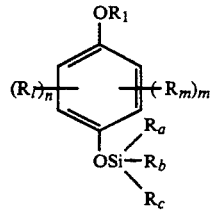

wherein $R_1$, $R_{1a}$, $R_2$, $R_3$, $R_4$, $R_5$, and $R_6$ have the same meanings as defined in formula (I); $R_a$ to $R_k$, which are the same or different, each represent a hydrogen atom, an alkyl group, or an aryl group; $R_d$ and $R_e$, and $R_e$ and $R_f$ may bond together to form a 5- to 7-membered hydrocarbon ring; $R_l$ and $R_m$, which are the same or different, each represent a hydrogen atom, an alkyl group, an aryl group, an acyl group, an oxycarbonyl group, or a sulfonyl group, $R_l$ and $R_m$ do not represent hydrogen atoms at the same time respectively, $R_l$ and $R_m$ may bond together to form a 5- to 7-membered ring, m is 1 or 2, and n is 0 or 1, provided that m+n is 1 or 2.

5. The silver halide color photographic material as claimed in claim 4, wherein $R_1$ and $R_{1a}$ in formulae (I-a) to (I-h) each represent an alkyl group or an aryl group.

6. The silver halide color photographic material as claimed in claim 4, wherein $R_2$ to $R_6$ in formulae (I-a) to (I-h) each represent a hydrogen atom, an alkyl group or an aryl group.

7. The silver halide color photographic material as claimed in claim 4, wherein the compound represented by formula (I) is selected from the group consisting of compounds represented by formulae (I-d), (I-e), (I-g), and (I-h).

8. The silver halide color photographic material as claimed in claim 1, wherein the compound represented by formula (I) is contained in an amount in the range of 0.01 to 2.0 mol per mol of the yellow coupler.

9. The silver halide color photographic material as claimed in claim 1, wherein the yellow coupler represented by formula (II) or (III) is selected from the group consisting of compounds represented by the following formulae (A), (B), and (C):

Formula (A)

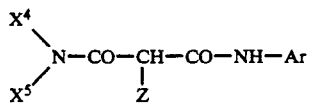

Formula (B)

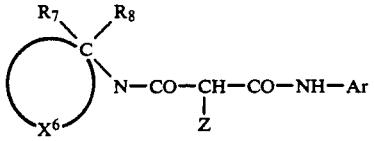

-continued

Formula (C)

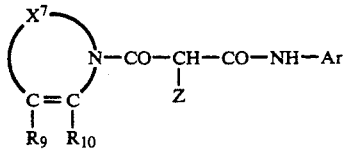

wherein Z has the same meaning as defined in formula (II), $X^4$ represents an alkyl group, $X^5$ represents an alkyl group or an aromatic group, Ar represents a phenyl group having at least one substituent in the ortho position, $X^6$ represents an organic residue required to form a nitrogen-containing cyclic group (monocyclic or condensed ring) together with the —C($R_7R_8$)—N<, $X^7$ represents an organic residue required to form a nitrogen heterocyclic group (monocyclic or condensed ring) together with the —C($R_9$)=C($R_{10}$)—N<, and $R_7$, $R_8$, $R_9$, and $R_{10}$ each represent a hydrogen atom or a substituent.

10. The silver halide color photographic material as claimed in claim 1, wherein $X^1$ or $X^2$ in formula (II) is an alkyl group having 1 to 10 carbon atoms.

11. The silver halide color photographic material as claimed in claim 1, wherein Y in formulas (II) and (III) is a phenyl group having at least one substituent on the ortho position thereof.

12. The silver halide color photographic material as claimed in claim 1, wherein Z in formulas (II) and (III) is a 5- to 6-membered nitrogen-containing heterocyclic group bonded to the coupling site through the nitrogen atom, an aromatic oxy group, a 5- to 6-membered heterocyclic oxy group, or a 5- to 6-membered heterocyclic thio group.

13. The silver halide color photographic material as claimed in claim 1, wherein the coupler represented by formula (II) or (III) forms a dimer or higher polymer by bonding at the groups represented by $X^1$ to $X^3$, Y, and Z through a divalent group or more higher polyvalent group.

14. The silver halide color photographic material as claimed in claim 1, wherein the coupler represented by formula (II) or (III) is a nondiffusible coupler.

15. The silver halide color photographic material as claimed in claim 1, wherein the α-acylacetamide yellow dye-forming coupler is represented by the following formula (Y):

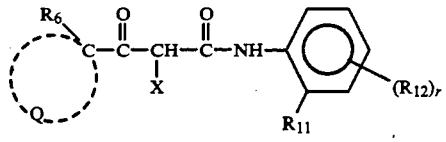

wherein $R^6$ represents a monovalent substituent other than hydrogen; Q represents a group of non-metallic atoms required to form together with the C a substituted or unsubstituted 3- to 5-membered cyclic hydrocarbon group or a substituted or unsubstituted 3- to 5-membered heterocyclic group having in the group at least one heteroatom selected from a group consisting of N, O, S, and P; $R_{11}$ represents a hydrogen atom, a halogen atom, an alkoxy group, an aryloxy group, an alkyl group, or an amino group, $R_{12}$ represents a group capable of substitution onto a benzene ring, X represents a hydrogen atom or a group capable of being released upon a coupling reaction thereof with the oxidized product of an aromatic primary amine developing agent, r is an integer of 0 to 4, and when r is 2 or more, the $R_{12}$ groups may be the same or different.

16. The silver halide color photographic material as claimed in claim 1, wherein $R^6$ in formula (IV) is a halogen atom or an alkyl group.

17. The silver halide color photographic material as claimed in claim 1, wherein the ring formed by Q together with the C in formula (IV) is a substituted or unsubstituted 3-, 4-, or 5-membered cyclic hydrocarbon group.

18. The silver halide color photographic material as claimed in claim 1, wherein the ring formed by Q together with the C in formula (IV) is a substituted or unsubstituted 3-membered cyclic hydrocarbon group.

19. The silver halide color photographic material as claimed in claim 15, wherein $R_{11}$ in formula (Y) represents a chlorine atom, fluorine atom, an alkyl group, an alkoxy group, or an aryloxy group.

20. The silver halide color photographic material as claimed in claim 15, wherein $R_{12}$ in formula (Y) represents a halogen atom, an alkoxy group, an alkoxycarbonyl group, an aryloxycarbonyl group, a carbonamido group, a sulfonamido group, a carbamoyl group, or a sulfamoyl group.

21. The silver halide color photographic material as claimed in claim 15, wherein X in formula (Y) represents a heterocyclic group bonded to the coupling active site through the nitrogen atom or an aryloxy group.

22. The silver halide color photographic material as claimed in claim 1, wherein the coupler represented by formula (II), (III), or (IV) is contained in the range of 0.1 to 1.0 mol per mol of the silver halide in the layer where the yellow coupler is used.

23. The silver halide color photographic material as claimed in claim 1, wherein at least one layer of silver halide emulsion layers comprises a silver chloride emulsion or a silver bromochloride emulsion being substantially free from silver iodide and having a silver chloride content of 90 mol % or more.

24. The silver halide color photographic material as claimed in claim 23, wherein the silver chloride content is 95 mol % or more.

25. The silver halide color photographic material as claimed in claim 24, wherein the silver chloride content is 98 mol % or more.

26. The silver halide color photographic material as claimed in claim 1, wherein said group Z of formulae (II) and (III) is a non-photographically useful group.

27. The silver halide color photographic material as claimed in claim 1, wherein

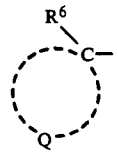

of formula (IV) represents a monovalent group selected from the group consisting of

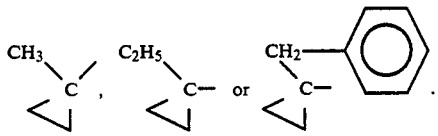

* * * * *